US009488013B2

(12) United States Patent
Donnally et al.

(10) Patent No.: US 9,488,013 B2
(45) Date of Patent: Nov. 8, 2016

(54) BI-DIRECTIONALLY RAISABLE DRILLING RIG MAST

(71) Applicant: National Oilwell Varco, L.P., Houston, TX (US)

(72) Inventors: Robert Benjamin Donnally, Shanghai (CN); Chunqiao Ren, Shanghai (CN); Xilin Liu, Henan (CN)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/529,693

(22) Filed: Oct. 31, 2014

(65) Prior Publication Data

US 2015/0052828 A1 Feb. 26, 2015

Related U.S. Application Data

(62) Division of application No. 13/868,696, filed on Apr. 23, 2013, now Pat. No. 8,904,716.

(60) Provisional application No. 61/637,677, filed on Apr. 24, 2012.

(51) Int. Cl.
*B66C 23/06* (2006.01)
*E21B 15/00* (2006.01)
(Continued)

(52) U.S. Cl.
CPC ..... *E21B 15/00* (2013.01); *E21B 7/00* (2013.01); *E21B 7/02* (2013.01)

(58) Field of Classification Search
CPC ..... E21B 15/00; E21B 15/003; E21B 7/00; E21B 7/02; E21B 7/021; E21B 7/023; E21B 7/026
USPC ..... 52/123.1, 111, 117, 118, 120, 745.18, 52/745.17, 114, 116; 254/5 C, 250, 258, 254/261
See application file for complete search history.

(56) References Cited

U.S. PATENT DOCUMENTS 5,503,368 A 4/1996 Torres
5,855,359 A 1/1999 Chipperfield
(Continued)

FOREIGN PATENT DOCUMENTS

CN 201125675 Y 10/2008
CN 101435313 A 5/2009
(Continued)

OTHER PUBLICATIONS

Office Action from related application U.S. Appl. No. 13/868,676 dated Jan. 30, 2014.
(Continued)

*Primary Examiner* — Mark Wendell
(74) *Attorney, Agent, or Firm* — Amerson Law Firm, PLLC

(57) ABSTRACT

Disclosed herein is a bi-directionally raisable drilling rig mast system that includes a drilling rig mast having a bi-directional mast erection connection, a first erection connection positioned proximate a first side of a rig substructure, and a second erection connection positioned proximate a second side of the rig substructure, the second side being at an opposite side of the rig substructure from the first side. The system further includes at least one mast erection apparatus having an upper end that is adapted to be pivotably attached to the bi-directional mast erection connection and a lower end that is adapted to be pivotably attached to the first erection connection for erecting the drilling rig mast from the first side of the substructure, the lower end being further adapted to be pivotably attached to the second erection connection for erecting the drilling rig mast from the second side of the substructure.

19 Claims, 55 Drawing Sheets

(51) Int. Cl.
*E21B 7/02* (2006.01)
*E21B 7/00* (2006.01)

(56) References Cited

U.S. PATENT DOCUMENTS

| | | | |
|---|---|---|---|
| 6,286,812 | B1 | 9/2001 | Cherry |
| 6,533,045 | B1 | 3/2003 | Cooper |
| 6,848,515 | B2 | 2/2005 | Orr et al. |
| 7,163,087 | B2 | 1/2007 | Putnam |
| 7,234,896 | B2 | 6/2007 | Donnally et al. |
| 7,347,410 | B2 | 3/2008 | Atkinson, Jr. |
| 7,765,749 | B2 | 8/2010 | Palidis |
| 8,172,497 | B2 | 5/2012 | Orgeron et al. |
| 2003/0121230 | A1 | 7/2003 | Bockhorn et al. |
| 2004/0211572 | A1 | 10/2004 | Orr et al. |
| 2004/0211598 | A1 | 10/2004 | Palidis |
| 2005/0193645 | A1 | 9/2005 | Barnes |
| 2005/0194189 | A1 | 9/2005 | Barnes |
| 2006/0213653 | A1 | 9/2006 | Cunningham et al. |
| 2009/0188677 | A1 | 7/2009 | Ditta et al. |
| 2009/0218137 | A1 | 9/2009 | Donnally et al. |
| 2009/0218138 | A1 | 9/2009 | Donnally et al. |
| 2009/0218139 | A1 | 9/2009 | Donnally et al. |
| 2009/0218144 | A1 | 9/2009 | Donnally et al. |
| 2009/0272953 | A1 | 11/2009 | Wolf |
| 2010/0326734 | A1 | 12/2010 | Wasterval |
| 2011/0072737 | A1 | 3/2011 | Wasterval |
| 2012/0066999 | A1 | 3/2012 | Donnally et al. |
| 2013/0276386 | A1 | 10/2013 | Donnally et al. |

FOREIGN PATENT DOCUMENTS

| | | | |
|---|---|---|---|
| CN | 201273147 | Y | 7/2009 |
| CN | 201747282 | U | 2/2011 |
| CN | 102364033 | A | 2/2012 |

OTHER PUBLICATIONS

PCT International Search Report and Written Opinion dated Jun. 13, 2014 for International Application No. PCT/US2013/037904, 9 pages.

PCT International Search Report and Written Opinion dated Jun. 23, 2014 for International Application No. PCT/US2013/037906, 9 pages.

Office Action dated Jul. 24, 2015 from the Chinese Intellectual Property Office for Chinese patent application No. 201380032094.4, including translation and letter from foreign agent, 11 pages total.

BI-DIRECTIONALLY RAISABLE DRILLING RIG MAST

CROSS-REFERENCE TO RELATED APPLICATIONS

This application is a divisional of U.S. patent application Ser. No. 13/868,696, filed Apr. 23, 2013, which claims priority from U.S. Provisional Patent application Ser. No. 61/637,677, filed on Apr. 24, 2012, and is hereby incorporated by reference for all it contains.

BACKGROUND

1. Field of the Disclosure

The present subject matter is generally directed to mobile drilling rig assemblies, and in particular, to a bi-directionally raisable drilling rig mast to facilitate assembly and erection of the mast from either the setback side or the drawworks side of a drilling rig.

2. Description of the Related Art

In many land-based oil and gas drilling operations, drilling rigs are delivered to an oilfield drilling site by transporting the various components of the drilling rig over roads and/or highways. Typically, the various drilling rig components are transported to a drilling site on one or more truck/trailer combinations, the number of which may depend on the size, weight, and complexity of the rig. Once at the drilling site, the drilling rig components are then assembled, and the drilling rig assembly is raised to an operating position so as to perform drilling operations. After the completion of drilling operations, the mobile drilling rig is then lowered, disassembled, loaded back onto truck/trailer combinations, and transported to a different oilfield drilling site for new drilling operations. Accordingly, the ease with which the various drilling rig components can be transported, assembled and disassembled, and raised and lowered can be a substantial factor in the drilling rig design, as well as the rig's overall operational capabilities and cost effectiveness.

As drilling rig technologies have progressed, the size and weight of mobile drilling rigs has significantly increased so as to meet the higher drilling load capabilities that are oftentimes required to drill deeper wells, particularly in more mature oilfield formations. For example, it is not uncommon for many land-based mobile drilling rigs to have a 1500-2000 HP capability, with hook load capacities of 1 million pounds or greater. Additionally, there are some even larger 3000 HP mobile drilling rigs in operation, with hook and/or rotary load capacities exceeding 1.5 million pounds.

However, as the capacity—and the overall size and weight—of mobile drilling rigs increases, the size and weight of many of the various components of the rig also proportionately increase, a situation that can sometimes contribute to an overall reduction in at least some of the "mobility" characteristics of the rig. For example, a typical drawworks for a 2000 HP mobile rig may weigh in the range of 80-100 thousand pounds, or even more. Furthermore, individual sections of a drilling rig mast may be 30-40 feet or more in length, and may weigh 20-80 thousand pounds. In many cases, such large and heavy components require the use of a suitably sized crane so as to lift and position the various drilling components during rig assembly. Accordingly, while each the various larger rig components may be "transportable" over roads and/or highways from one oilfield drilling site to another, the overall logistical considerations for using at least some higher capacity mobile drilling rigs, e.g., 1500 HP and greater, may need to include having a crane present at a given drilling site prior to the commencement of drilling operations in order to facilitate initial rig assembly. Furthermore, a crane must also be present after the completion of drilling operations so as to facilitate rig disassembly for transportation to other oilfield drilling sites. As may be appreciated, the requirement that a crane be used during these assembly/disassembly stages can have a significant impact on the overall cost of the drilling operation, as well as the amount of time that may be needed to perform the operations.

Accordingly, there is a need to develop and implement new designs and methods for facilitating the assembly of modern mobile drilling rigs having higher operating capacities without relying on the use of a conventional crane to facilitate the assembly and/or disassembly the rig. The following disclosure is directed to the design and use of mobile drilling rigs that address, or at least mitigate, at least some of the problems outlined above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein is directed to mobile drilling rig assemblies having a movable center floor section that may be used in conjunction with a raisable rig substructure so as to facilitate the assembly and installation of large and/or heavy drilling rig components, such as the drilling rig mast sections and the rig drawworks and the like, without relying on the use of a conventional crane to lift and/or position the rig components. The disclosed subject matter is also directed various aspects of bi-directionally raisable drilling rig masts, which may be assembled and erected from either the drawworks side or the setback side of an illustrative mobile drilling rig.

In one illustrative embodiment, a bi-directionally raisable drilling rig mast system is disclosed that includes, among other things, a drilling rig mast having a bi-directional mast erection connection, a first erection connection positioned proximate a first side of a rig substructure, and a second erection connection positioned proximate a second side of the rig substructure, the second side being at an opposite side of the rig substructure from the first side. The disclosed bi-directionally raisable drilling rig mast system further includes at least one mast erection apparatus having an upper end that is adapted to be pivotably attached to the bi-directional mast erection connection and a lower end that is adapted to be pivotably attached to the first erection connection for erecting the drilling rig mast from the first side of the rig substructure. Furthermore, the lower end is also adapted to be pivotably attached to the second erection connection for erecting the drilling rig mast from the second side of the rig substructure.

In another embodiment, an exemplary bi-directionally raisable drilling rig mast system is disclosed that includes a drilling rig mast, a first erection connection positioned proximate a first side of a rig substructure, and a second erection connection positioned proximate a second side of the rig substructure that is opposite of the first side. The drilling rig mast includes, among other things, a bi-directional mast erection connection and a bi-directional drilling rig mast connection system that is adapted to removably connect a bottom mast section of the drilling rig mast to at least one further mast section of the drilling rig mast when an upper end of the drilling rig mast is oriented toward the first side of a rig structure and when the upper end of the drilling rig mast is oriented toward the second side of the rig structure. The disclosed bi-directionally raisable drilling rig mast system further includes a mast erection apparatus having an upper end that is adapted to be pivotably attached to the bi-directional mast erection connection and a lower end that is adapted to be pivotably attached to the first erection connection for erecting the drilling rig mast from the first side of the rig substructure, wherein the lower end is further adapted to be pivotably attached to the second erection connection for erecting the drilling rig mast from the second side of the rig substructure.

In yet a further illustrative embodiment of the present disclosure, a bi-directionally raisable drilling rig mast system includes a drilling rig mast of a drilling rig, the drilling rig mast including a bi-directional mast erection connection. The disclosed bi-directionally raisable drilling rig mast system also includes, among other things, a first erection connection that is adapted to be positioned proximate a first end of a lower substructure box of a drilling riu substructure and a second erection connection that is adapted to be positioned proximate a second end of the lower substructure box, wherein the first end of the lower substructure box is oriented toward a setback side of the drilling rig and the second end of the lower substructure box is oriented toward a drawworks side of the drilling rig. Additionally, a mast support shoe is attached to an upper substructure box of the drilling rig substructure, wherein a lower end of the drilling rig mast is adapted to be pivotably attached to the mast support shoe. Furthermore, the bi-directionally raisable drilling rig mast system includes a mast erection apparatus that is adapted to pivotably erect the drilling rig mast above the upper substructure box while the lower end of the drilling rig mast is pivotably attached to the mast support shoe, the mast erection apparatus having an upper end and a lower end. The upper end of the mast erection apparatus is adapted to be pivotably attached to the bi-directional mast erection connection for pivotably erecting the drilling rig mast, the lower end of the mast erection apparatus is adapted to be pivotably attached to the first erection connection for erecting the drilling rig mast from the setback side of the drilling rig, the lower end of the mast erection apparatus being further adapted to be pivotably attached to the second erection connection for erecting the drilling rig mast from the draw works side of the drilling rig.

BRIEF DESCRIPTION OF THE DRAWINGS

The disclosure may be understood by reference to the following description taken in conjunction with the accompanying drawings, in which like reference numerals identify like elements, and in which.

Figure 1A:
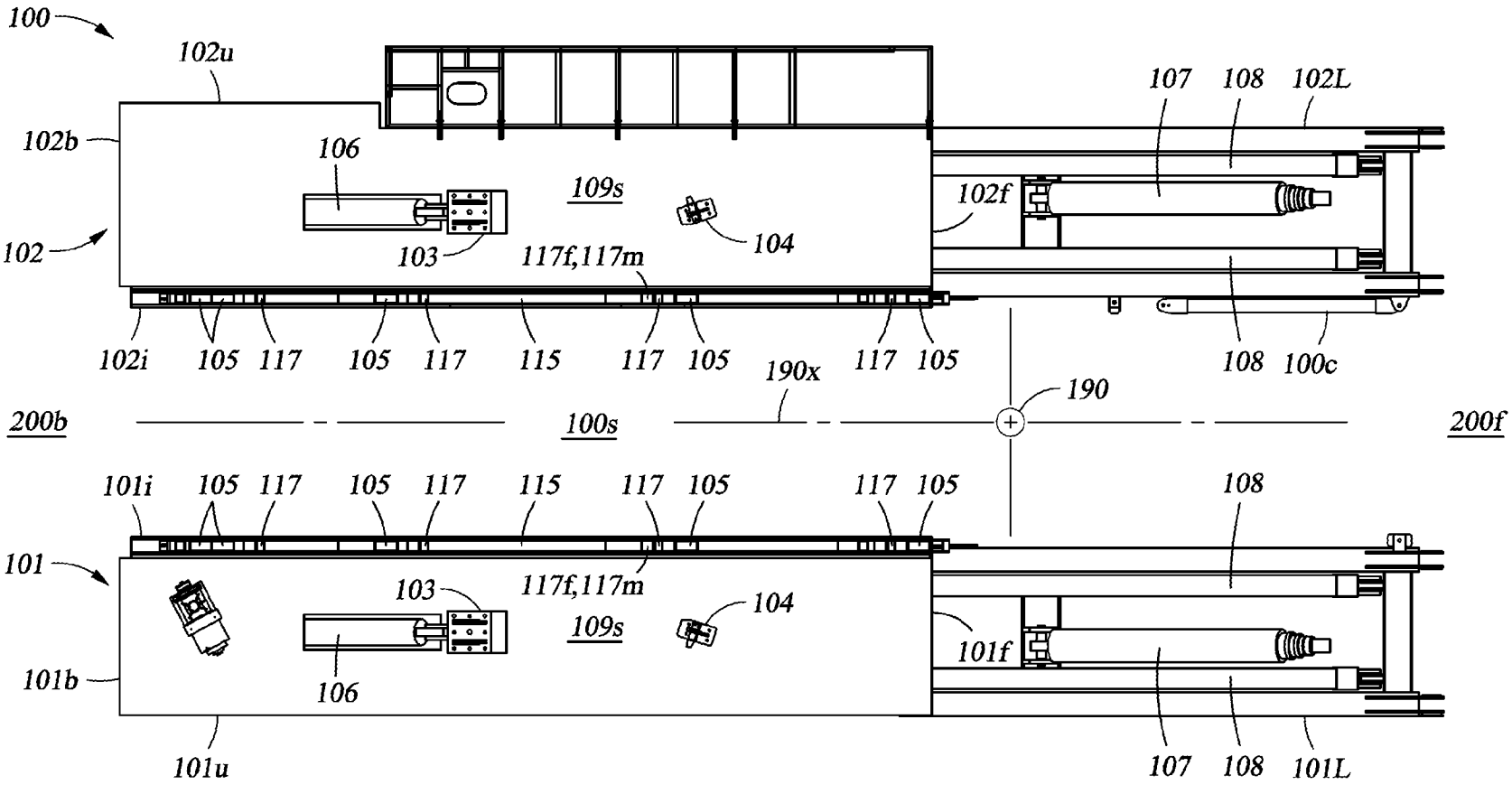
FIG. 1A is a plan view of one embodiment of a raisable substructure of an illustrative mobile drilling rig disclosed herein during an early rig assembly stage.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein is directed to mobile drilling rig assemblies having a movable center floor section that may be used in conjunction with a raisable rig substructure so as to facilitate the assembly and installation of large and/or heavy drilling rig components, such as the drilling rig mast sections and the rig drawworks and the like, without relying on the use of a conventional crane to lift and/or position the rig components. The disclosed subject matter is also directed various aspects of bi-directionally raisable drilling rig masts, which may be assembled and erected from either the drawworks side or the setback side of an illustrative mobile drilling rig.

FIG. 1A is a plan view of an illustrative mobile drilling rig 200 during an early stage of drilling rig assembly. As shown in FIG. 1A, the mobile drilling rig 200 may include a raisable substructure 100 that is positioned adjacent to a well location 190. In some embodiments of the present disclosure, the raisable substructure 100 may be made up of two separate substructure assemblies: a first substructure box 101 (sometimes referred to as the driller-side box); and a second substructure box 102 (sometimes referred to as the off-driller-side box). Additionally, the raisable substructure 100 may be positioned as shown in FIG. 1A so as to define an open space 100*s* between the substructure boxes 101 and 102, and the substructure boxes 101, 102 may be aligned substantially along a well centerline 190*x* so as to straddle the well location 190. In certain illustrative embodiments, the open space 100*s* may be sized so that a truck/trailer combination hauling various drilling rig components can be moved between the substructure boxes 101, 102 during at least some rig assembly stages, as will be described in further detail below.

The raisable substructure 100 may also include a plurality of cross braces 100*c* (one shown in FIG. 1A near the setback or front side 200*f* of the mobile drilling rig 200) that can be pivotably attached to one or both of the substructure boxes 101, 102. In certain embodiments, the cross braces 100*c* may be used to facilitate proper alignment and spacing between the substructure boxes 101 and 102, whereas at least some of the cross braces 100*c* may be disconnected from one of the substructure boxes 101 and 102 and pivoted away so as to allow a truck/trailer combination to be moved into the open space 100*s*, as noted above. When entry into the open space 100*s* by a truck/trailer combination is no longer required, any disconnected cross braces 100*c* may be reconnected to a respective substructure box, as may be required for overall structural stability.

In at least some embodiments, the substructure box 101 may include an upper box 101*u* and a lower box 101L, and the substructure box 102 may include upper and lower boxes 102*u* and 102L, respectively. As shown in FIG. 1A, the upper boxes 101*u*, 102*u* have respective front ends 101*f*, 102*f* (i.e., oriented toward the front side 200*f* of the mobile drilling rig 200) and respective back ends 101*b*, 102*b* (i.e., oriented toward the back side 200*b*). Furthermore, the substructure boxes 101, 102 may each be configured so that, during the various stages of rig assembly, erection, and/or disassembly, the upper boxes 101*u*, 102*u* can be raised above the respective lower boxes 101L, 102L and lowered again as required, and as will be described in additional detail below. In the illustrative embodiment depicted in FIG. 1A, the substructure boxes 101, 102 are shown in a collapsed configuration—i.e., with the upper boxes 101*u*, 102*u* in a lowered position relative to the respective lower boxes 101L, 102L.

Also as shown in FIG. 1A, the upper boxes 101*u* and 102*u* may include, among other things, a drilling floor section 109*s* along the top surfaces thereof, with a mast shoe 103 and a front leg support shoe 104 positioned above the drilling floor section 109*s*. In certain embodiments, each mast shoe 103 may include a pin hole 103*h* (see, FIG. 1C) of a suitably designed pinned connection, which may be used during a subsequent rig assembly stage to pivotably attach the rear legs of a drilling rig mast, e.g., the rear support legs 131 of the bottom mast section 130 shown in FIGS. 2A-2E and described below, to the upper boxes 101*u*, 102*u* during a later rig assembly stage. Similarly, each front leg support shoe 104 may also include a pin hole 104*h* (see, FIG. 1C) of a suitably designed pinned connection, which may be used to removably attach the front legs of a drilling rig mast to each of the upper boxes 101*u* and 102*u*, such as the front leg braces 132 of the bottom mast section 130 illustrated in FIGS. 2A-2E, after the drilling rig mast of the mobile drilling rig 200 has been erected.

In certain illustrative embodiments, each of the upper boxes 101*u* and 102*u* may further include floor sliding means that may be adapted to facilitate a sliding movement of a movable center floor section installed thereon during a later rig assembly stage, such as the movable center floor section 120 shown in FIGS. 1B-1E, also described below. For example, in at least some embodiments, the floor sliding means may include, among other things, a plurality of roller wheel supports 105 that are rotatably mounted in respective center floor support members 115 that are disposed along inside edges 101*i* and 102*i* of the upper boxes 101*u* and 102*u*, respectively. In at least some embodiments, the plurality of roller wheel supports 105 may permit the movable center floor section 120 to be rolled, or slidably moved, between the upper boxes 101*u* and 102 during the further assembly stages of the mobile drilling rig 300, as will also be discussed in additional detail below. Furthermore, it should be appreciated that, while FIGS. 1A-1E depict floor sliding means that includes, among other things, five roller wheel supports 105 mounted on each upper box 101*u*, 102*u*, the total number of roller wheel supports 105 may vary, e.g., a fewer or greater number may actually be used, depending on the specific design of the substructure boxes 101, 102 and the movable center floor section 120. Moreover, it should also be understood that other suitable floor sliding means, such as low-friction contact surfaces and the like, may also be used to facilitate the sliding movement of the movable center floor section 120, depending on the various design parameters of the mobile drilling rig 300, such as overall rig size, anticipated dead and/or live loading conditions, etc.

Additionally, a plurality of fixed spacers 117*f* and movable spacers 117*m* (generally illustrated in FIG. 1A and noted together as spacers 117) may also be disposed along each center floor support member 115, additional details of which are provided in FIGS. 4A-7B and described below. In certain embodiments, the plurality of fixed and movable spacers 117*f*, 117*m* may be adapted to transfer the load of the movable center floor section 120 to each center floor support member 115 when the movable center floor section 120 has been moved to certain fixed positions, such as, for example, a final rig operating position, and the like. See, e.g., FIGS. 6A-7B and the accompanying description set forth below. Accordingly, it should be understood that each center floor support member 115 may be appropriately adapted so as to transfer any loads on the movable center floor section 120, including dead loads and/or live loads and the like, to the respective substructure boxes 101, 102.

Figure 1B:
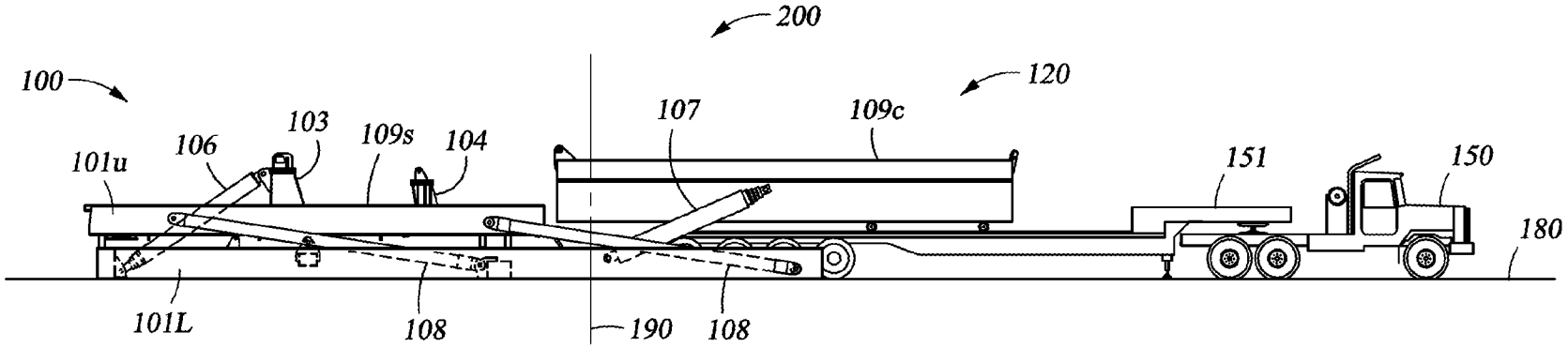
FIGS. 1B-1E are a-side elevation views of the illustrative mobile drilling rig of FIG. 1A during further rig assembly stages, wherein a movable center floor section according to the present disclosure is being installed on the raisable substructure.
Figure 1C:
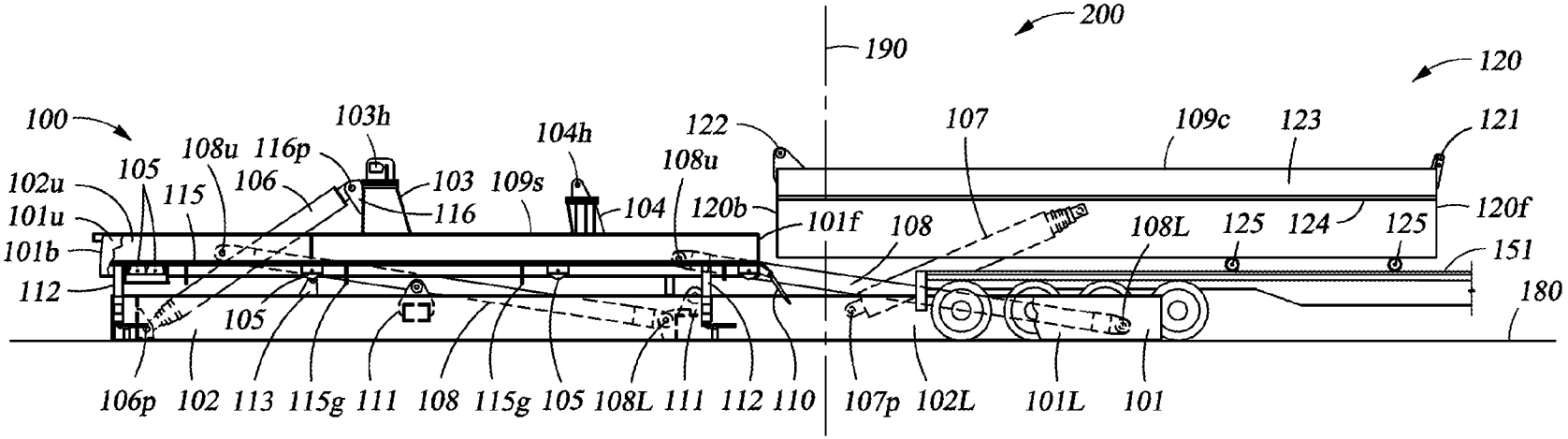

FIG. 1B is a side elevation view of the mobile drilling rig 200 of FIG. 1A during a further illustrative rig assembly stage, i.e., wherein the movable center floor section 120 noted above has been positioned adjacent to the raisable substructure 100, while FIG. 1C is a blow-up view of a portion of FIG. 1B showing some aspects of the rig 200 in additional detail. As shown in FIGS. 1B and 1C, the movable center floor section 120 may be positioned on a trailer 151, and a truck 150 may be used to move the trailer 151 with the movable center floor section 120 positioned thereon along the ground 180 and into the open space 100*s* (see, FIG. 1A) between the substructure boxes 101 and 102. In some illustrative embodiments, the truck 150 and trailer 151 may be used to move the movable center floor section 120 at least partially into the open space 100*s* from the front side 200*f* of the mobile drilling rig 200 (see, FIG. 1A). However, it should be appreciated by those of ordinary skill after having full benefit of the subject matter disclosed herein that, in other embodiments, the movable center floor section 120 may also readily be moved into position, i.e., at least partially into the open space 100*s*, by the truck 150 and trailer 151 from the back side 200*b* (sometimes referred to as the drawworks side) of the mobile drilling rig 200.

In some embodiments, the movable center floor section 120 may include two side support beams 123, each being disposed along opposing sides of the movable center floor section 120. Furthermore, in those exemplary embodiments wherein the floor sliding means includes a plurality of roller wheel supports 105, a bearing plate 124 may be attached to the lower side of each side support beam 123, and may be adapted to come into rolling contact with one or more of the plurality of roller wheel supports 105 positioned along the inside edges 101*i*, 102*i* (see, FIG. 1A) of the respective upper boxes 101*u*, 102*u* when the movable center floor section 120 is slidably moved along the well centerline 190*x* between the substructure boxes 101 and 102. Additionally, a drilling floor section 109*c* may be positioned on the top surface of the movable center floor section 120, which may be substantially aligned with the drilling floor sections 109*s* on the upper boxes 101*u*, 102*u* after the movable floor section 120 has been installed on the substructure 100, as will be further described below.

In certain disclosed embodiments, one or more mast positioning lugs 121 may be attached to a front end 120*f* of the movable center floor section 120, i.e., on the end of the movable center floor section 120 that is oriented toward the setback or front side 200*f* of the mobile drilling rig 200 (see, FIG. 1A). Depending on the type and configuration of drilling rig mast used on the mobile drilling rig 200, the mast positioning lugs 121 may be adapted to facilitate movement and positioning of, for example, at least a bottom mast section of the drilling rig mast so that it can be pivotably attached to the pin hole 103*h* on each of the mast shoes 103 of the raisable substructure 100, as will be described in further detail with respect to the bottom mast section 130 shown in FIGS. 2A-2E below.

The movable center floor section 120 may also include one or more suitably sized drawworks support lugs 122 attached to a back end 120*b* of the movable center floor section 120, i.e., on the end of the movable center floor section 120 that is opposite of the front side 120*f* and oriented toward the drawworks or back side 200*b* of the mobile drilling rig 200 (see, FIG. 1A). In at least some embodiments, the drawworks support lugs 122 may be used to facilitate the installation of a drilling rig drawworks during a later stage of rig assembly, such as, for example, the drawworks skid 140 shown in FIGS. 3A-3C, described in further detail below.

In the illustrative embodiment shown in FIGS. 1B and 1C, the lower box 101L of the substructure box 101 is positioned on and supported by the ground 180 adjacent to the well location 190, and the upper box 101*u* is in a fully collapsed position above the lower box 101L as previously described. Furthermore, the upper and lower boxes 102*u* and 102L of the substructure box 102 are similarly positioned, but are not specifically illustrated in the elevation view of FIG. 1B. Accordingly, it should be understood that many details and elements of the substructure box 102 are substantially the same as the corresponding details and elements of the substructure box 101, but may not in all cases be specifically described herein unless otherwise noted.

In some embodiments, the substructure box 101 (shown in FIGS. 1B and 1C) and the substructure box 102 (not shown in FIGS. 1B and 1C) may both include substructure raising means for raising and/or lowering the upper boxes 101*u*, 102*u* relative to the lower boxes 101L, 102L, as may be required for a particular rig assembly, operating, or disassembly stage. For example, the substructure raising means may be operatively coupled to the respective upper and lower boxes 101*u*/101L and 102*u*/102L, as is generally represented by the exemplary powered raising apparatuses 106 shown in FIGS. 1B and 1C. In certain embodiments, the powered raising apparatuses 106 may be adapted to generate a lifting force of sufficient magnitude that is capable of raising the upper boxes 101*u*, 102*u* above the lower boxes 101L, 102L when the mobile drilling rig 200 is in a fully assembled condition, e.g., including all equipment and structures such as the drilling rig mast, travelling block, drawworks, drillers cabin, etc. In at least some embodiments, the powered raising apparatuses 106 may be, for example, a telescoping hydraulic or pneumatic cylinder apparatus, a screw and/or gear mechanism, and the like, and may each be pivotably attached to the lower boxes 101L, 102L at an appropriately designed pinned connection 106*p*. Furthermore, the powered raising apparatuses 106 may be pivotably attached at an opposite end thereof to a respective upper box 101*u*, 102*u* by way of a pinned connection 116*p* at a lug 116 that is fixedly attached to the mast shoe 103, although it should be appreciated that other connection points on the upper box 101*u* may also be used.

Each substructure box 101, 102 may also include mast raising means for raising and/or lowering a drilling rig mast (not shown) that may be attached to the raisable substructure 100 during a later rig assembly stage. (See, e.g., the bottom mast section 130 shown in FIGS. 2A-2E, described in further detail below.) In at least some embodiments, the mast raising means may include, for example, suitably designed mast erection apparatuses, as generally represented by the mast erection apparatuses 107 shown in FIGS. 1B and 1C. Furthermore, the mast erection apparatuses 107 may each be, for example, a telescoping hydraulic or pneumatic cylinder, and the like, and may each be pivotably attached to the lower boxes 101L, 102L at an appropriately designed pinned connection 107*p*. Furthermore, the substructure boxes 101, 102 may also include a plurality of pivotable support members 108, two of which are shown partially illustrated in FIGS. 1B and 1C, for clarity. In certain illustrative embodiments, the lower ends of each of the support members 108 may be pivotably attached to the respective lower boxes 101L, 102L at a pinned connection 108L, and the upper ends may be pivotably attached to the respective upper boxes 101*u*, 102*u* at a pinned connection 108*u*. In at least some embodiments, the support members 108 are adapted such that when the substructure raising means, e.g., the powered raising members 106, lift the upper boxes 101*u*, 102*u* of the raisable substructure 100, the upper boxes 101*u*, 102*u* move or translate forward, i.e., in the direction of the well location 190 and the front side 200*f* of the mobile drilling rig 200 (see, FIG. 1A).

Also as shown in FIGS. 1B and 1C, one or more additional support lugs 111 may be attached to the lower boxes 101L, 102L, which may then be used to install additional support members or braces (not shown) between the lower boxes 101L, 102L and the respective upper boxes 101*u*, 102*u* as may be necessary for the requisite stability and strength of the raisable substructure 100 after the upper boxes 101*u*, 102*u* have been raised to a final operating position (not shown). For example, the additional support members or braces (not shown) may be pivotably attached at one end to the support lugs 111 at a pin hole 111*h* and at an opposite to corresponding lugs and/or pin holes (not shown) on the upper boxes 101*u*, 102*u*. Additionally, in at least some embodiments, the lower boxes 101L, 102L may also include lower drawworks support lugs 113 having a pin hole 113*h* therein to which a drawworks support brace (not shown) may be attached during a later rig assembly stage. See, e.g., the installation of the drawworks skid 140 shown in FIGS. 3A-3C and described below.

In certain embodiments, each of the substructure boxes 101, 102 may also include support posts 112 located at each end of the lower boxes 101L, 102L, which may be used to temporarily support the movable center floor section 120 during at least some stages of rig assembly. Additionally, each lower box 101L, 102L may also include spacer moving means for moving each of the movable spacers 117*m* above a respective fixed spacer 117*f* during some stages of rig assembly, such as, for example, when the movable center floor section 120 is being temporarily supported by the support posts 112. In at least some embodiments, the spacer moving means may include, for example, spacer positioning bars 117*b* (as shown in FIGS. 4A-4E and described below), and a movable spacer actuator handle 110 as shown in FIG. 1C, which will be described in further detail in conjunction with FIGS. 6A-6E below.

Figure 1D:
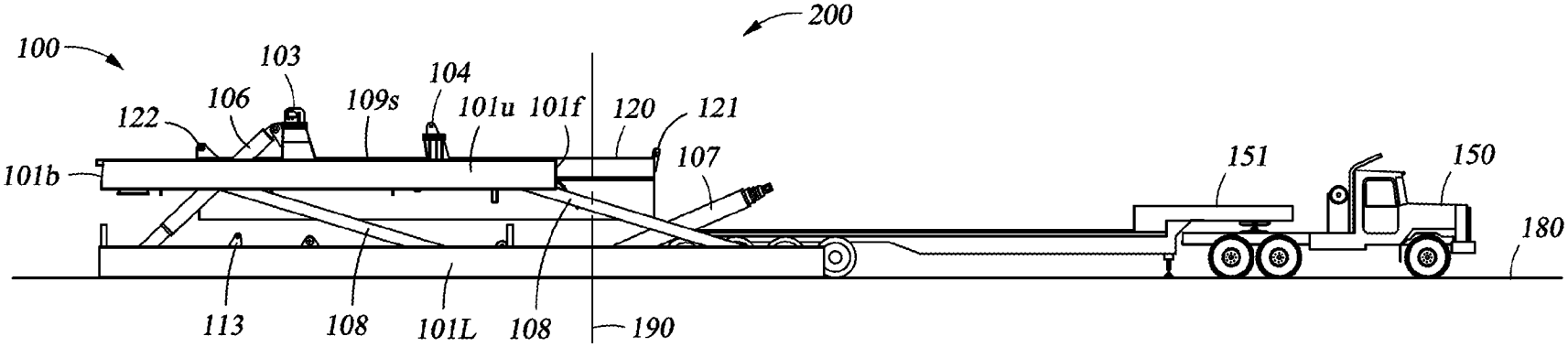
Figure 1E:
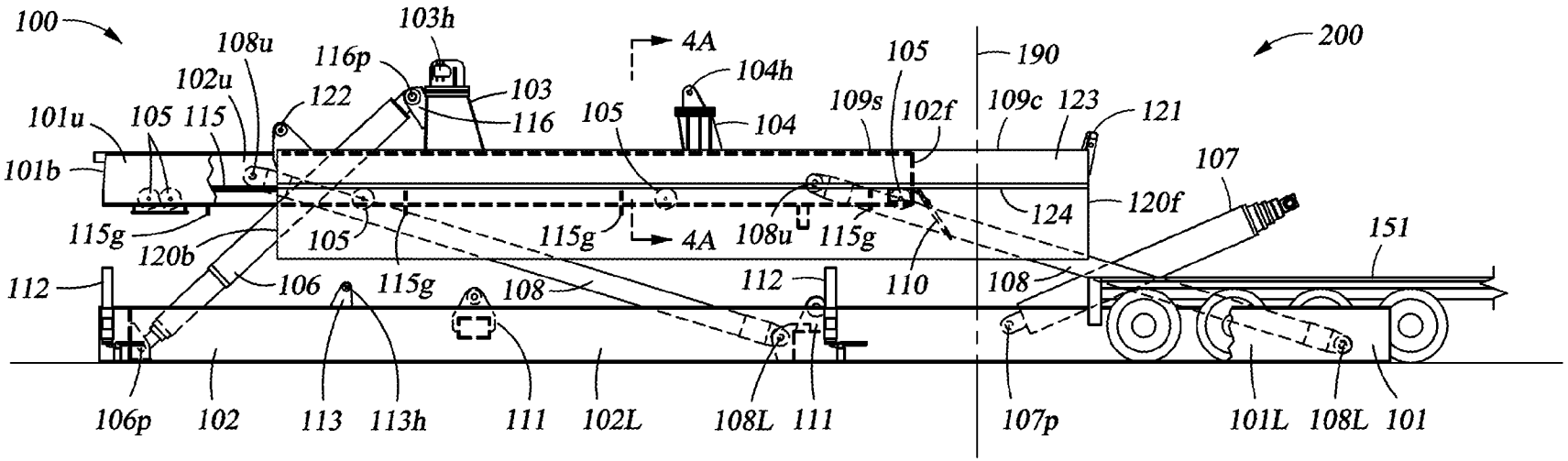

FIG. 1D is a side elevation view of the mobile drilling rig 200 shown in FIG. 1B in a further rig assembly stage, after the movable center floor section 120 has been installed on the substructure 100, while FIG. 1E is a blow-up view showing some aspects of a portion of FIG. 1D in additional detail. In some disclosed embodiments, the movable center floor section 120 may be installed on the substructure 100 by using the truck 150 to move the trailer 151 into the open space 100*s* (see, FIG. 1A) a sufficient distance so that at least a portion of the side support beams 123 and bearing plates 124 on either side of the movable center floor section 120 extend over the front ends 101*f*, 102*f* of the upper boxes 101*u*, 102*u* and are positioned above at least one roller wheel support 105 on each of the substructure boxes 101, 102. On the other hand, in those embodiments wherein the movable center floor section 120 is moved into position from the back side 200*b* of the mobile drilling rig 200, the trailer 151 may be moved into the open space 100*s* until at least a portion of the side support beams 123 and bearing plates 124 extend over the back ends 101*b*, 102*b* of the upper boxes 101*u*, 102*u* and are positioned above at least the first roller wheel support 105 closest to each back end 101*b*, 102*b*. However, irrespective of the side from which the movable center floor section 120 is positioned, it should be appreciated that, in at least some embodiments, the trailer 151 may be moved into the open space 100*s* such that the movable center floor section 120 is positioned above two or more, or even all, roller wheel supports 105 on each upper box 101*u*, 102*u* prior to proceeding to the next rig assembly stage described below.

Once the movable center floor section 120 has been positioned as described above, the powered raising apparatuses 106 may then be actuated to raise the upper boxes 101*u*, 102*u* until each of the roller wheel supports 105 that are below the movable floor section 120 comes into contact with a respective bearing plate 124, at which point the powered raising apparatuses 106 may be maintained in a substantially constant position. Thereafter, in at least some embodiments, the floor sliding means may be used to slidably position the movable floor section 120 on the raisable substructure 100, e.g., by rolling the movable floor section 120 across each successive roller wheel support 105 and onto the upper boxes 101*u*, 102*u* as will be described in further detail below, at least until the movable floor section 120 has been moved off of the trailer 151. The truck/trailer combination 150/151 may then be moved out of the open space 100*s* (see, FIG. 1A) and away from the mobile drilling rig 200, and the powered raising apparatus 106 may be further actuated as required to raise or lower the upper boxes 101*u*, 102*u* in preparation for the rig assembly stages to follow.

In certain embodiments disclosed herein, one or more appropriately sized and located rollers and/or dollies 125 (schematically shown in FIGS. 1B and 1C) may be positioned between the movable center floor section 120 and the trailer 151 so as to facilitate a rolling movement of the movable center floor section 120 across and off of the trailer 151. Furthermore, floor moving means (not shown in FIGS. 1D and 1E) may be used to roll the movable floor section 120 off of the trailer 151, across the respective roller wheel supports 105, and onto the raisable substructure 100. Depending on the overall center floor moving requirements, the floor moving means may be temporarily connected to any suitably sized and positioned structural connection on the movable center floor section 120, e.g., the mast positioning lugs 121 and/or the drawworks support lugs 122. For example, in some embodiments, the floor moving means may be a tugging apparatus, such as a truck-mounted winch apparatus (not shown in FIGS. 1D and 1E) and the like, wherein the truck carrying the truck-mounted winch may be positioned at an appropriate location relative to the mobile drilling rig 200, e.g., at either the front side 200*f* or the back side 200*b*, depending on the direction that the movable center floor section 120 will be moved. In other embodiments, the floor moving means, e.g., tugging apparatus, may be one or more powered winch apparatuses (not shown in FIGS. 1D and 1E) mounted on either or both of the substructure boxes 101, 102, such as, for example, the winch apparatuses 370 shown in FIGS. 8A-8K, which will be further described below.

As noted above, the trailer 151 may be moved into the open space 100*s* such that the movable center floor section 120 is positioned above two or more roller wheel supports 105 on each upper box 101*u*, 102*u*. Furthermore, in at least some embodiments, the movable center floor section 120 may be positioned above a sufficient number of roller wheel supports 105 on each upper box 101*u*, 102*u* so that the movable center floor section 120 can be lifted directly off of the trailer 151 in a substantially stable fashion, and without having to rely on the use of the floor moving means to roll the movable center floor section 120 across the trailer 151 or the roller wheel supports 105. For example, as shown in the illustrative embodiment of the present disclosure that is depicted in FIGS. 1D and 1E, the movable center floor section 120 may be positioned above three roller wheel supports 105, although any sufficient number of roller wheel supports 105 capable of supporting the movable center floor section 120 in a substantially stable manner may be used. After the upper boxes 101*u*, 102*u* have been raised and the roller wheel supports 105 brought into contact with the bearing plates 124 on the movable center floor section 120 as described above, actuation of the powered raising apparatus 106 may be continued so that the movable center floor section 120 is lifted off of the trailer 151 in a substantially stable fashion. Thereafter, the truck 150 may be used to move the trailer 151 out of the open space 100*s* and away from the mobile drilling rig 200, and the substructure raising means, e.g., the powered raising apparatus 106 may be used so as to raise or lower the upper boxes 101*u*, 102*u* as noted above, in preparation for subsequent rig assembly stages.

Figure 2A:
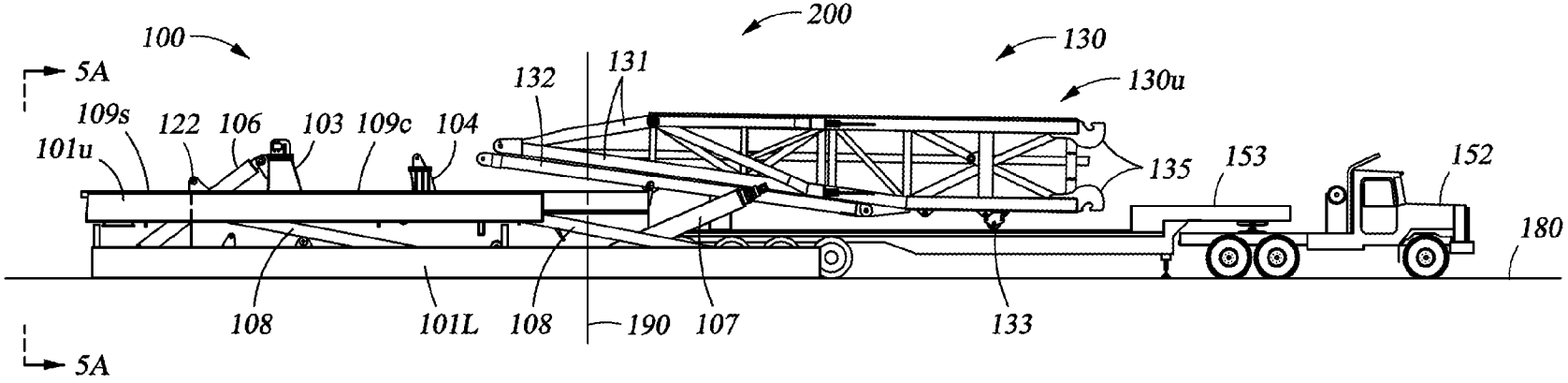
FIGS. 2A and 2B are side elevation views of the illustrative mobile drilling rig of FIGS. 1D and 1E, wherein a drilling rig mast section is being positioned adjacent to the raisable substructure.
Figure 2B:
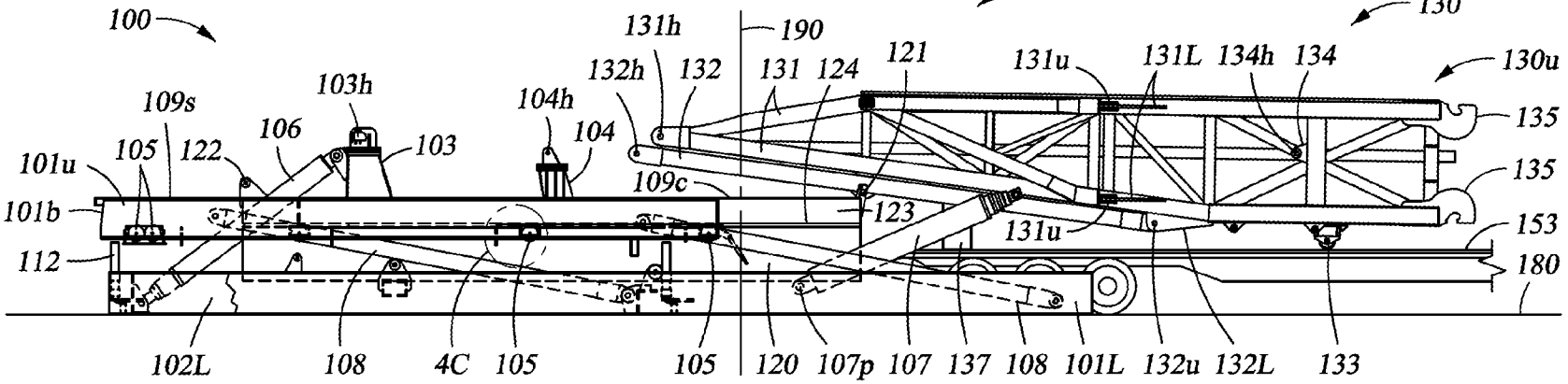

FIG. 2A is a side elevation view of the illustrative mobile drilling rig 200 shown in FIG. 1D during a further rig assembly stage, wherein a bottom mast section 130 of a drilling rig mast has been positioned adjacent to the raisable substructure 100 and the movable center floor section 120 in preparation for attaching the bottom mast section 130 to the upper boxes 101*u*, 102*u*. Furthermore, FIG. 2B is a blow-up view of a portion of FIG. 2A, showing some aspects of the mobile drilling rig 200 of FIG. 2A in additional detail. As shown in FIGS. 2A and 2B, the bottom mast section 130 may be positioned on a trailer 153, and may be supported by one or more dollies or rollers 133 and one or more temporary supports 137. In some embodiments, the mast 130 may be made up of, among other things, rear support legs 131, which may be pivotably attached to the bottom mast section 130 at pinned joints 131*u* on rear leg lugs 131L, and front leg braces 132 that may be pivotably attached to the bottom mast section at pinned joints 132*u* on front leg lugs 132L. In some embodiments, a pin hole 131*h* may be located at the lower end of the rear support legs 131, which may be adapted to pivotably attach the bottom mast section 130 to the respective pin holes 103*h* on each of the mast shoes 103, as described below. Similarly, the front leg braces 132 may also have a pin hole 132*h* of a suitably designed pinned connection at a lower end thereof, which may be used to attach the front leg braces 132 to the pin holes 104*h* on the respective front leg support shoes 104 after a completely assembled drilling rig mast (not shown) of the mobile drilling rig 200 has been erected into an operating position.

One or more mast connection devices 135 may also be located at the upper end 130*u* of the bottom mast section 130, which may be adapted to facilitate the connection of the bottom mast section 130 to an intermediate or upper mast section (not shown) during the assembly of the drilling rig mast. The bottom mast section 130 may also include mast erection lugs 134 having a pin hole 134*h* of a suitably designed pinned connection to which respective mast erection apparatuses 107 may be pivotably attached, thereby facilitating raising and lowering of the bottom mast section 130 during the drilling rig mast assembly steps, as well as erecting the completed mast prior to performing drilling operations, and/or lowering the mast after the completion of drilling operations.

Figure 2C:
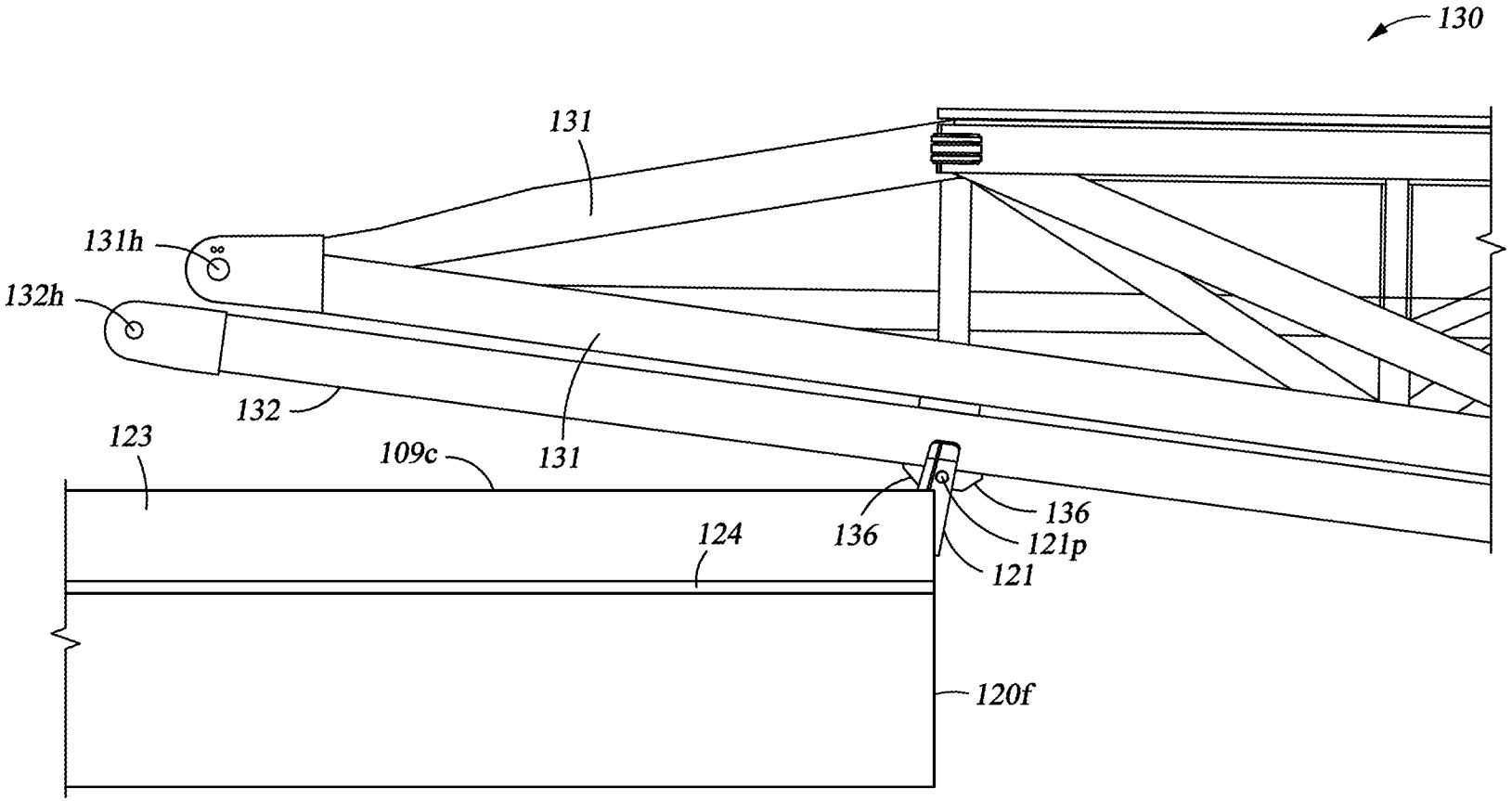
FIG. 2C is a detailed view of a mast positioning lug on the movable center floor section of the illustrative mobile drilling rig of FIGS. 2A and 2B that is used for positioning the drilling rig mast section on the raisable substructure.

In certain disclosed embodiments, a center floor engagement lug 136 may be attached to one or both of the front leg braces 132. The center floor engagement lug 136 may be adapted to temporarily engage the mast positioning lug 121 located at the front end 120*f* of the movable center floor section 120. FIG. 2C is a blow-up detailed view of an illustrative center floor engagement lug 136 in accordance with the present disclosure. In at least some embodiments, the mast positioning lug 121 on the movable center floor section 120 may include, for example, a pin 121*p*. Furthermore, the center floor engagement lug 136 may include a pair of gussets 136*g* that are adapted to straddle and engage the pin 121 of the mast positioning lug 121, thus removably coupling the bottom mast section 130 to the movable floor section 120 such that the bottom mast section 130 may be moved together with the movable center floor section 120 when the floor moving means (not shown in FIGS. 2A and 2B; see, e.g., FIGS. 8A-8K described below) is used in conjunction with the floor sliding means to slidably move the movable center floor section 120, e.g., over the roller wheel supports 105 on the raisable substructure 100. In this way, the movable center floor section 120 may be used to facilitate the positioning of the pin holes 131*h* on the rear support legs 131 adjacent to respective pin holes 103*h* on the mast shoes 103 so that at least bottom mast section 130 of the drilling rig mast can be pivotably attached to the raisable substructure 100, as will be further described in conjunction with FIGS. 2D and 2E below In order to position the bottom mast section 130 on the raisable substructure 100, the trailer 153 may first be moved over the ground 180 by a truck 152 and at least partially into the open space 100*s* (see, FIG. 1A) between the substructure boxes 101 and 102. In certain embodiments, the trailer 153 may be moved into the open space 100*s* so that that at least a lower portion of the bottom mast section 130, e.g., the ends of the rear support legs 131 and the front leg braces 132, extend beyond the front ends 101*f*, 102*f* of the upper boxes 101*u*, 102*u*, as shown in FIGS. 2A and 2B. Furthermore, the movable center floor section 120 may be slidably moved relative to the upper boxes 101*u*, 102*u* using the floor moving means (not shown in FIGS. 2A and 2B), e.g., by winches and the like as shown in FIGS. 8A-8K and described below, along the roller wheel supports 105 toward the front side 200*f* of the mobile drilling rig 200. In at least some embodiments, the movable center floor section 120 may be slidably moved to a mast installation position, i.e., wherein the front end of the movable center floor section 120 extends beyond the front ends 101*f*, 102*f* of the upper boxes 101*u*, 102*u*, and the mast positioning lugs 121 are positioned substantially below and aligned with the center floor engagement lugs 136 on the front leg braces 132. The mast positioning lugs 121 may then be temporarily engaged with the center floor engagement lugs 136 by using the substructure raising means, e.g., the powered raising apparatuses 106, to raise the upper boxes 101*u*, 102*u* with the movable center floor section 120 installed thereon until the pins 121*p* of the mast positioning lugs 121 move into place, e.g., between the gussets 136*g*.

In certain embodiments, the substructure raising means may be used, e.g., actuation of the powered raising apparatuses 106 may be continued, to thereafter lift the bottom mast section 130 off of the temporary support 137, which may then be moved away. In this configuration, the bottom mast section 130 is then supported by the mast positioning lugs 121 and the rollers 133. Furthermore, due to the engaging configuration between the mast positioning lugs 121 and the center floor engagement lugs 136 and the rolling support provided by the rollers 133, the bottom mast section 130 may substantially freely roll across the top of the trailer 153 when the movable center floor section 120 is thereafter slidably moved, e.g., across the plurality of roller wheel supports 105, by use of the floor moving means (not shown in FIGS. 2A and 2B) to a different position along the raisable substructure 100.

Figure 2D:
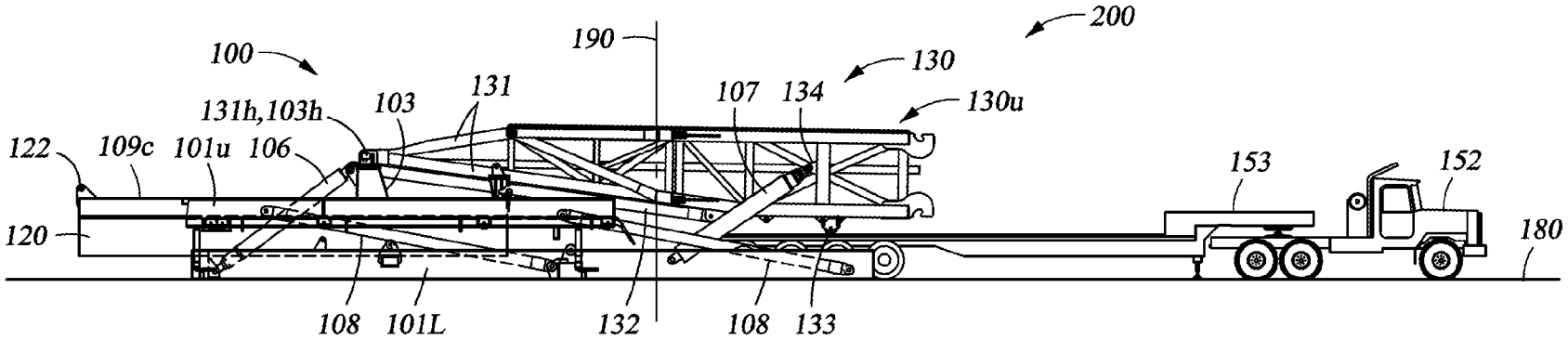
FIGS. 2D and 2E are side elevation views of the illustrative mobile drilling rig of FIGS. 2A and 2B, after the drilling rig mast section of the illustrative mobile drilling rig has been attached to the raisable substructure.
Figure 2E:
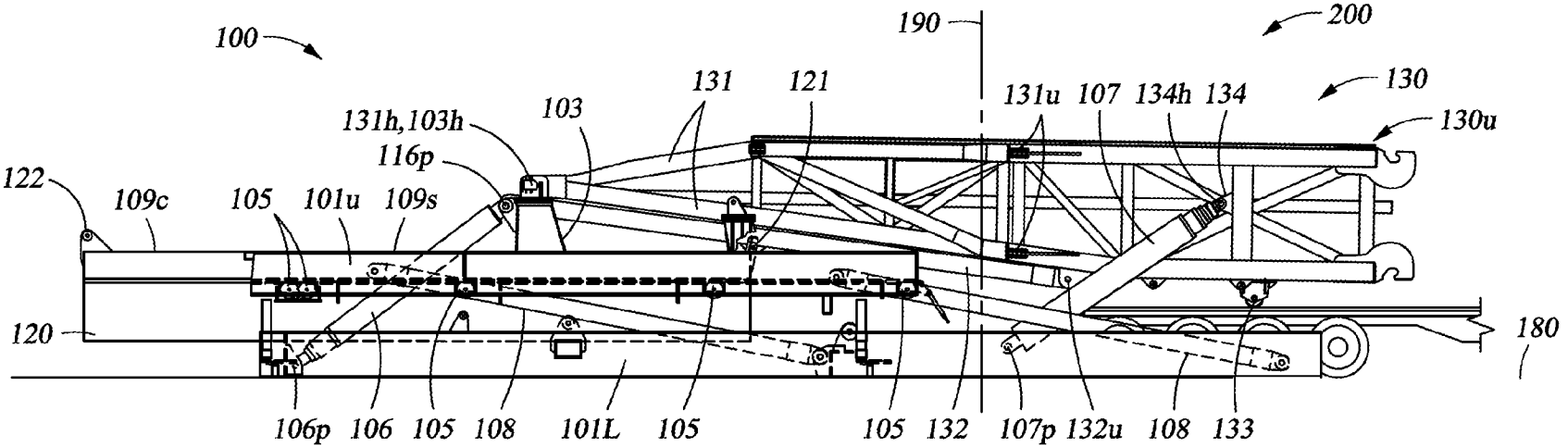

FIG. 2D shows the mobile drilling rig 200 depicted in FIG. 2A after the movable center floor section 120 (and the bottom mast section 130 that is temporarily engaged with the mast positioning lug 121) has been slidably moved, e.g., on the roller wheel supports 105, toward the back side 200*b* (see, FIG. 1A) of the mobile drilling rig 200, while FIG. 2E is a blow-up view of some aspects of the rig 200 shown in FIG. 2D. In some embodiments, the movable center floor section 120 may be moved to a mast attachment position relative to the upper boxes 101*u*, 102*u* so that the rear support legs 131 of the bottom mast section 130 can be pivotably attached to the mast shoes 103. Next, with the movable center floor section 120 in the mast attachment position, each rear support leg 131 may be pivotably rotated outwardly from the bottom mast section 130 about respective pinned connections 131*u*, thereby substantially aligning the pin hole 131*h* on each rear support legs 131 with the pin holes 103*h* on a respective mast shoe 103. A pinned connection between the bottom mast section 130 and the mast shoes 103 may then be completed by installing a suitably designed pin (not shown) into the substantially aligned pin holes 103*h*, 131*h*.

In certain illustrative embodiments, after the bottom mast section 130 has been pivotably attached to the raisable substructure 100, each mast erection apparatus 107 may be pivoted about the pinned connection 107*p* and pivotably attached to the mast erection lugs 134 at the pin holes 134*h*. The mast raising means, e.g., mast erection apparatuses 107, may then be used to raise the bottom mast section 130 off of the trailer 153, and the truck/trailer combination 152/153 moved away from the mobile drilling rig 200. Mast assembly may then continue by positioning an additional mast section (not shown) adjacent to the bottom mast section 130 and connecting the additional mast section thereto, e.g., by way of the mast connection devices 135. In some illustrative embodiments, the mast connection devices 135 may be, for example, bi-directional mast connection devices that may adapted to permit assembly and erection of the completed drilling rig mast from either the front side 200*f* or the back side 200*b* of the mobile drilling rig 200, as will described in further detail below with respect to FIGS. 9A-9D, FIGS. 10A-10F, FIGS. 11A-11N and 11P, and FIGS. 12A-12H. Once all additional mast sections have been assembled to the bottom mast section 130, the completed drilling rig mast (not shown) may then be erected by actuating the mast erection apparatus 107, and each front leg brace 132 may be pivotably rotated about respective pinned connections 132*u* and removably attached to a respective leg support lug 104 using the pin holes 132*h*, 104*h* and a suitably sized pin (not shown). Thereafter, the mast erection apparatuses 107 may be disconnected from the mast erection lugs 134 and pivotably rotated away from the drilling rig mast to a position as shown in FIGS. 3B and 3C, described below.

Figure 3A:
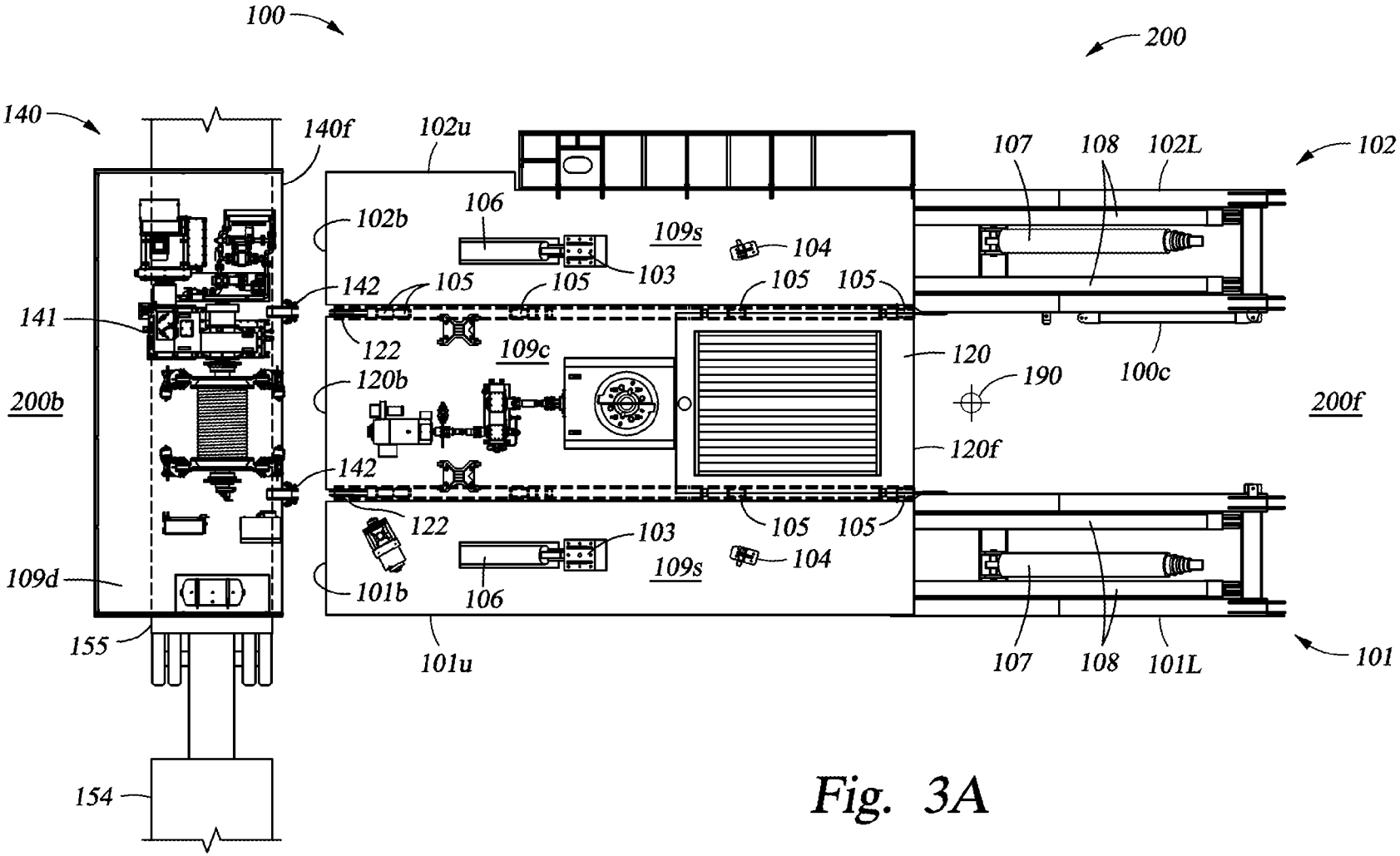
FIGS. 3A-3C are various views of the illustrative mobile drilling rig of FIGS. 2D and 2E during further rig assembly stages, wherein a drawworks skid is being attached to the movable center floor section.
Figure 3B:
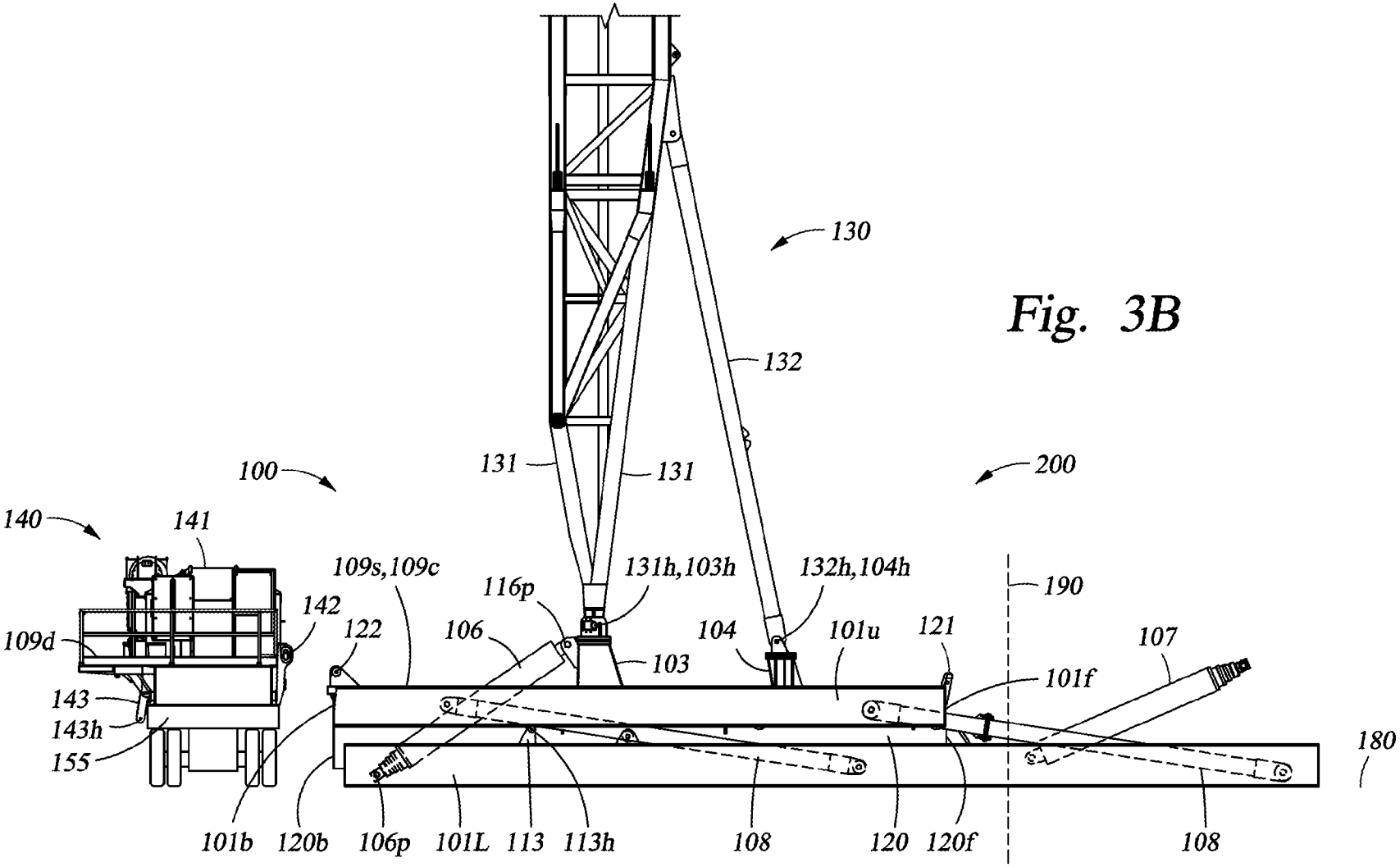
Figure 3C:
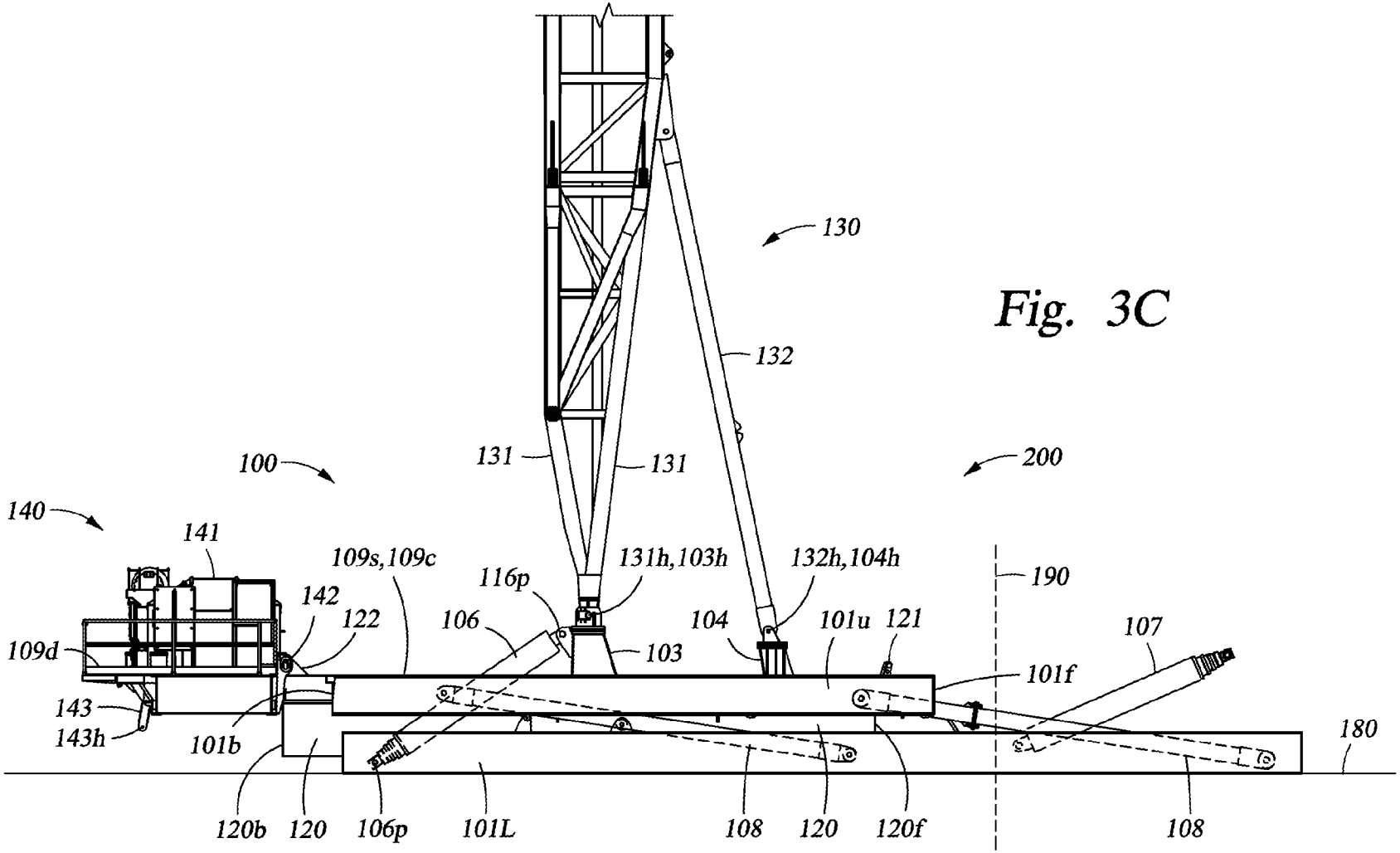

FIGS. 3A-3C illustrate various views of the mobile drilling rig 200 depicting further rig assembly stages wherein a drawworks skid 140 may be removably attached to the movable center floor section 120. More specifically, FIG. 3A is a plan view of the mobile drilling rig 200 showing the drawworks skid 140 positioned at the back side, or drawworks side, 200*b* of the rig 200, such that a front end 140*f* of the drawworks skid 140 is adjacent to the back end 120*b* of the movable center floor section 120 and the back ends 101*b*, 102*b* of the upper boxes 101*u*, 102*u*. In illustrative embodiments of the present disclosure, the drawworks skid 140 may be positioned as shown in FIG. 3A after at least the bottom mast section 130 (not shown in FIG. 3A, for clarity) has been attached to the raisable substructure 100, as shown in FIGS. 2A-2E and described above. Positioning of the drawworks skid 140 may be accomplished by loading the drawworks skid 140 on a suitably sized trailer 155 and using a truck 154 to move the trailer 155 across the ground 180 (see, FIG. 3B) adjacent to the raisable substructure 100.

In some embodiments, the drawworks skid 140 may include, among other things, a drawworks 141, which may be positioned above a drilling floor section 109*d* of the drawworks skid 140. The drawworks skid 140 may further include one or more suitably sized drawworks skid attachment lugs 142, which may be adapted to removably attach the drawworks skid 140 to the corresponding one or more drawworks support lugs 122 at the back end 120*b* of the movable center floor section 120. The drawworks skid attachment lug 142 may be any suitable structural configuration that is adapted to removably engage a corresponding structural configuration of the drawworks support lug 122. For example, in some embodiments, the drawworks skid attachment lug 142 may have a hook configuration and the like, and the drawworks support lug 122 may include a pin or pin-like structural element that is adapted to matingly engage the hook configuration of the drawworks skid attachment lug 142. It should be appreciated that other removably engagable configurations may also be used.

FIG. 3B is a side elevation view of the illustrative mobile drilling rig 200 depicted in FIG. 3A, wherein the trailer 155 is positioned on the ground 180 adjacent to the raisable substructure 100 with the drawworks skid 140 loaded on. As shown in FIG. 3B, the drawworks skid 140 may also include one or more upper drawworks support lug 143 attached thereto, the upper drawworks support lug 143 having a pin hole 143*h* at the lower end thereof. The pin hole 143*h* may be used in conjunction with a corresponding pin hole 113*h* on the lower drawworks support lugs 113 (see, FIGS. 1B-1E) to removably install a drawworks support brace (not shown) that is adapted to provide additional support and stability to the drawworks skid 140 during operation of the mobile drilling rig 200.

FIG. 3C shows the mobile drilling rig 200 of FIG. 3B after the drawworks skid 140 has been removably attached to the movable center floor section 120, which may be accomplished by the following illustrative steps. In certain embodiments, the truck/trailer combination 154/155 may be used to position the front end 140*f* of drawworks skid 140 adjacent to the back end 120*b* of the movable center floor section 120 so that each of the drawworks skid attachment lugs 142 on the drawworks skid 140 is substantially aligned with a corresponding drawworks support lug 122 on the movable floor section 120. The floor moving means (not shown in FIGS. 3A-3C) may be used to slidably move the movable center floor section 120, e.g., over the roller wheel supports 105, in the direction of the back side 200*b* of the mobile drilling rig 200 (see, FIG. 1A) in a manner as previously described to a drawworks installation position. In this configuration, the back end 120*b* of the movable center floor section 120 extends beyond the back ends 101*b*, 102*b* of the upper boxes 101*u*, 102*u*, and the drawworks support lugs 122 are positioned substantially directly below and in alignment with the drawworks skid attachment lugs 142.

Next, the substructure raising means, e.g., the powered raising apparatuses 106, may be used to raise the upper boxes 101*u*, 102*u* and the movable center floor section 102 installed thereon so that the drawworks support lugs 122 matingly and removably engage the drawworks skid attachment lugs 142. In some embodiments, the front end 140*f* (see, FIG. 3A) of the drawworks skid 140 may be, in this position, immediately adjacent to, or even in contact with, the back end 120*b* of the movable center floor section 120. The drawworks skid 140 may then be lifted off of the trailer 155 using the substructure raising means, e.g., by further actuating the powered raising apparatuses 106, after which the trailer 155 may be moved away. Thereafter, the movable center floor section 120 may be slidably moved toward the front side 200*f* of the mobile drilling rig 200 (see, FIG. 1A) until the front end 140*f* of the drawworks skid 140 is immediately adjacent to, e.g., substantially in contact with, the back ends 101*b* and 102*b* of the upper boxes 101*u* and 102*u*, respectively, as will be further described below with respect to the illustrative embodiments shown in FIGS. 8I-8K. Furthermore, in at least some embodiments, after the trailer 155 has been moved away from below the drawworks skid 140, the powered raising apparatuses 106 may then be used to lower the upper boxes 101*u*, 102*u* to a fully collapsed position relative to the lower boxes 101L, 102L in anticipation of further stages of rig assembly.

In certain embodiments, the above-described illustrative steps that may be used to removably attach the drawworks skid 140 to the movable center floor section 120 may be performed after the drilling rig mast of the mobile drilling rig 200 has been completely assembled. Furthermore, and depending on the overall rig assembly and erection strategy, in at least some embodiments the drawworks skid 140 may be removably attached to the movable center floor section 120 after the completed drilling rig mast has been erected to an operating position, as shown in FIGS. 3B-3C. However, in other embodiments the drawworks skid 140 may be attached to the movable center floor section 120 prior to the erection of the completed drilling rig mast.

Figure 4A:
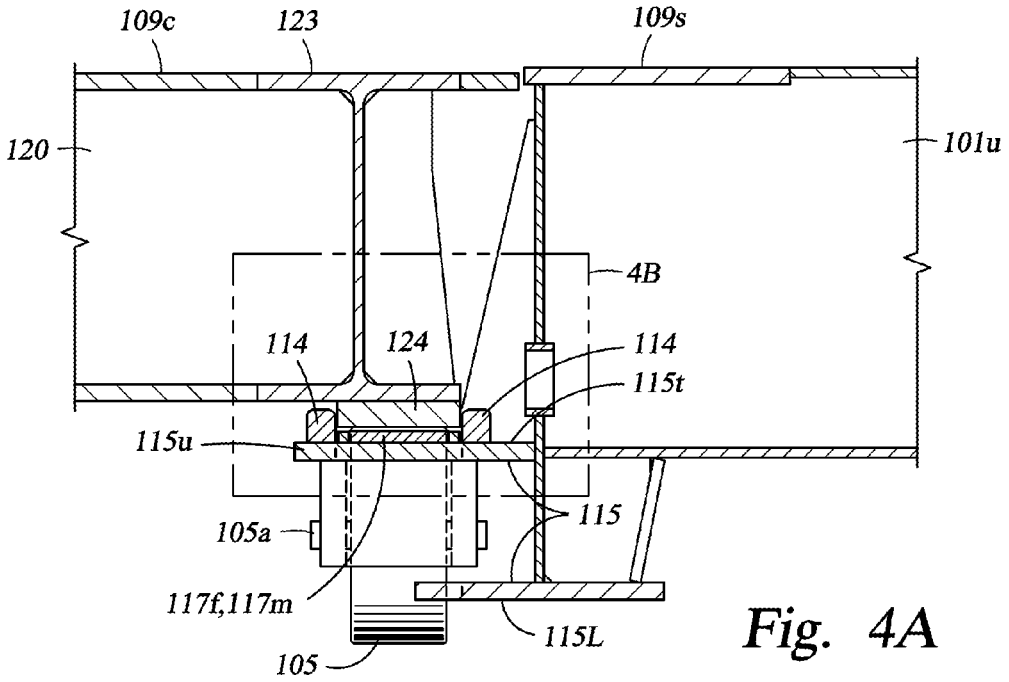
FIGS. 4A and 4B are various views of one embodiment of a support interface between a movable center floor section and raisable substructure of an illustrative mobile drilling rig disclosed herein.
Figure 4B:
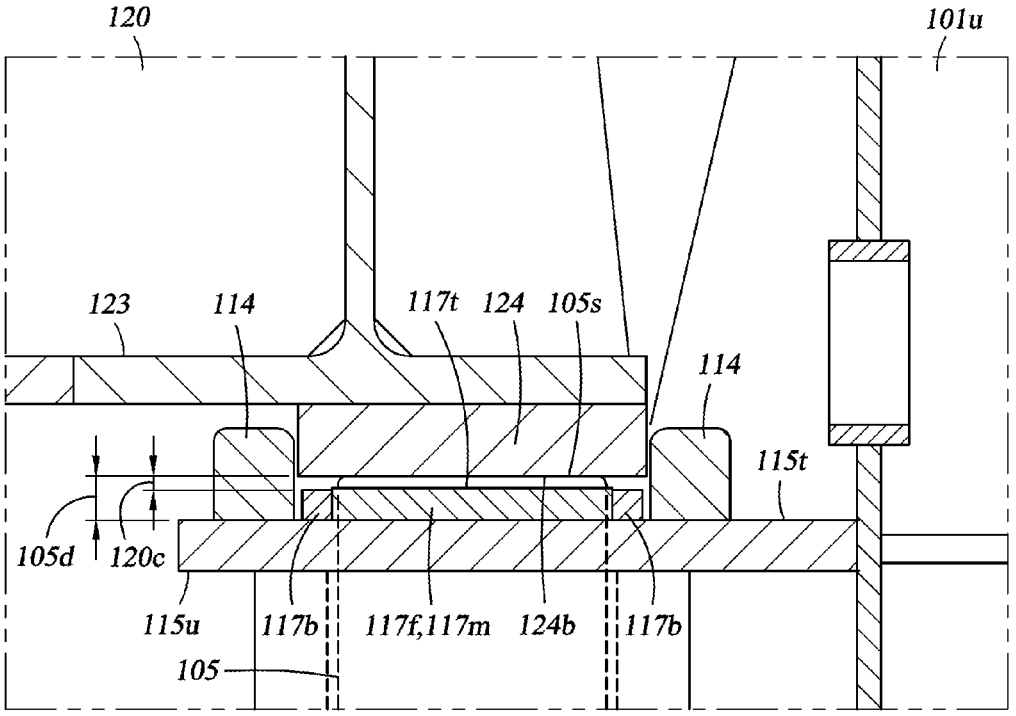

FIGS. 4A and 4B are various illustrative views of one embodiment of a support interface between the movable center floor section 120 and the raisable substructure 100 that are shown in FIGS. 1A-3C and described above. More specifically, FIG. 4A is the section view "4A-4A" from the illustrative embodiment shown in FIG. 1E, detailing some aspects of the support relationship between the upper box 101*u*, the movable center floor section 120, and a representative roller wheel support 105 during the sliding movement of the movable center floor section 120. Furthermore, FIG. 4B is a close-up view of the area designated "4B" in FIG. 4A, depicting some illustrative details shown in FIG. 4A.

As noted previously, the roller wheel supports 105 (shown schematically in FIG. 4A) may be rotatably mounted in the center floor support member 115 on, for example, a center axle 105*a* (also shown schematically in FIG. 4A). In certain embodiments disclosed herein, the center floor support members 115 may include an upper support member 115*u*, a lower support member 115L, and a stiffener or gusset 115*g* (see, FIGS. 4C-4E, described below). Furthermore, a pair of guide rails 114 may be attached to an upper surface 115*t* of the upper support member 115*u*, which may be spaced apart by a sufficient distance so as to guide a bearing plate 124 on a respective side support beam 123 as the movable center floor section 120 slidably moves along the roller wheel supports 105.

In at least some embodiments, a plurality of fixed spacers 117*f* and a plurality of corresponding movable spacers 117*m* may also be positioned between the movable center floor section 120 and the center floor support members 115 during the above-described sliding movement. As will be described in further detail with respect to FIGS. 4C-4E below, each of the fixed spacers 117*f* is fixedly attached to the upper surface 115*t* of the center floor support members 115, whereas, during the sliding movement of the movable center floor section 120, each corresponding movable spacer 117*m* is movably positioned on the upper surface 115*t* adjacent to a respective fixed spacer 117*f*. Furthermore, as previously described, the movable spacers 117*m* may be interconnected by way of the positioning bars 117*b*, which may be used during a subsequent rig assembly stage to simultaneously re-position each corresponding movable spacer 117*m* above a respective fixed spacer 117*f*, as will be further described with respect FIGS. 6A-7B below.

During sliding movement of the movable center floor section 120 across the plurality of roller wheel supports 105, a bottom surface 124*b* of the bearing plate 124 is in rolling contact with a surface 105*s* of each roller wheel support 105. Furthermore, in certain exemplary embodiments, the surface 105*s* of the roller wheel support 105 may project above the upper surface 115*t* of the upper support member 115*u* by a distance 105*d* so that there is a sufficiently sized clearance space 120*c* between the bottom surface 124*b* of the bearing plate 124 and the top surfaces 117*t* of the spacers 117*f*, 117*m*, thereby allowing the sliding movement of the movable center floor section 120 substantially without restriction.

Figure 4C:
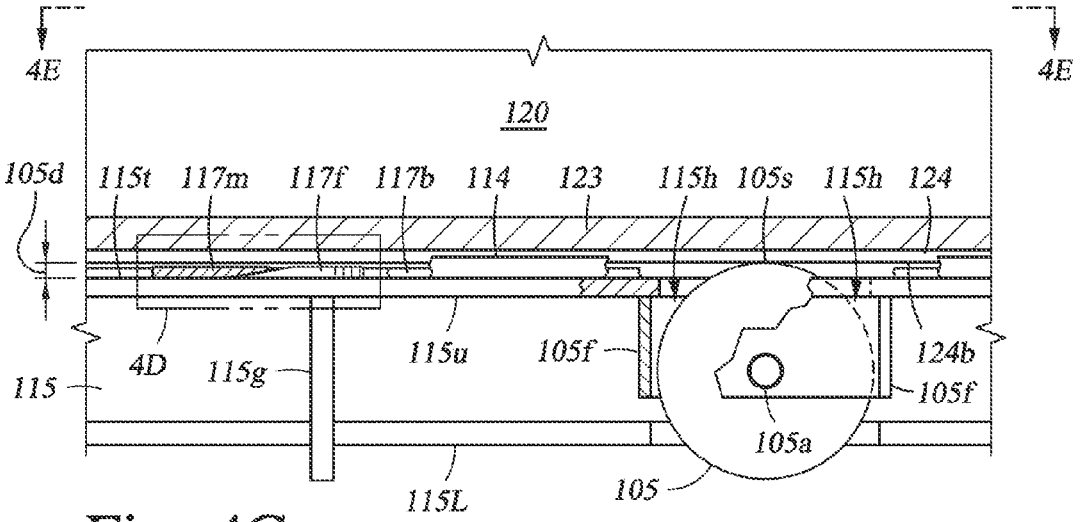
FIGS. 4C-4E are various close-up views of illustrative fixed and movable spacers positioned between the movable center floor section and the raisable substructure according to one illustrative embodiment of the present disclosure.
Figure 4D:
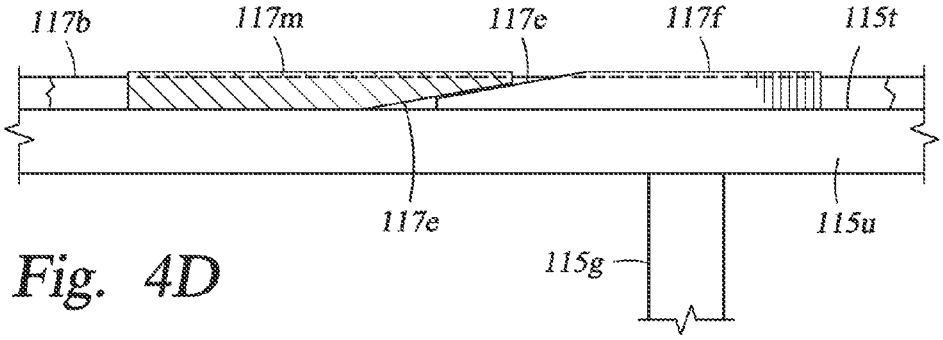

FIG. 4C is a side elevation view of the detail "4C" from the disclosed embodiment illustrated in FIG. 2B, showing some additional aspects of the relationship between an exemplary fixed spacer 117*f*, a movable spacer 117*m*, the movable center floor section 120, the center floor support member 115, and a representative roller wheel support 105 during the sliding movement of the movable center floor section 120. Additionally, FIG. 4D is a close-up view of the area designated "4D" in FIG. 4C, providing further illustrative details of some aspects of the spacers 117*f*, 117*m*. As shown in the illustrative embodiment depicted in FIGS. 4C and 4D, the fixed spacer 117*f* may be fixedly attached to the upper surface 115*t* of the upper support member 115*u*, and the movable spacer 117*m* may be movably positioned on the upper surface 115*t* immediately adjacent to the fixed spacer 117*f*. In certain embodiments, the spacers 117*f* and 117*m* may have matingly engaging tapered surfaces 117*e*, which may be adapted to allow the movable spacer 117*m* to slide laterally and above the fixed spacer 117*f* when moved and positioned by the positioning bar 117*b* (shown as hidden lines in FIG. 4D) during a later rig assembly stage (see, e.g., FIGS. 6A-7B). Furthermore, in at least some embodiments, the fixed spacer 117*f* may be substantially positioned above a stiffener or gusset 115*g*, which may be adapted to provide additional local stiffness and/or support to the center floor support member 115 when the movable center floor section 120 is supported by the fixed and movable spacers 117*f*, 117*m*, as will be further described with respect FIGS. 6A-7B below.

In some disclosed embodiments, the roller wheel support 105 may be rotatably mounted on an axle 105*a* and inside a roller wheel frame 105*f*, as shown in FIG. 4C. Additionally, the roller wheel frame 105*f* may substantially define an opening 115*h* in the upper support member 115*u* through which the roller wheel support 105 may project so as to contact the bottom surface 124*b* of the bearing plate 124 during sliding movement of the movable center floor section 120, and to provide the requisite distance 105*d* between the bearing plate 124 and the upper surface 115*t* of the upper support member 115*u*, as previously described.

Figure 4E:
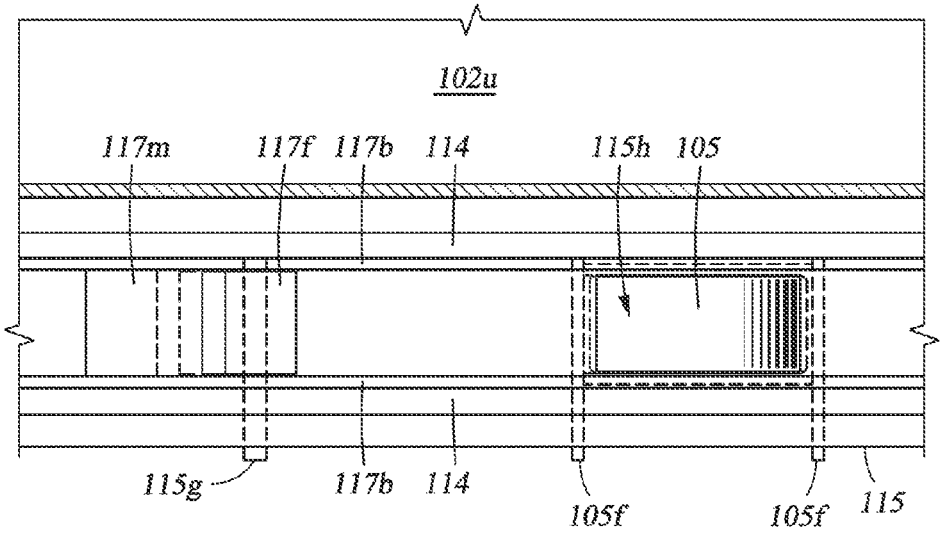

FIG. 4E is a plan view "4E-4E" of the detail shown in FIG. 4C illustrating some additional details of the fixed spacers 117*f*, the movable spacers 117*m*, the positioning bars 117*b*, and a representative roller wheel support 105, wherein the movable center floor section 120 has been removed from the view for clarity. As shown in FIG. 4E, the movable spacers 117*m* are positioned between and attached to the positioning bars 117*b*. In at least some embodiments, the positioning bars 117*b* may straddle the fixed spacers 117*f*, so that the positioning bars 117*b* can be easily moved relative to the fixed spacer 117*f*, thereby enabling the positioning bars 117*b* to readily and easily position the movable spacers 117*m* above the fixed spacers 117*f*, as previously noted. Furthermore, the positioning bars 117*b* may similarly straddle the roller wheel supports 105 so as not to interfere with the rolling action of the roller wheel supports 105 during the sliding movement of the movable center floor section 120.

Figure 5B:
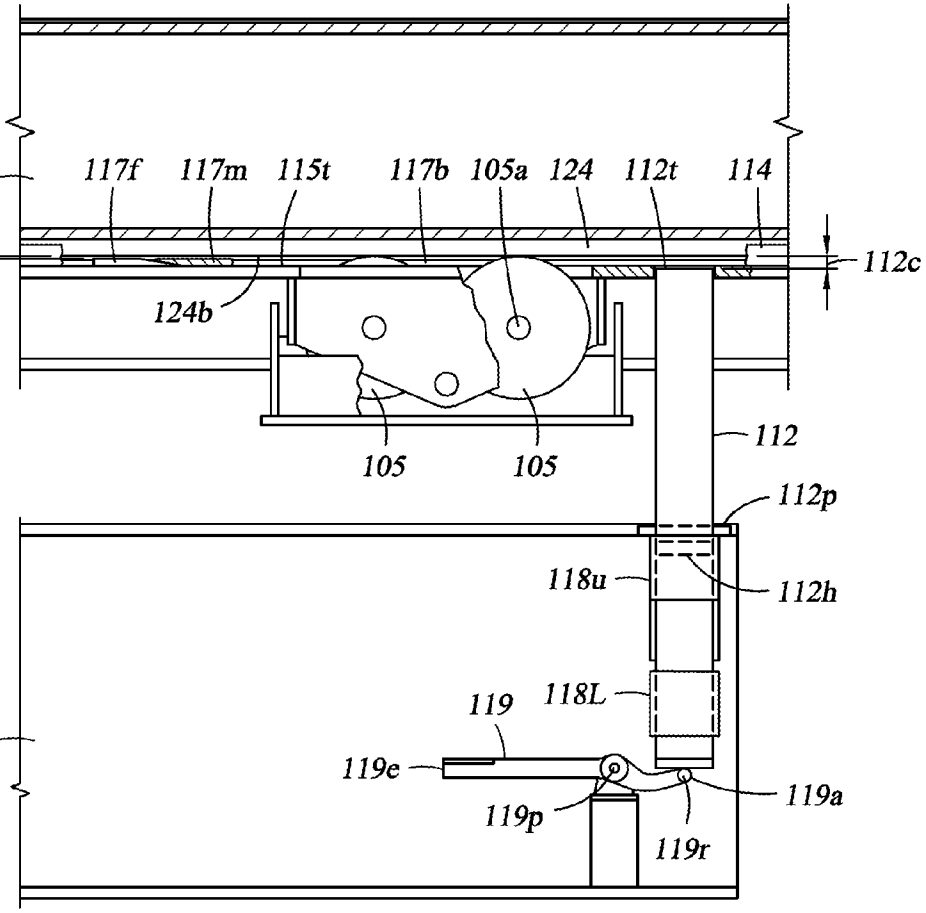
FIGS. 5A and 5B are various views of one embodiment of an illustrative support post for the movable center floor section during an illustrative stage of rig assembly disclosed herein.
Figure 5A:
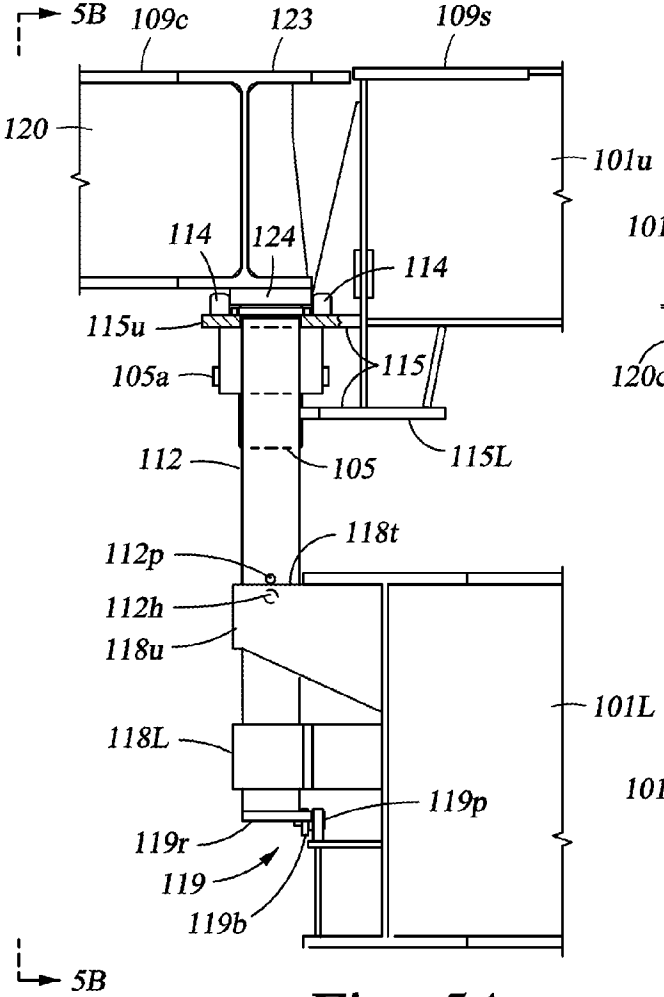

FIGS. 5A and 5B illustrate some aspects of a support post 112 that may be used to temporarily support the movable center floor section 120 during some stages of rig assembly. More specifically, FIG. 5A is an end view "5A-5A" of the illustrative upper and lower boxes 101*u*, 101L as shown in FIG. 2A, and FIG. 5B is the side elevation view "5B-5B" indicated in FIG. 5A. In the configuration shown in FIGS. 5A and 5B, the support post 112 is in a lowered post position, thereby allowing the movable center floor section 120 to substantially freely slide on the roller wheel supports 105. Furthermore, the upper box 101*u* and movable center floor section 120 are shown in a fully lowered position relative to the lower box 101L.

In some embodiments, the support post 112 may be supported in the illustrative lowered post position shown in FIGS. 5A and 5B by a post support pin 112*p* that is in supporting contact with a top surface 118*t* of an upper guide bracket 118*u* that is fixedly attached to the lower box 101L. In this configuration, the top end 112*t* of the support post 112 may be positioned below the bottom surface 124*b* by a sufficiently sized clearance space 112*c* so that the support post 112 does not interfere with the sliding movement of the movable center floor section 120. In certain embodiments, the support post 112 may be guided at a lower end by a lower guide bracket 118L that is also fixedly attached to the lower box 101L, and which, together with the upper guide bracket 118*u*, may be adapted to maintain the support post 112 in a substantially vertical orientation. Also as shown in FIGS. 5A and 5B, a lever bracket 119*b* may be fixedly attached to the lower box 101L, and a lever 119 may be pivotably attached to the lever bracket 119*b* at a pinned connection 119*p*. In certain disclosed embodiments, the lever 119 may be used to raise the support post 112 to a raised post position during at least some further rig assembly stages, as will be described with respect to FIGS. 6A-6E below.

Figure 6A:
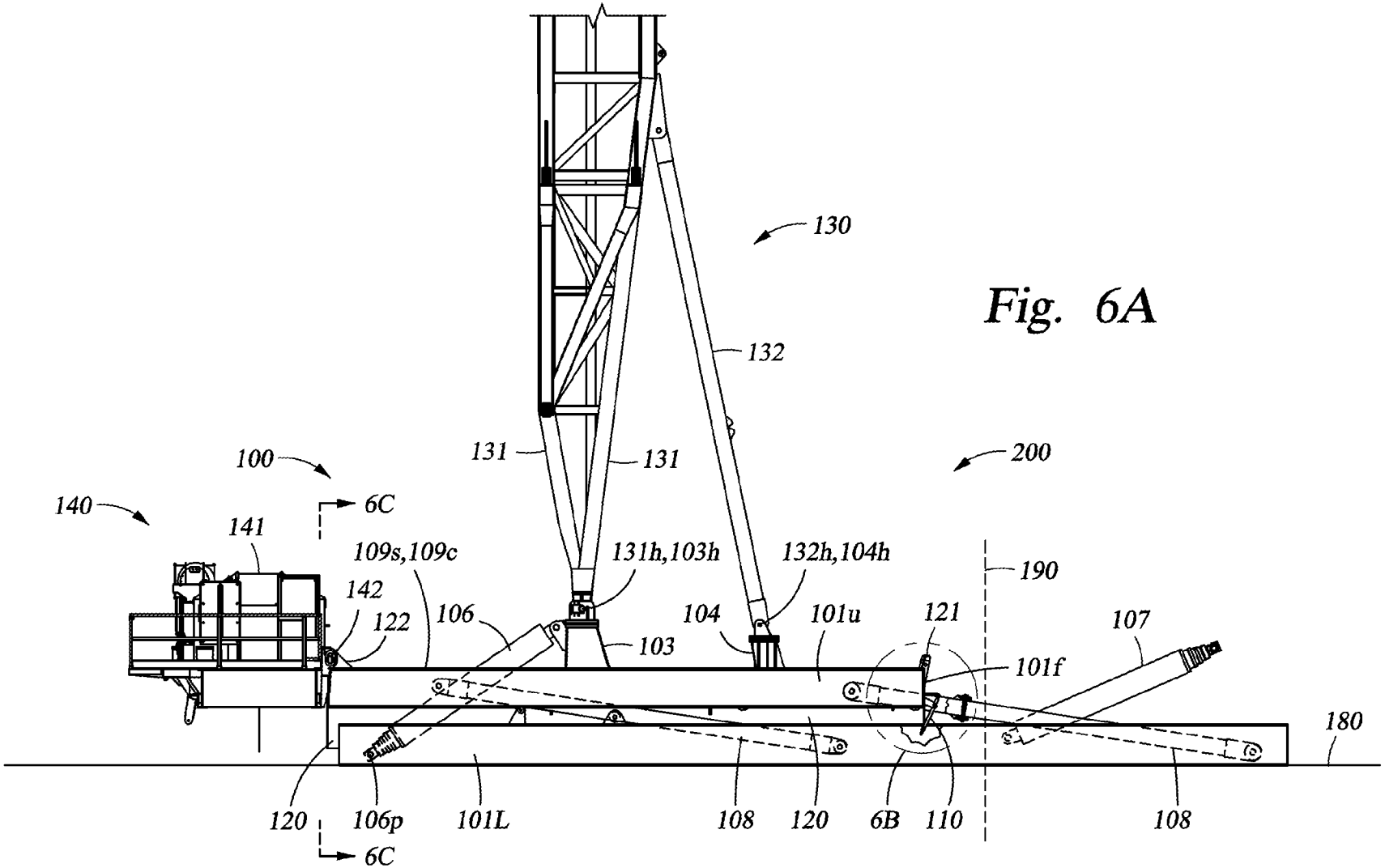
FIGS. 6A-6E are various views of the illustrative mobile drilling rig of FIG. 3C during further rig assembly stages, wherein the movable center floor section is being temporarily supported by support posts while movable spacers are being positioned between the movable center floor section and fixed spacers on the raisable substructure.
Figure 6B:
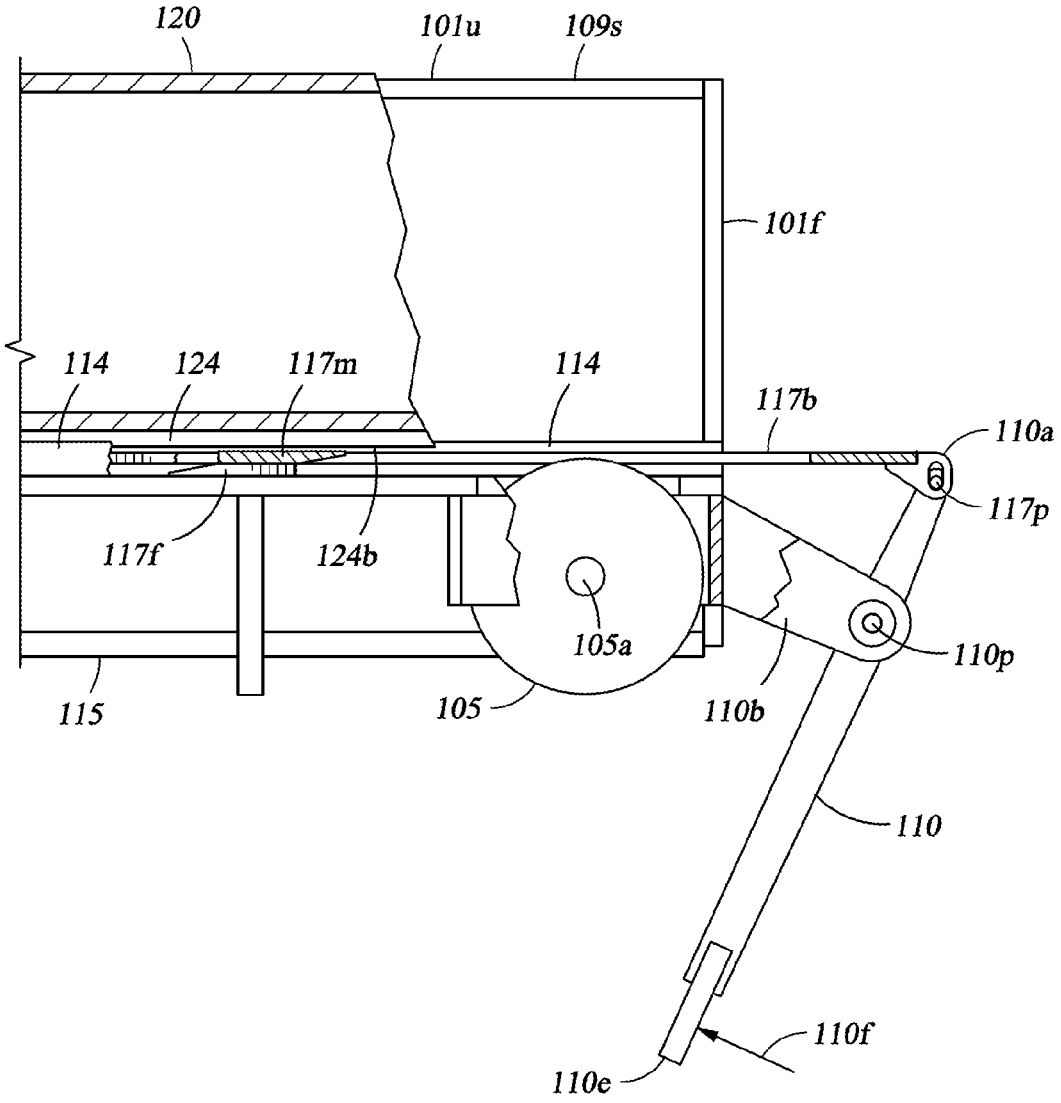
Figure 6D:
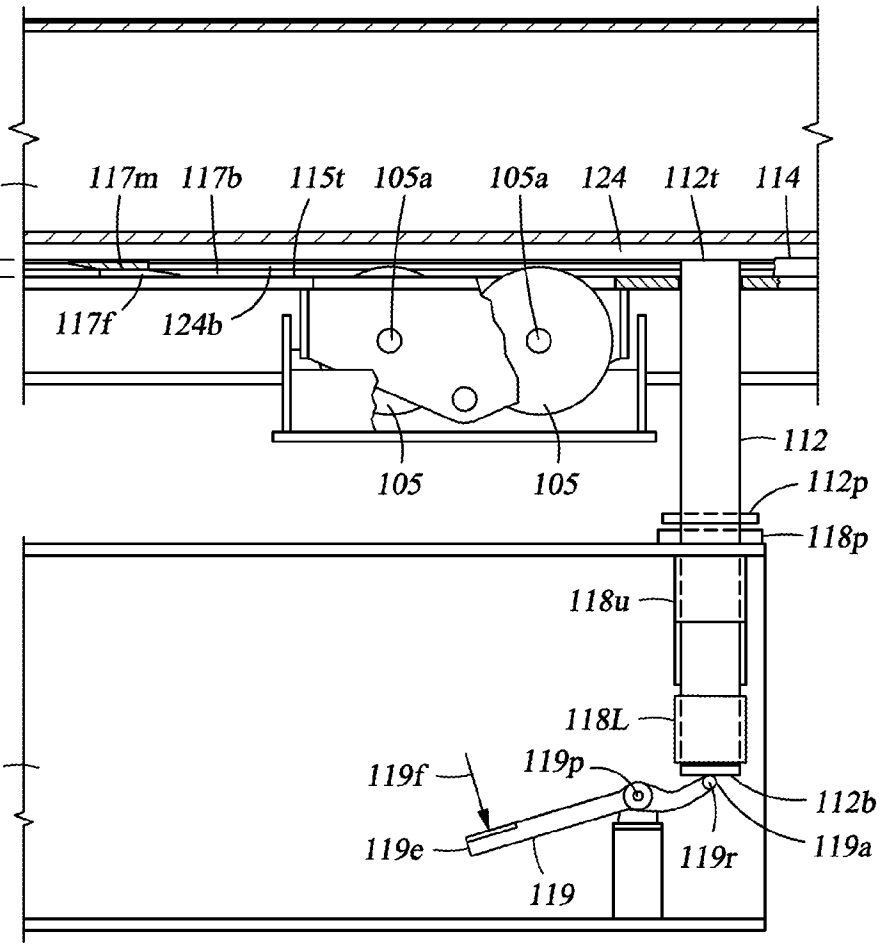
Figure 6C:
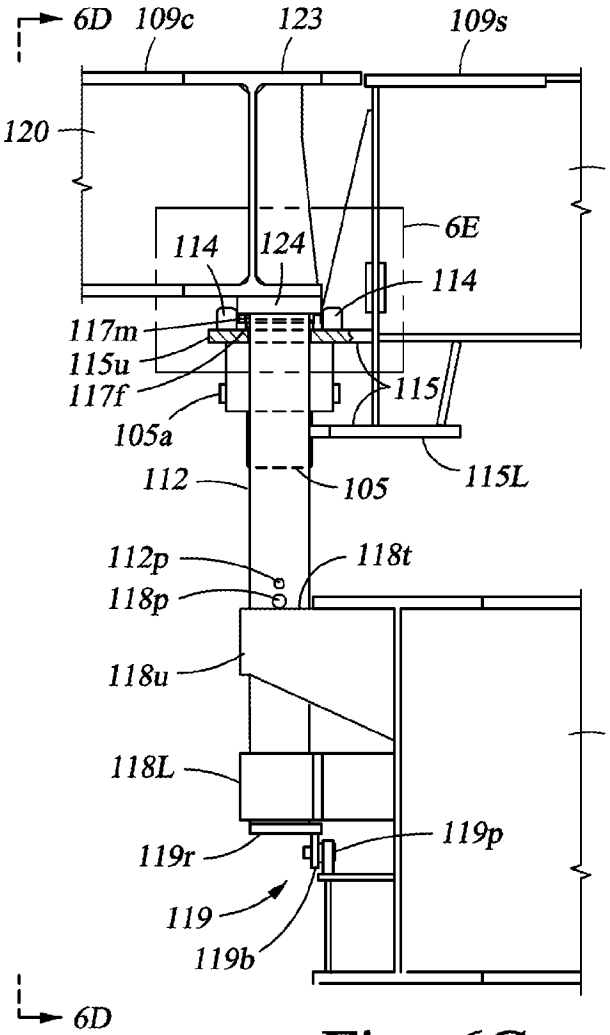

FIG. 6A-6E show various views of an illustrative mobile drilling rig of the present disclosure during further rig assembly stages. More specifically, FIG. 6A is a side elevation view of the mobile drilling rig 200 shown in FIG. 3A after the drilling rig mast (a portion of the bottom mast section 130 is shown in FIG. 6A) and the drawworks skid 140 have both been attached to the raisable substructure 100. Additionally, FIG. 6B is a close-up view of the area designated "6B" in FIG. 6A, showing some detailed aspects of the movable spacer actuator handle 110. Furthermore, FIG. 6C is an end view "6C-6C" of the illustrative upper and lower boxes 101*u*, 101L as indicated in FIG. 6A, and FIG. 6D is the side elevation view "6D-6D" indicated in FIG. 6C. It should be appreciated that the end and side elevation views shown in FIGS. 6C and 6D substantially correspond to the end and side elevation views shown in FIGS. 5A and 5B above, respectively, albeit illustrating further stages of rig assembly, as will be described below.

As shown in FIG. 6A, the powered raising apparatuses 106 may be actuated to raise the upper boxes 101*u*, 102*u* so that the movable center floor section 120 installed thereon is lifted off of the roller wheel supports 105. In certain embodiments, the upper boxes 101*u*, 102*u* may be raised until there is a sufficiently sized clearance space 124*c* (see, FIG. 6D) between the upper surface 115*t* of the center floor support members 115 and the bottom surface 124*b* of the bearing plates 124 so as to enable the movable spacers 117*m* to be movably positioned between the fixed spacers 117*f* and the movable center floor section 120.

As noted previously, the support posts 112 may be used during at least some rig assembly stages to temporarily support the movable center floor section 120. For example, in the illustrative embodiments shown in FIGS. 6A-6E, the support posts 112 may be used to temporarily support the movable center floor section 120 so that the movable spacers 117*m* may be movably positioned above the fixed spacers 117*f* in the illustrative manner described with respect to FIG. 6B below. Accordingly, after the powered raising apparatuses 106 have been actuated to raise the movable center floor section 120 off of the roller wheel supports 105 so as to provide the clearance space 124*c*, the support post 112 may be raised to a raised post position by the lever 119.

In at least some embodiments, each of the support posts 112 may be raised by imparting a substantially downward actuating force 119*f* near an end 119*e* of the lever 119 (see, FIG. 6D), thereby pivotably raising a lifting rod 119*r* located at an opposite end 119*a* of the lever 119. The lifting rod 119*r* may then contact a bottom end 112*b* of the support post 112, thereby raising the support post 112 so that the post support pin 112*p* is no longer in supporting contact with the top surface 118*t* of the upper guide bracket 118*u* (see, FIGS. 5A and 5B). The support posts 112 may then be raised to the post support position, i.e., wherein an appropriately located pin hole 112*h* in each respective support post 112 is raised above the top surface 118*t* of a respective upper guide bracket 118*u*. In some embodiments, a center floor support pin 118*p* (see, FIGS. 6C and 6D) may then be temporarily installed in each respective pin hole 112*h* (see, FIGS. 5A and 5B) so that each center floor support pin 118*p* may be put into supporting contact with the top surface 118*t* of an upper guide bracket 118*u*. Thereafter, the powered raising apparatuses 106 may be further actuated so as to lower the upper boxes 101*u*, 102*u* until the bottom surfaces 124*b* of the bearing plates 124 contact the top end 112*t* of each respective support post 112. In this configuration, the movable center floor section 120 may be temporarily supported by support posts 112, e.g., by the center floor support pins 118*p* that are installed in the pin holes 112 and are in supporting contact with the upper guide brackets 118*u*, as shown in FIGS. 6C and 6D.

In certain illustrative embodiments, while the movable center floor section 120 is being temporarily supported by the support posts 112, a movable spacer actuator handle 110 may be actuated so to move each of the movable spacers 117*m* above a respective fixed spacer 117*f*. As illustrated in the detailed view shown in FIG. 6B, the movable spacer actuator handle 110 may be pivotably attached to a handle bracket 110*b* at a pinned connection 110*p*, and pivotably attached to the movable spacer positioning bars 117*b* at a pinned connection 117*p*. In at least some embodiments disclosed herein, the movable spacers 117*m* may be movably positioned above the fixed spacers 117*f* by imparting a substantially lateral actuating force 110*f* to an end 110*e* of the movable spacer actuator handle 110, thereby pivoting the actuator handle 110 about the pinned connection 110*p* and laterally moving an opposite end 110*a* of the actuator handle 110 laterally away from the front end 101*f* of the upper box 101*u*. As the opposite end 110*a* of the movable spacer actuator handle 110 moves laterally away from the front end 101*f*, the movable spacer positioning bars 117*b* (and each of the movable spacers 117*m* attached thereto) may also be moved laterally with the end 110*a* by the pinned connection 117*p* that pivotably attaches the positioning bars 117*b* to the actuator hand 110. Accordingly, when the movable spacers 117*m* are laterally moved by the movable spacer positioning bars 117*b*, the matingly engaging tapered surfaces 117*e* (see, FIGS. 4C and 4D, described above) of the spacers 117*f* and 117*m* allow each movable spacer 117*m* to slidably move into a new position above a respective adjacent fixed spacer 117*f*, as shown in FIGS. 6B and 6D.

Figure 6E:
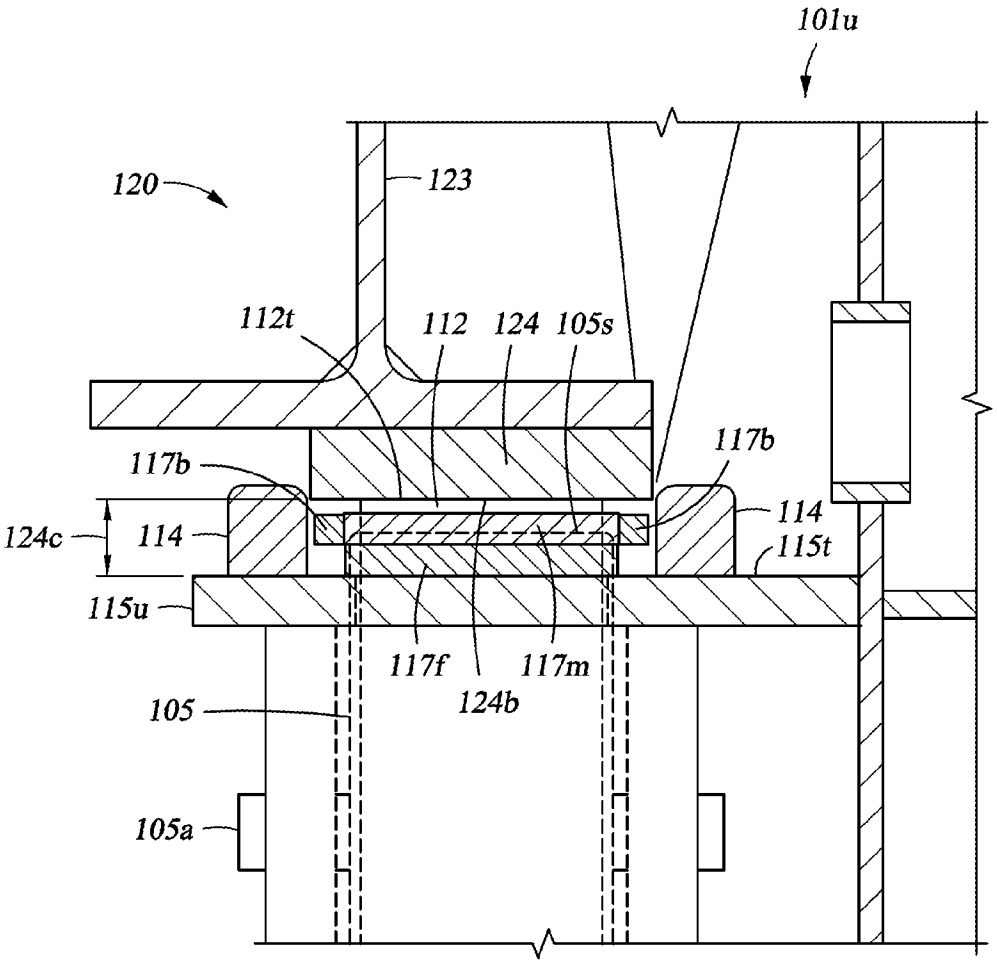

FIG. 6E is a close-up view of the area designated "6E" in FIG. 6C, showing some detailed aspects of the spacers 117*f*, 117*m*, the base plate 124 of the movable center floor section 120, the support post 112, and the roller wheel support 105. As shown in FIG. 6E, the bottom surface 124*b* of the bearing plate 124 is no longer in rolling contact with the surface 105*s* of the roller wheel support 105. Instead, in this configuration, the top end 112*t* of the support post 112 is in contact with the bottom surface 124*b*, and therefore supports the movable center floor section 120 with a clearance space 124*c* between the bottom surface 124*b* and the upper surface 115*t* of the upper support member 115*u*. Furthermore, the movable spacer 117*m* has been positioned above the fixed spacer 117*f* by actuation of the movable spacer actuator handle 110, as previously described.

Figure 7B:
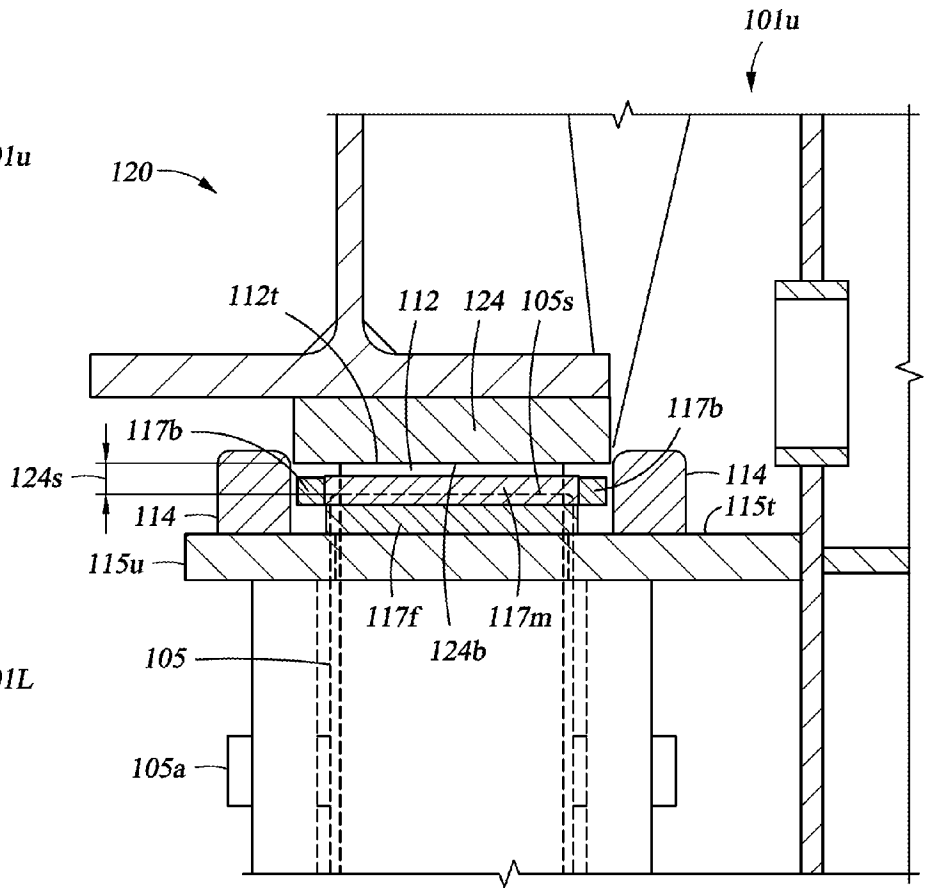
FIGS. 7A and 7B are various detailed views of the illustrative support post shown in FIGS. 6A-6E after the movable center floor section has been lowered onto the fixed and movable spacers.
Figure 7A:
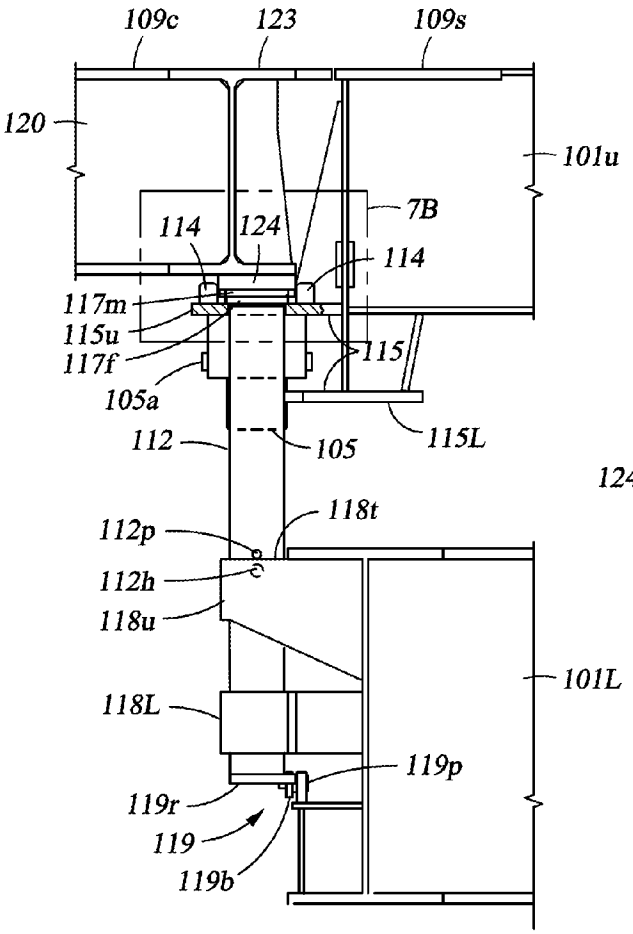

FIGS. 7A and 7B illustrate the mobile drilling rig 200 of FIGS. 6A-6E in a further rig assembly stage, after the movable center floor section 120 has been moved to an operating position on the raisable substructure 100. More specifically, FIG. 7A is an end view of the upper and lower boxes 101*u*, 101L that substantially corresponds to the end view of the upper and lower boxes 101*u*, 101L shown in FIG. 6C after the support posts 112 have been lowered to the lowered post position as shown in FIGS. 5A and 5B, wherein, however, support of the movable center floor section 120 has been transferred from its temporary position on the support posts 112 to an operating position on the spacers 117*f*, 117*m* and the center floor support member 115.

In some embodiments, the movable center floor section 120 may be moved to an operating position by first actuating the powered raising apparatuses 106 so as to lift the movable center floor section 120 off of the respective top ends 112*t* of each support post 112. Each support post 112 may then be lowered to the lowered post position by the following exemplary steps:

1) raising the support post 112 with a respective lever 119 (as described above with respect to FIGS. 6C and 6D) so that the center floor support pins 118*p* are no longer in supporting contact with the top surface 118*t* of the upper guide bracket 118*u;*
2) removing each center floor support pin 118*p* from its respective pin hole 112*h*; and
3) lowering the support post 112 with the lever 119 until the post support pin 112*p* is in supporting contact with the top surface 118*t*.

Thereafter, the powered raising apparatuses 106 may again be actuated so as to lower the upper boxes 101*u*, 102*u* with the movable center floor section 120 thereon until the bottom surface 124*b* of the bearing plates 124 come into supporting contact with the movable spacers 117*m*, each of which, as described above, have been previously positioned above a respective fixed spacer 117*f*.

FIG. 7B is a close-up view of the area designated "7B" in FIG. 7A, showing some detailed aspects of the spacers 117*f*, 117*m*, the base plate 124 of the movable center floor section 120, the support post 112, and the roller wheel support 105. As shown in FIG. 7B, the movable center floor section 120 is not supported by the surface 105*s* of the roller wheel supports 105, but is instead supported by the spacers 117*f* and 117*m*, which are now in a stacked configuration, i.e., wherein the movable spacer 117*m* is stacked on top of the fixed spaced 117*f*. Furthermore, the bottom surface 124*b* of the bearing plate 124 is separated from the surface 105*s* of the roller wheel support 105 by a space 124*s*. Accordingly, the dead load of the movable center floor section 120, as well as any additional dead and/or live loads imposed on the movable center floor section 120 during rig operation, are transferred to the substructure through the spacers 117*f*, 117*m*, and not through the roller wheel supports 105. Thereafter, the raisable substructure 100 may be raised to a drilling rig operating configuration, i.e., wherein the substructure raising means are used to raise the upper boxes 101*u*, 102*u* above the lower boxes 101L, 102L, e.g., by actuating the powered raising apparatus 106, after which any additional support legs and/or braces may be installed on the raisable substructure 100, as may be required.

FIGS. 8A-8K illustrate additional exemplary embodiments of a mobile drilling rig 400 disclosed herein, and in particular, illustrative floor moving means that may be used to slidably move a movable center floor section 320 along substructure boxes 301, 302 of a raisable substructure 300 during the assembly and erection of the rig 400. It should be understood that some elements of the rig 400 may substantially correspond to like elements depicted with respect to some embodiments of the illustrative mobile drilling rig 200 shown in FIGS. 1A-7B and described above. Furthermore, it should be noted that, where appropriate, the reference numbers used in depicting the various elements shown in the illustrative embodiments of FIGS. 8A-8K may substantially correspond, where appropriate, to the reference numbers used in describing related elements illustrated in FIG. 1A-7B above, except that the leading numeral in each figure has been changed from a "1" to a "3," or from a "2" to a "4," where appropriate. For example, the raisable substructure "100" may correspond to the raisable substructure "300," the mast support shoes "103" may correspond to the mast support shoes "303," the pivotable support members "108" may correspond to the pivotable support members "308," and so on. Similarly, the front side "200*f*" of the mobile drilling rig "200" may substantially corresponds to the front side "400*f*" of the mobile drilling rig "200.". Accordingly, the reference number designations used to identify some elements of the presently disclosed subject matter may be illustrated in the FIGS. 8A-8K but may not be specifically described in the following disclosure. In those instances, it should be understood that the numbered elements shown in FIGS. 8A-8K which are not described in detail below substantially correspond with their like-numbered counterparts illustrated in FIGS. 1A-7B and described in the associated disclosure set forth above.

Figure 8A:
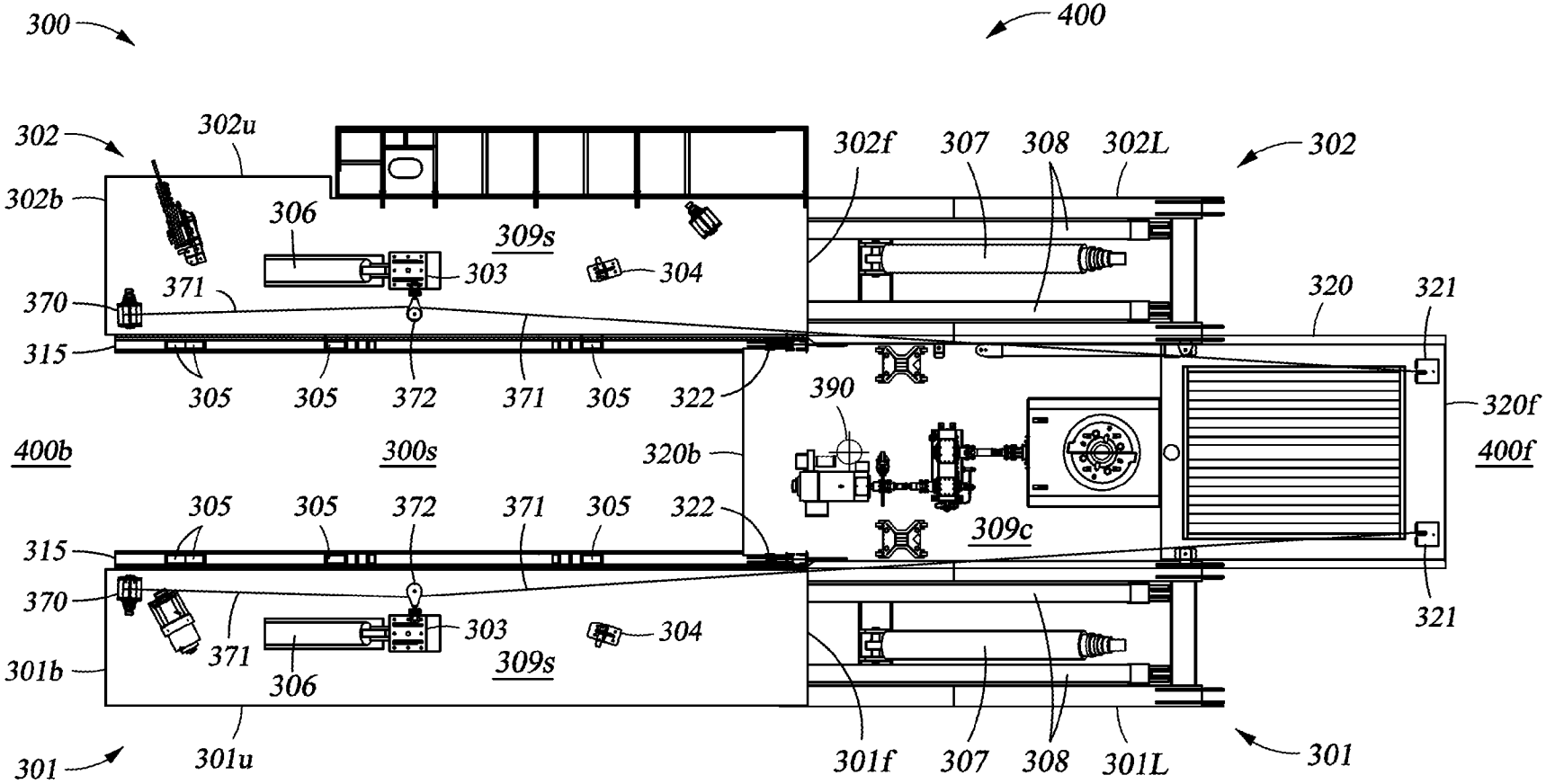
FIGS. 8A-8K are various plan and elevation views of a mobile drilling rig of the present disclosure that depict illustrative steps of using floor moving means to slidably move an illustrative movable center floor section according to the present disclosure during various stages of drilling rig assembly.
Figure 8B:
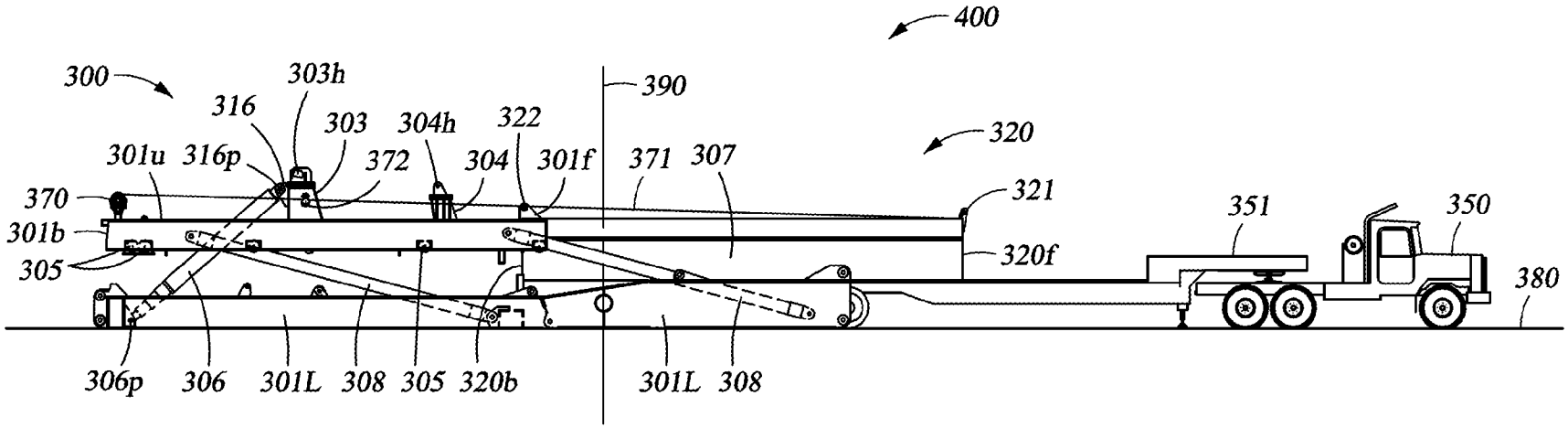

FIGS. 8A and 8B are plan and elevation views, respectively, of an early rig assembly stage of the mobile drilling rig 400 wherein a movable center floor section 320 is being positioned on a raisable substructure 300 in a manner that is similar to that illustrated in FIGS. 1A-1E and described above. For example, in some embodiments, the movable center floor section 320 may be loaded on a trailer 351, which may then be moved by a truck 350 (not shown in FIG. 8A, for clarity) over the ground 380 and into position in an open space 300*s* between first and second substructure boxes 301, 302, until the back end 320*b* of the movable center floor section 320 extends beyond the front ends 301*f*, 302*f* of the upper boxes 301*u*, 302*u*, respectively, of the raisable substructure 300. The upper boxes 301*u*, 302*u* may then be raised using powered raising apparatuses 306 until at least a first roller wheel support 305 closest to a front side 400*f* of the mobile drilling rig 400 contacts bearing plates 324 on the side support beams 323 of the movable center floor section 320.

In certain embodiments, floor moving means, such as a winch line 371 of a winch 370, may be temporarily connected to any suitably sized and positioned structural connection on the movable center floor section 320, such as a mast positioning lug 321, a drawworks support lug 322, and the like. As shown in the illustrative embodiment depicted in FIGS. 8A and 8B, the floor moving means may include, for example, two winches 370, wherein a winch 370 is positioned above and attached to a drilling floor section 309*s* on each upper box 301*u*, 302*u*. Furthermore, the winch lines 371 for each winch 370 may be temporarily attached to the mast positioning lugs 321 at the front end 320*f* of the movable center floor section 320. In at least some embodiments, a suitably designed pulley 372, such as a swivel shackle pulley and the like, may be temporarily attached to a suitably sized and positioned structural connection on each substructure box 301, 302, such as, for example, the mast shoes 303, and each winch line 371 may be sheaved through a respective pulley 372.

In some disclosed embodiments, the winches 370 may be actuated so as to draw in the respective winch lines 371, thereby tugging on the mast positioning lugs 321 so as to slidably move the movable center floor section 320 with the floor sliding means, e.g., across the plurality of roller wheel supports 305 that are rotatably mounted in the center floor support members 315 that are disposed along the inside edges 301*i* and 302*i* of the upper boxes 301*u* and 302*u*, respectively. Thereafter, once the movable center floor section 320 is in a substantially stable position on the raisable substructure 300, the truck/trailer combination 350/351 may be moved away from the open space 300*s*.

Figure 8C:
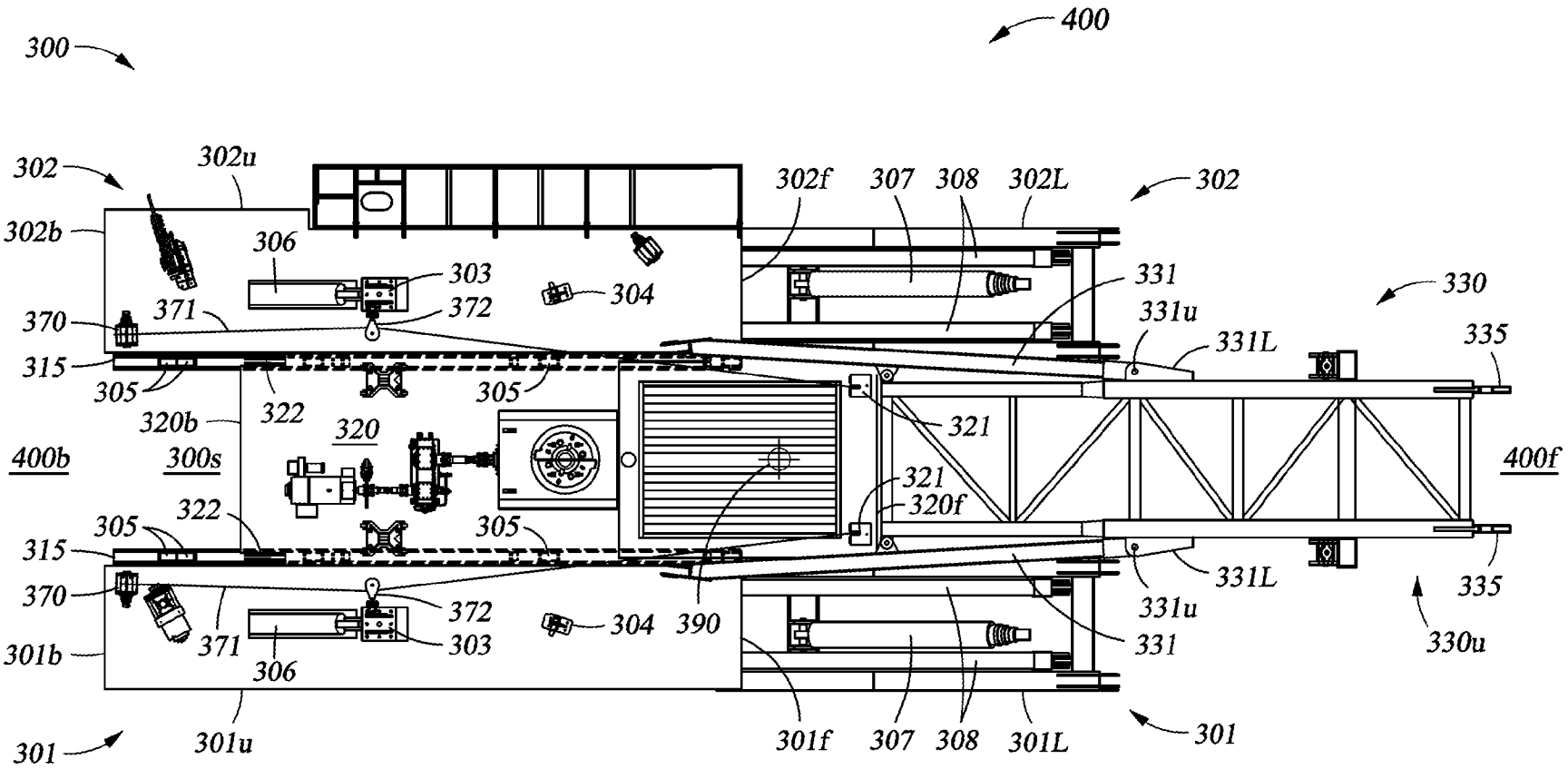
Figure 8D:
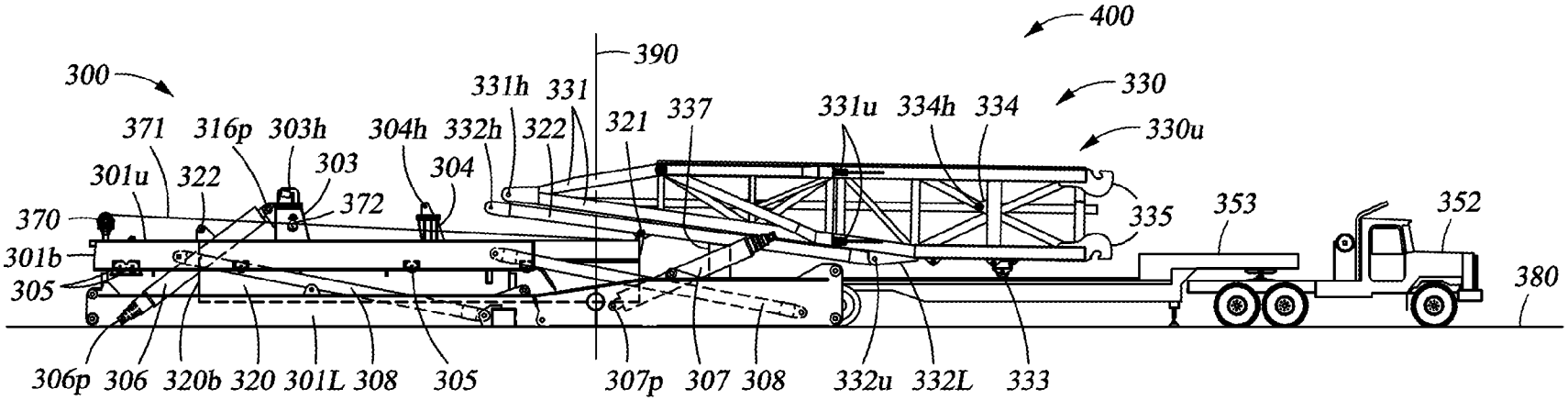

FIGS. 8C-8F are various illustrative views of the mobile drilling rig 400 shown in FIGS. 8A and 8B, depicting further illustrative stages of rig assembly during which a bottom mast section 330 of a drilling rig mast may be attached to the raisable substructure 300. More specifically, FIGS. 8C and 8D are plan and elevation views, respectively, of the mobile drilling rig 400 shown in FIGS. 8A and 8B wherein the bottom mast section 330 is being positioned on the movable center floor section 320 in a manner that is similar to that illustrated in FIG. 2A and described above. For example, in some embodiments, the bottom mast section 330 may be loaded on a trailer 353, which may then be moved by a truck 352 (not shown in FIG. 8C, for clarity) into position in the open space 300*s* (see, FIG. 8A). The floor moving means, e.g., winches 370, and floor sliding means, e.g., roller wheel supports 305, may then be used to slidably move the movable center floor section 320 to a mast installation position, i.e., wherein the front end of the movable center floor section 320 extends beyond the front ends 301*f*, 302*f* of the upper boxes 301*u*, 302*u* as previously described. Thereafter, the substructure raising means, e.g., powered raising apparatuses 306, may be used to raise the upper boxes 301*u*, 302*u* so that the mast positioning lugs 321 may temporarily engage with corresponding engagement lugs (see, e.g., the center floor engagement lugs 136 shown in FIGS. 2A-2E) on the front leg braces 332 of the bottom mast section 330.

Figure 8E:
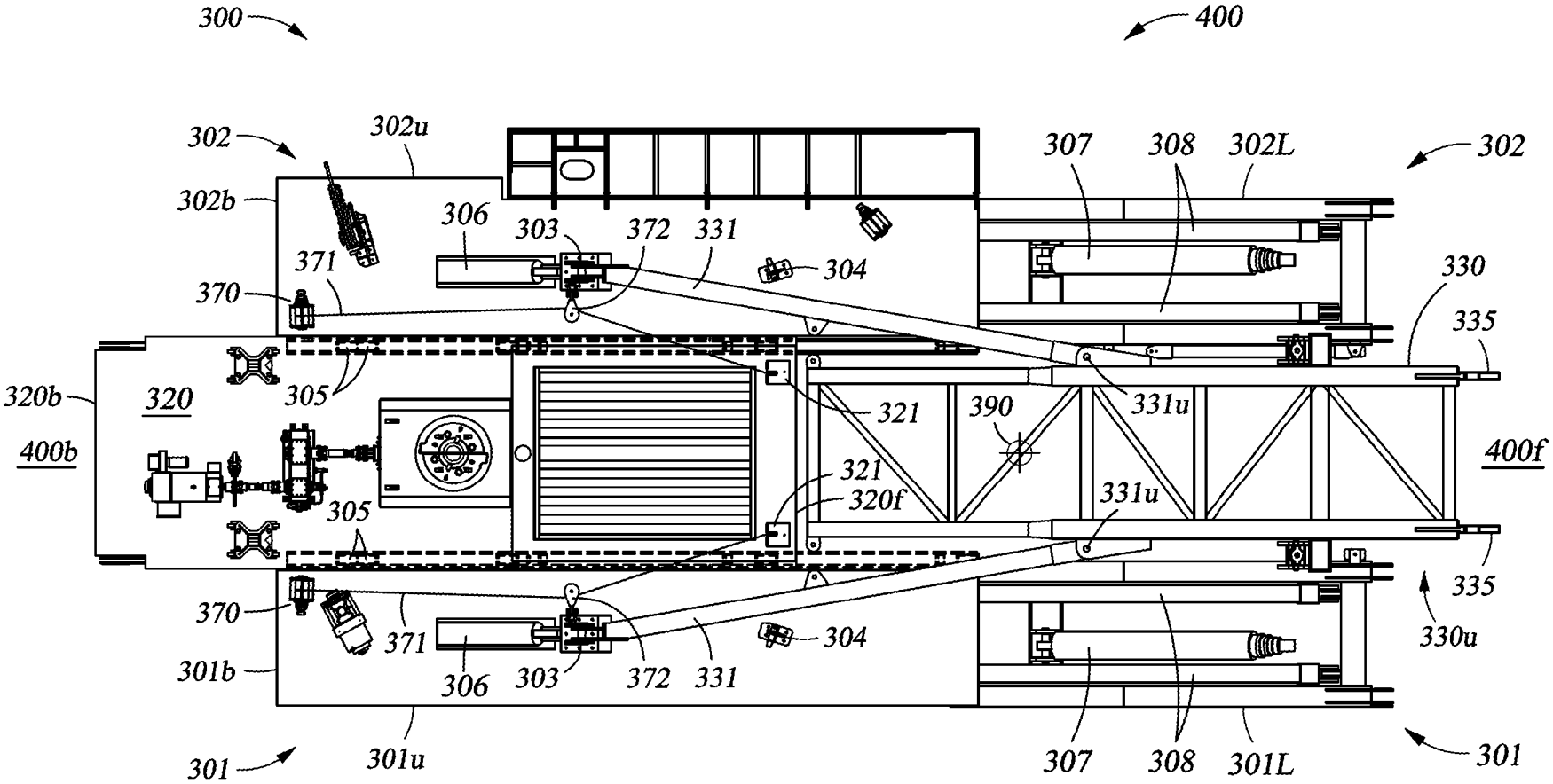
Figure 8F:
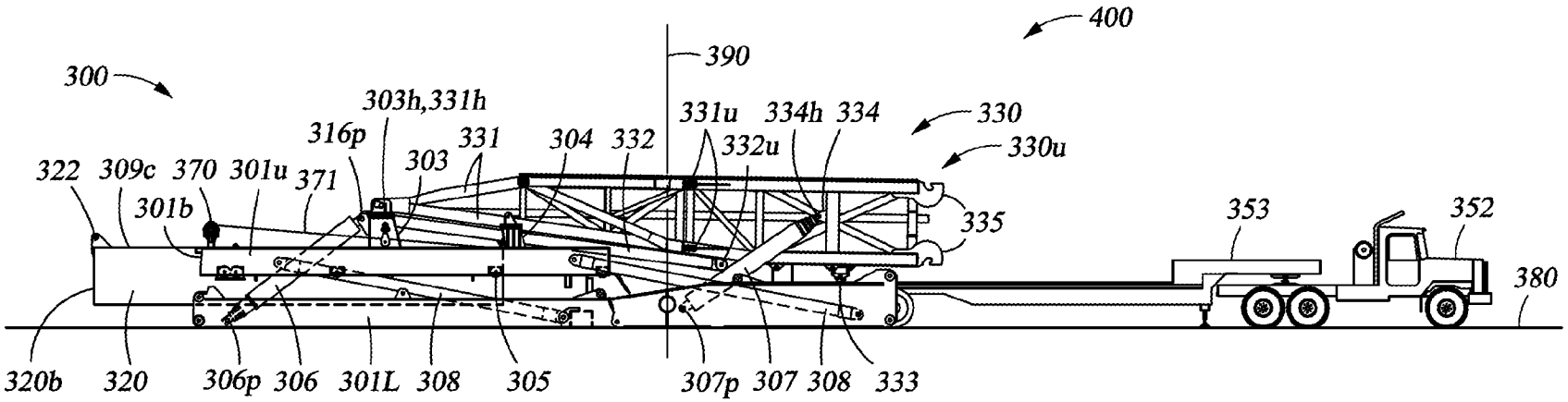

FIGS. 8E and 8F are plan and elevation views, respectively, of the mobile drilling rig 400 shown in FIGS. 8C and 8D after the rear support legs 331 of the bottom mast section 330 have been attached to respective mast shoes 303 positioned on the upper boxes 301*u*, 302*u* of the raisable substructure in a manner that is similar to that illustrated in FIGS. 2D and 2E, and described in further detail above. In certain illustrative embodiments, after the bottom mast section 330 has been positioned on the movable center floor section 320 as described with respect to FIGS. 8C and 8D above, the floor moving means, e.g., winches 370, may be used to slidably move the movable center floor section 320 toward the back side 400*b* of the mobile drilling rig 400. In this way, the movable center floor section 320 may be used to move bottom mast section 330 across the trailer 353 on the rollers 333 until the movable center floor section 320 is in the mast attachment position, i.e., wherein the pin holes 331*h* on the rear support legs 331 may be substantially aligned with and pivotably attached to the pin holes 303*h* on the mast shoes 303 in the manner previously described with respect to FIGS. 2D and 2E above, and as is illustrated in FIGS. 8E and 8F. Thereafter, in at least some embodiments, the drilling rig mast may be fully assembled and erected to an operating position using the mast erection apparatus 307, also as described with respect to FIGS. 2D and 2E above.

Figure 8G:
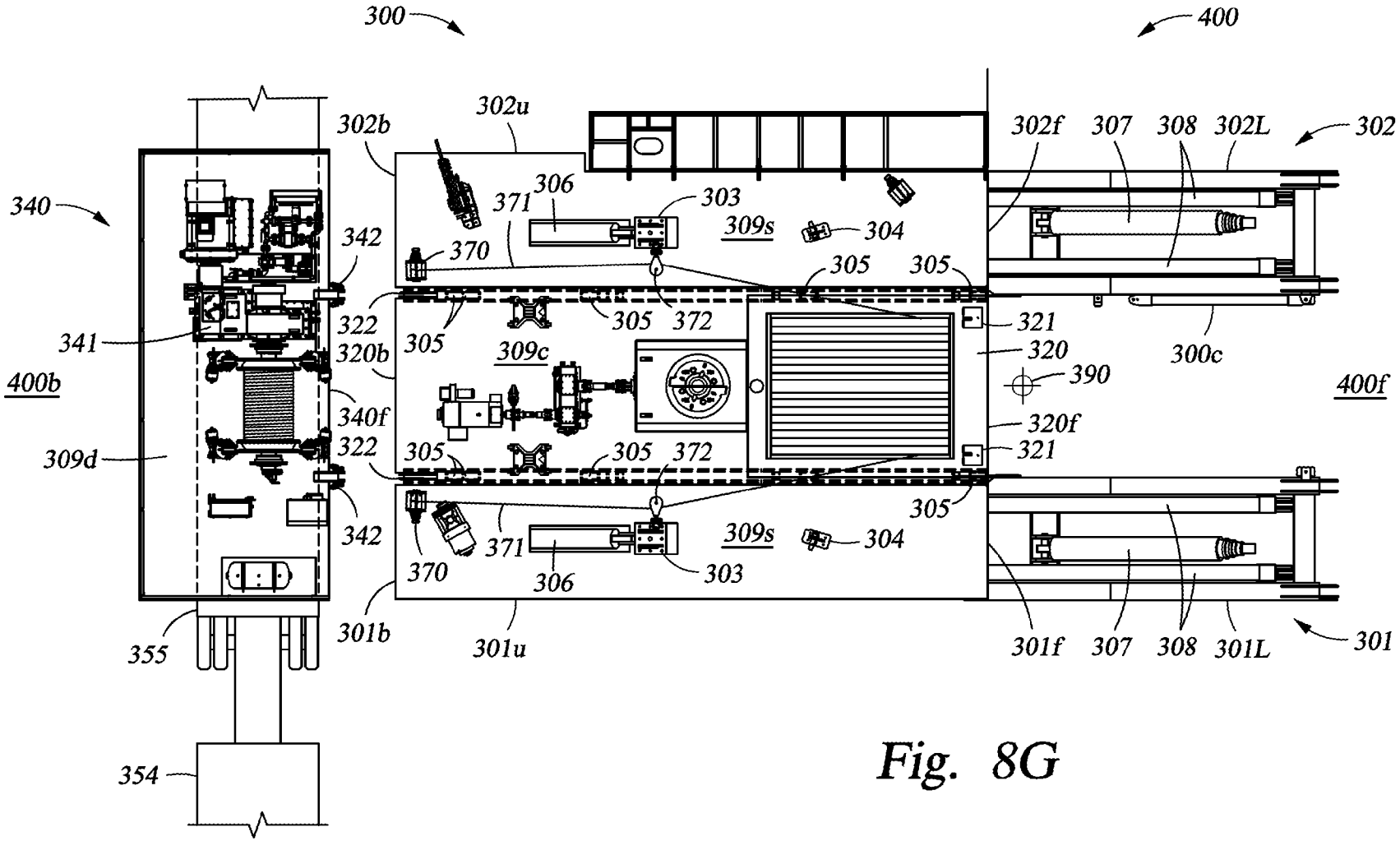
Figure 8H:
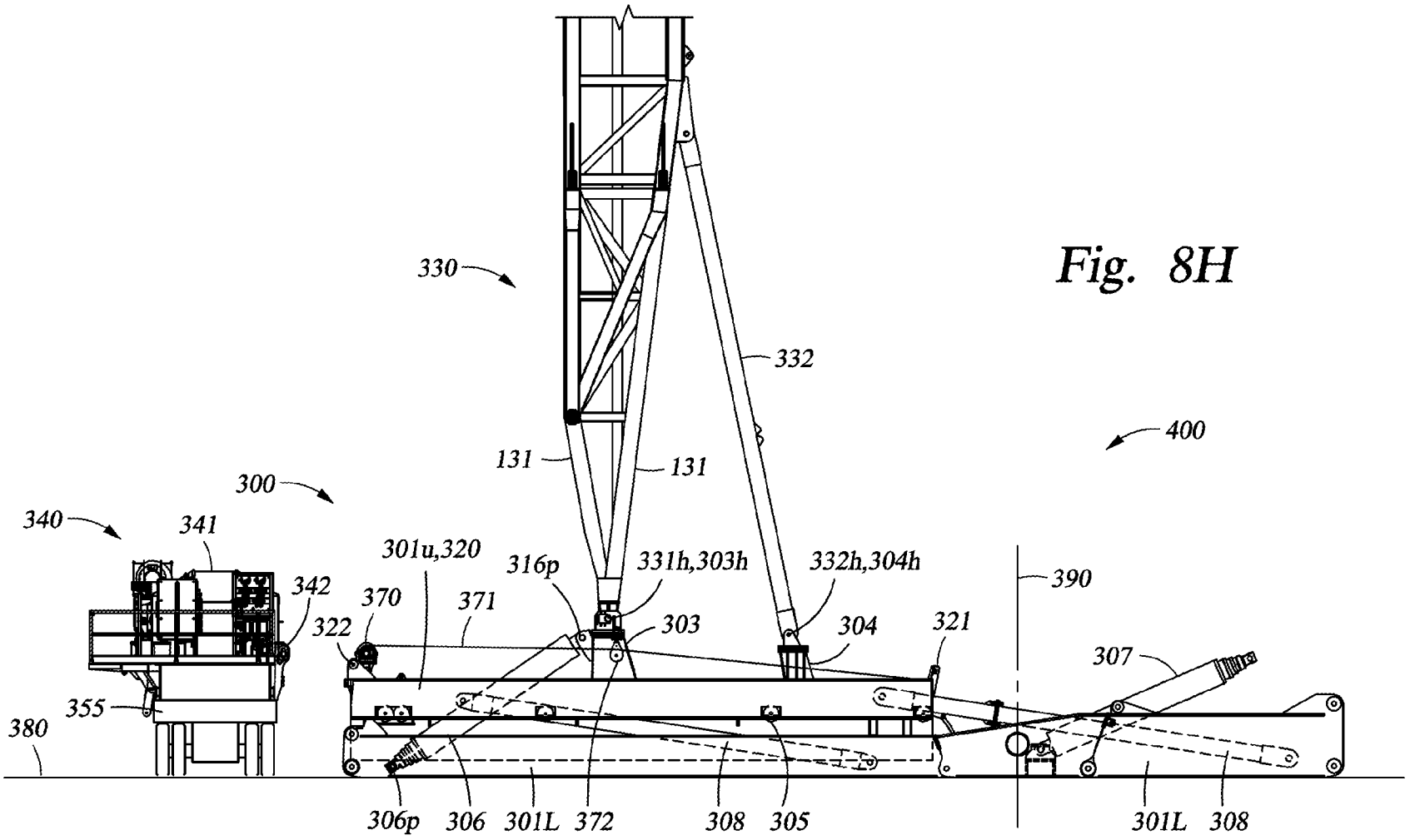

FIGS. 8G-8K are various illustrative views of the mobile drilling rig 400 shown in FIGS. 8E and 8F, depicting further stages of rig assembly during which a drawworks skid 340 may be removably attached to the movable center floor section 320 in a manner that is similar to that illustrated in FIGS. 3A-3C and described above. More specifically, FIGS. 8G and 8H are plan and elevation views, respectively, showing the drawworks skid 340 positioned at the back side 400*b* of the mobile drilling rig 400 such that a front end 340*f* of the drawworks skid 340 is adjacent to the back end 320*b* of the movable center floor section 320 and the back ends 301*b* and 302*b* of the upper boxes 301*u*, 302*u*, which may be accomplished by loading the drawworks skid 340 on a suitably sized trailer 355 and using a truck 354 to move the trailer 355 adjacent to the raisable substructure 300. In certain illustrative embodiments, the drawworks skid 340 may be positioned as shown in FIGS. 8G and 8H after at least the bottom mast section 330 (shown using hidden lines in FIGS. 8H and 8J, but not shown in FIGS. 8G, 8I and 8K, for clarity) has been attached to the raisable substructure 300 in the manner shown in FIGS. 8E and 8F and described above.

Figure 8I:
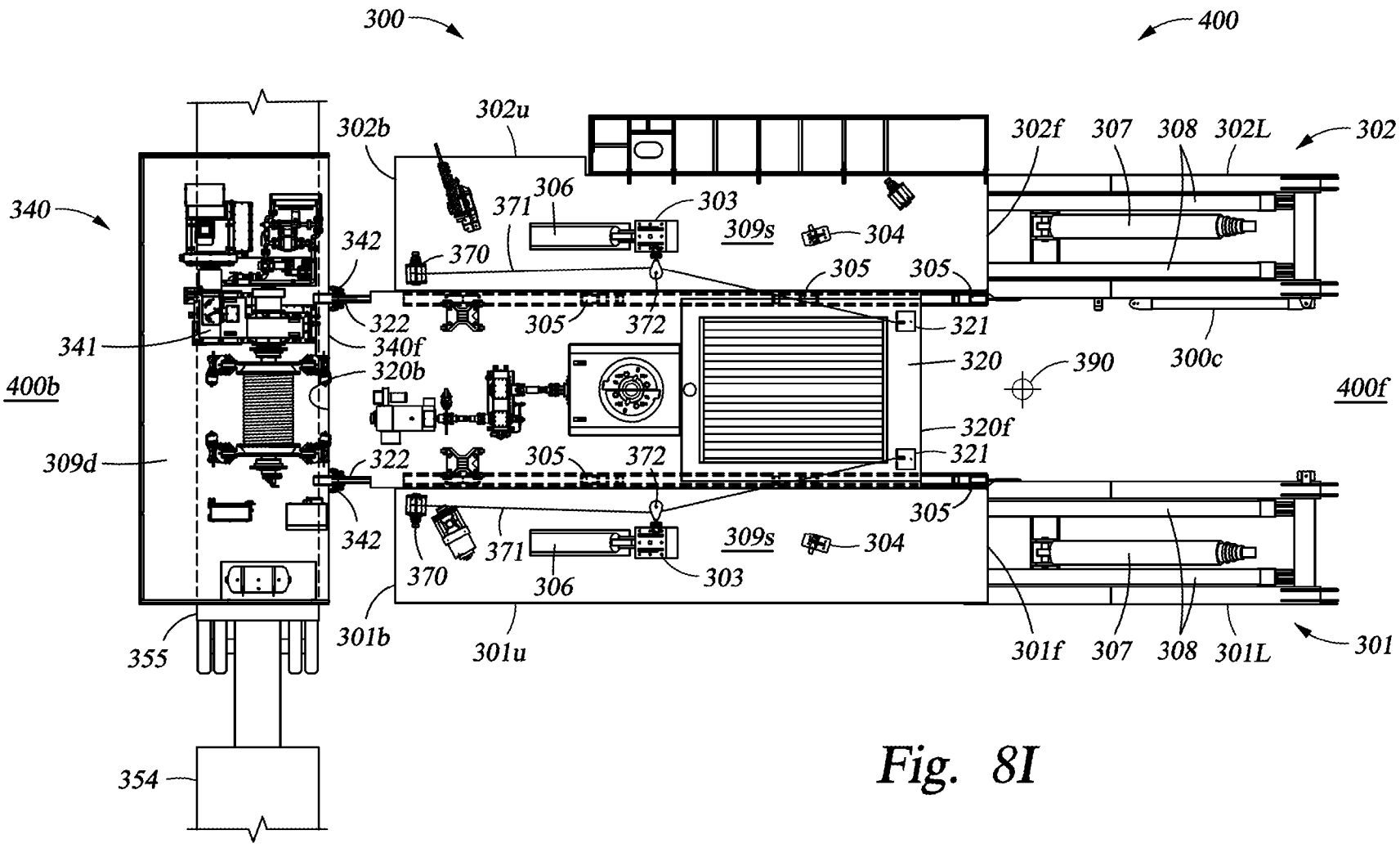
Figure 8J:
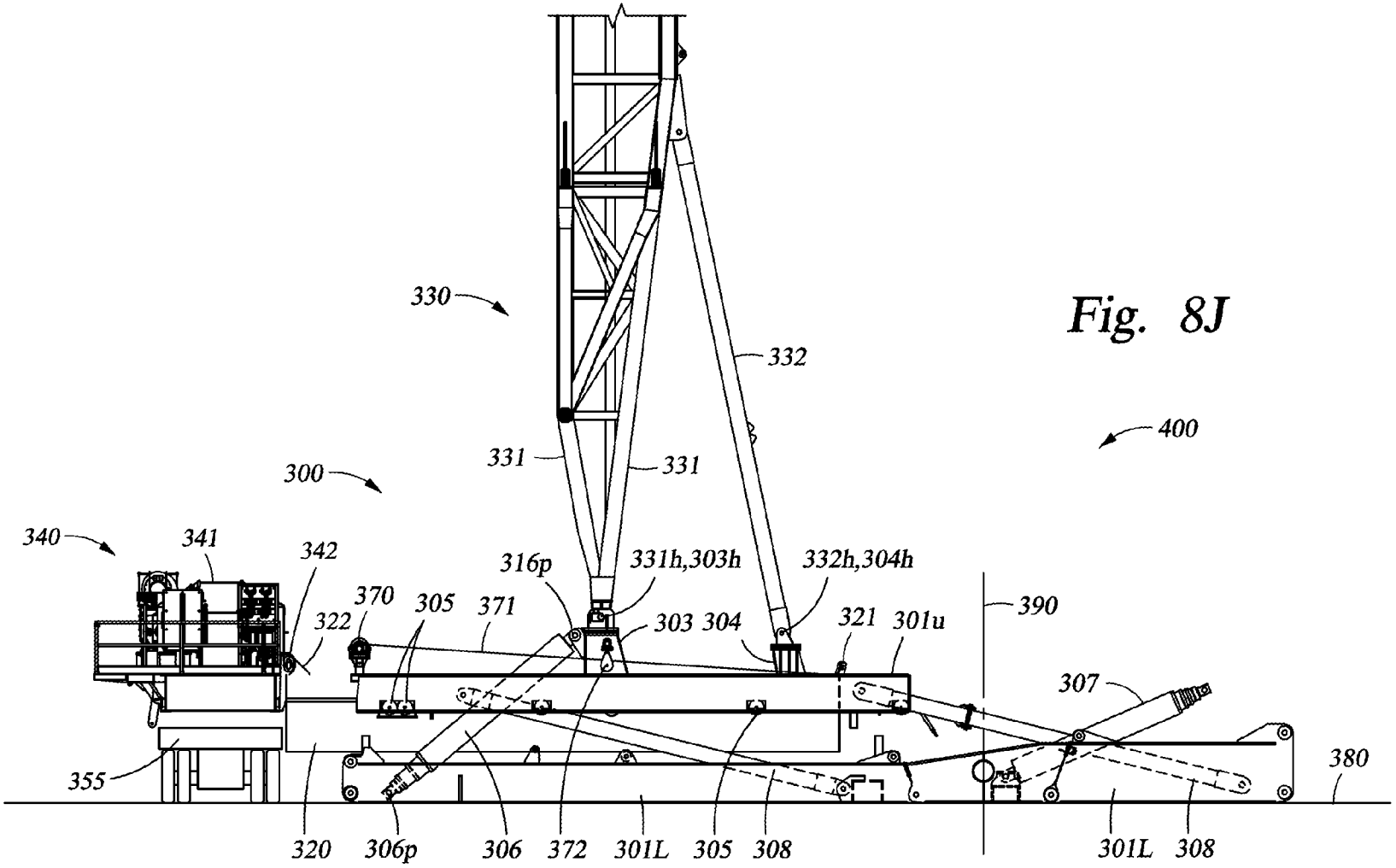

FIGS. 8I and 8J are plan and elevation views, respectively, of the mobile drilling rig 400 shown in FIGS. 8G and 8H after a further rig assembly step during which the drawworks skid 340 has been removably attached to the movable center floor section 320 in a manner substantially as previously described with respect to FIG. 3C above. In at least some embodiments, the floor moving means may be used, e.g., each winch 370 may be actuated to draw in a respective winch line 371, to slidably move the movable center floor section 320, e.g., over the roller wheel supports 305, to a drawworks installation position, such that the back end 320*b* of the movable center floor section 320 extends beyond the back ends 301*b*, 302*b* of the upper boxes 301*u*, 302*u*. Furthermore, as previously described with respect to FIG. 3C above, the drawworks support lugs 322 may positioned substantially below and aligned with the drawworks skid attachment lugs 342, after which the movable center floor section 320 may be raised using the powered raising apparatuses 306 until the drawworks support lugs 322 matingly and removably engage the drawworks skid attachment lugs 342.

Figure 8K:
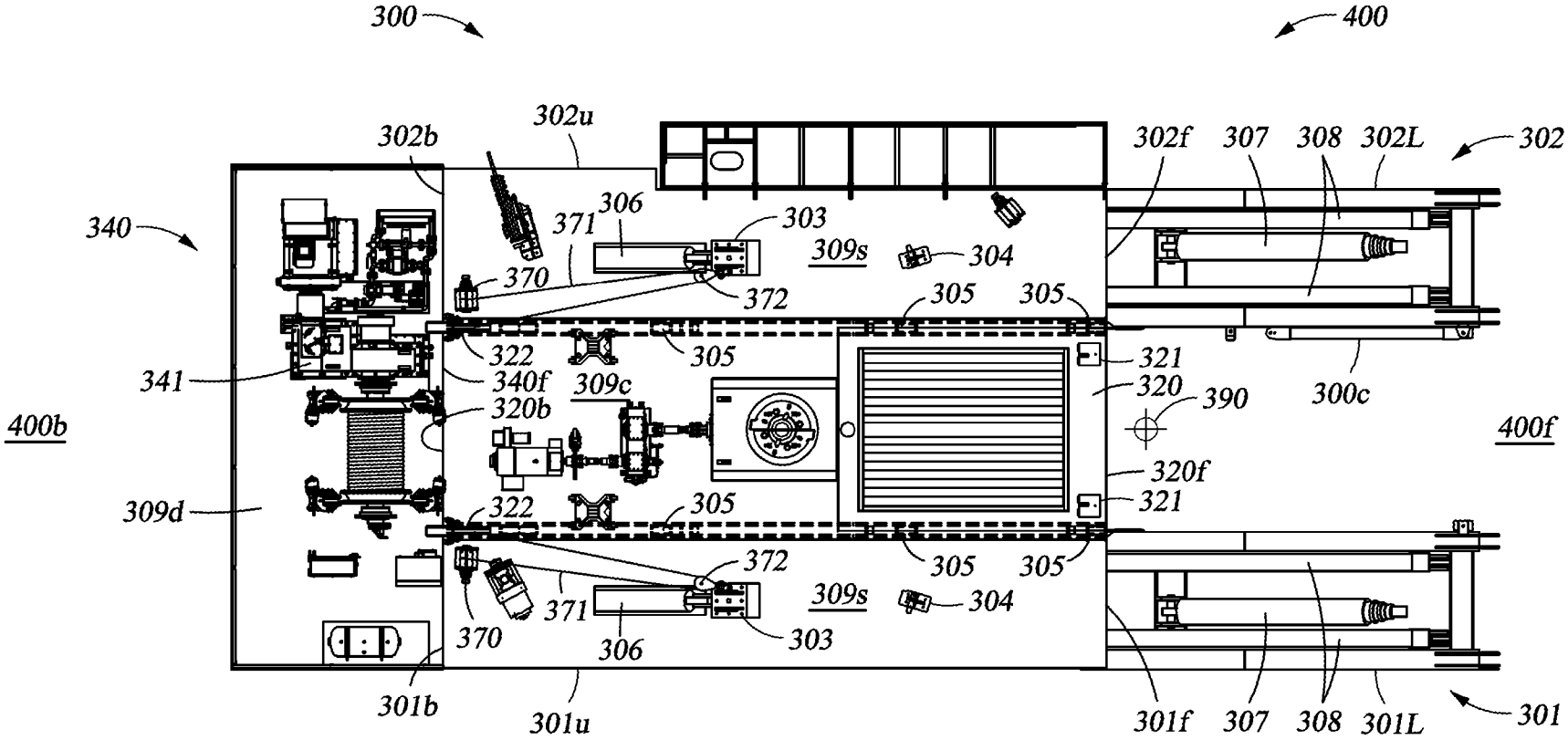

FIG. 8K is a plan view of the mobile drilling rig 400 shown in FIGS. 8I and 8J after the winches 370 have been used to slidably move the movable center floor section 320 over the roller wheel supports 305 toward the front side 400*f* of the mobile drilling rig 400, such that the front end 340*f* of the drawworks skid 340 is immediately adjacent to, e.g., substantially in contact with, the back ends 301*b* and 302*b* of the upper boxes 301*u* and 302*u*, respectively. In certain disclosed embodiments, the movable center floor section 320 may be moved by reconfiguring the floor moving means so as to facilitate movement the movable center floor section 320 in an opposite direction. For example, in those illustrative embodiments wherein the floor moving means includes the winches 370, reconfiguration may be accomplished by first detaching each winch line 371 from a respective mast positioning lug 321, and, with each winch line 371 still sheaved through a respective pulley 372, temporarily attaching the winch lines 371 to the drawworks support lugs 322. Thereafter, the winches 370 may be actuated so as to draw the respective winch lines 371 in and pull the movable center floor section 320 into position as previously described.

In the various exemplary embodiments set forth above, the drilling rig mast is generally illustrated and described as being assembled, installed, and raised from the front or setback side of the drilling rig substructure, i.e., opposite of the back or drawworks side of the drilling rig substructure. However, depending on the specific layout of a given oilfield drilling site, it may not always be advantageous to raise a drilling rig mast from the setback side of the rig. For example, depending on the proximity of a given wellbore location to other wellbore locations at the oilfield drilling site, and/or the presence of other rigs or support equipment adjacent to a specific wellbore location, it may be desirable, or even necessary, to assemble, install, and raise the drilling rig mast from the back or drawworks side of the rig substructure. In such situations, a different type of mast and/or mast raising system may be necessary in order to satisfy the preferred mast raising arrangement and/or any site-imposed raising requirements. Accordingly, it could be highly cost-effective and efficient to utilize a drilling rig mast that can be assembled from either side of a drilling rig substructure, and a mast raising system that is capable of being used to install and raise the mast from either the setback side or the drawworks side of the drilling rig substructure, depending on the preference and/or need for a specific given application. FIGS. 9A-12H illustrate some exemplary drilling rig mast configurations and mast raising systems that may be utilized to assemble, install, and raise a drilling rig mast from either side—i.e., the setback or drawworks side—of a drilling rig substructure.

FIGS. 9A-9D depict an illustrative mobile drilling rig 600 having a bi-directionally raisable drilling rig mast 530 in accordance with exemplary embodiments of the present disclosure. In some embodiments, the mobile drilling rig 600 may include, among other things, a raisable substructure 500 that may be any one of the raisable substructures previously described herein, e.g., raisable substructures 100 and 300 as described with respect to FIGS. 1A-7B and FIGS. 8A-8K above, respectively. The raisable substructure 500 may therefore include a first substructure box 101 that is made up of upper and lower boxes 101*u* and 101L, as well as a similarly configured second substructure box (not shown in FIGS. 9A-9D), such as the previously described second substructure boxes 102 and 302 illustrated in FIGS. 1A and 8A, respectively. Accordingly, since only the first substructure box 501 is illustrated in FIGS. 9A-9D, it should be understood that any reference made below to the substructure box 501 and the various components thereof may be equally applicable to the second similarly configured substructure box of the raisable substructure 500.

In certain illustrative embodiments, the mobile drilling rig 600 may include a movable center floor section 520 that may be installed on and slidably movable along the raisable substructure 500 on a plurality of roller wheel supports 505, e.g., any illustrative embodiments of the movable center floor sections 120, 320 and roller wheel supports 105, 305 previously described. As shown in the illustrative embodiment of FIG. 9A, the bi-directionally raisable drilling rig mast 530 may include rear support legs 531 that may be pivotably attached to a mast shoe 503 at a pinned connections 503*p*, which is positioned above a drilling floor 509 on the upper box 501*u* of the first substructure box 501, as well as to a mast shoe 503 on a similarly configured second substructure box (not shown). In certain embodiments, the bi-directionally raisable drilling rig mast 530 may be pivotably attached to the mast shoes 503 by positioning the bi-directionally raisable drilling rig mast 530 using the slidably movable center floor section 520, as previously described with respect to any of the illustrative embodiments disclosed herein.

Figure 9A:
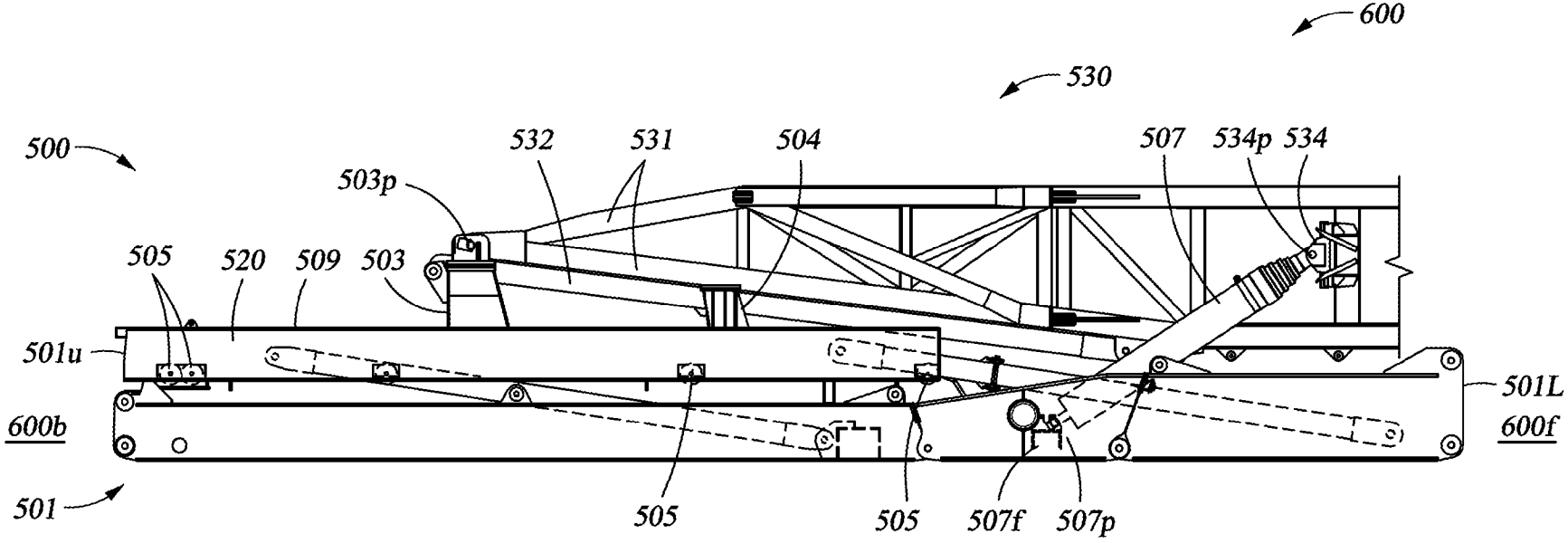
FIGS. 9A-9D are side elevation views of an illustrative mobile drilling rig of the present disclosure that includes a bi-directionally raisable drilling rig mast.

As shown in FIG. 9A, the bi-directionally raisable drilling rig mast 530 is in a nominally horizontal position, i.e., prior to mast erection, and is oriented toward the front, or setback, side 600*f* of the mobile drilling rig 600. Furthermore, the bi-directionally raisable drilling rig mast 530 may be supported by bi-directional mast raising means, such as, for example, respective mast erection apparatuses 507 positioned on either side of the mast 530, e.g., one on each of the first substructure box 501 and a second substructure box (not shown) of the raisable substructure 500, such as the previously described substructure boxes 101 and 102, or substructure boxes 301 and 302. In at least some embodiments, the mast erection apparatuses 507 may be pivotably attached at an upper end thereof to respective bi-directional mast erection connections 534 on the bi-directionally raisable drilling rig mast 530 using appropriately designed pinned connections 534*p*. It should be understood that the bi-directional mast erection connections 534 and associated pinned connections 534*p* are adapted to permit the mast erection apparatuses 507 to be attached to the bi-directionally raisable drilling rig mast 530 whether the mast 530 is oriented toward the setback, front side 600*f* of the mobile drilling rig 600 as shown in FIG. 9A, or toward the drawworks, or back side 600*b*.

For example, the bi-directional mast erection connections 534 and the associated pinned connections 534*p* may be configured and positioned relative to the various structural elements of the bi-directionally raisable drilling rig mast 530 so that the pivotably connected mast erection apparatuses 507 do not interfere with the structural elements of the mast 530, irrespective of the direction from which the mast erection apparatuses 507 are attached or the direction from which the mast 530 is raised. Furthermore, when the bi-directionally raisable drilling rig mast 530 is oriented toward the front side 600*f* (as shown in FIG. 9A), the mast erection apparatus 507 may be pivotably attached at a lower end thereof to the lower box 501L using respective pinned connections 507*p* on front erection connections 507*f* that are proximate the front side 600*f*. It should be appreciated that the mast erection apparatuses 507 may be any mast erection apparatus as previously set forth in the present disclosure.

Figure 9B:
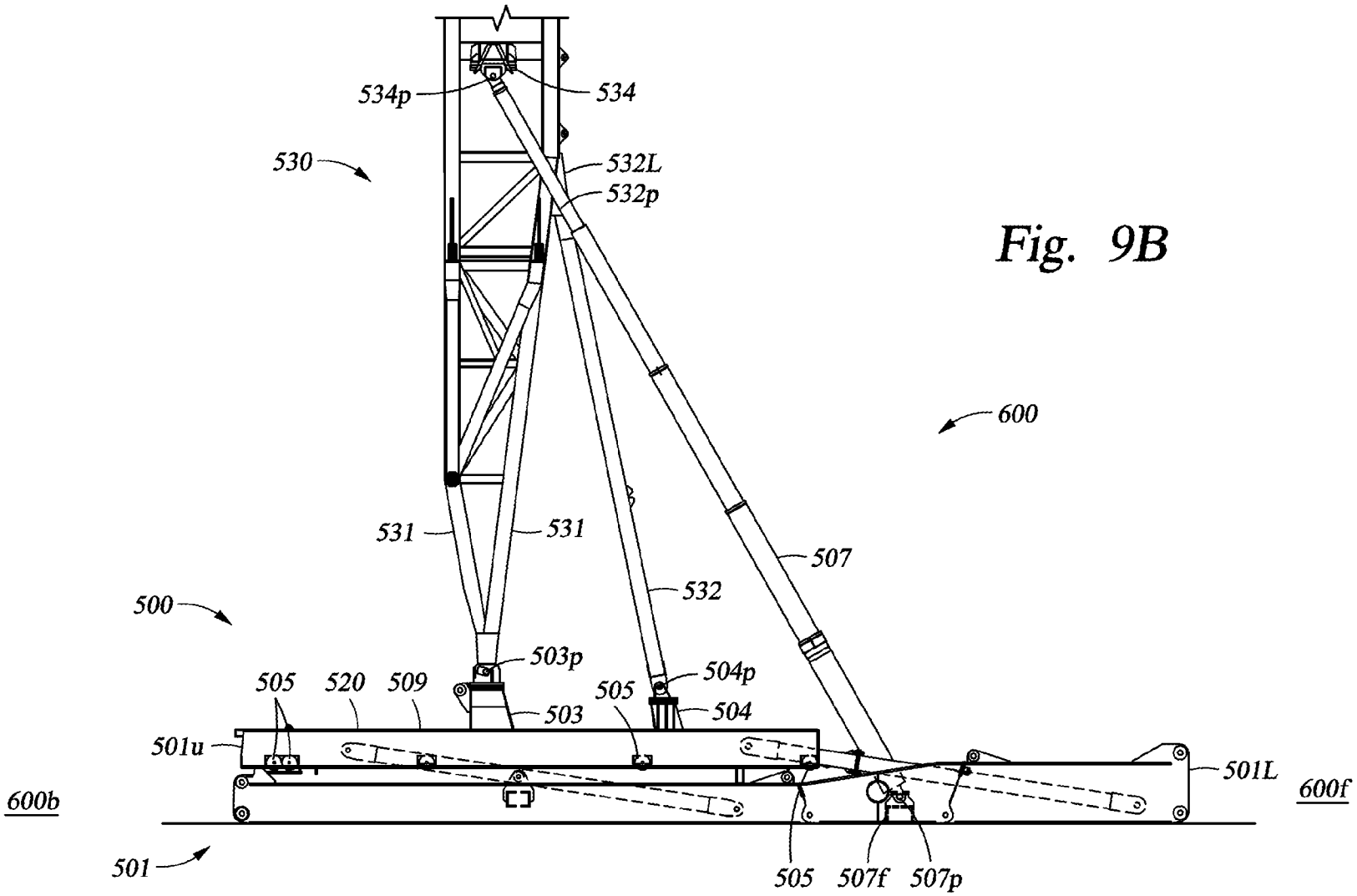

FIG. 9B shows the mobile drilling rig 600 of FIG. 9A after the bi-directionally raisable drilling rig mast 530 has been raised from the front side 600*f* of the rig 600 to an operating position, i.e., in preparation for performing drilling rig operations. As shown in the illustrative embodiment of FIG. 9B, the bi-directionally raisable drilling rig mast 530 may be raised to a substantially vertical orientation by actuating the bi-directional mast raising means, e.g., mast erection apparatuses 507, so as to pivotably rotate the mast 530 about the pinned connections 503*p* of the mast shoes 503. The front leg braces 532 may then be pivotably rotated about pinned connections 532*p* on front leg lugs 532L and removably attached to the front leg support shoes 504 at pinned connections 504*p*. Thereafter, the upper end of the each respective mast erection apparatus 507 may be detached the pinned connection 534*p* on from a corresponding bi-directional mast erection connection 534 and lowered to a staging position (not shown) during rig operations. Thereafter, further rig assembly stages may continue, such as, for example, removably attaching a drawworks skid (not shown) to the movable center floor section 520 in a manner previously described, and the like.

Figure 9C:
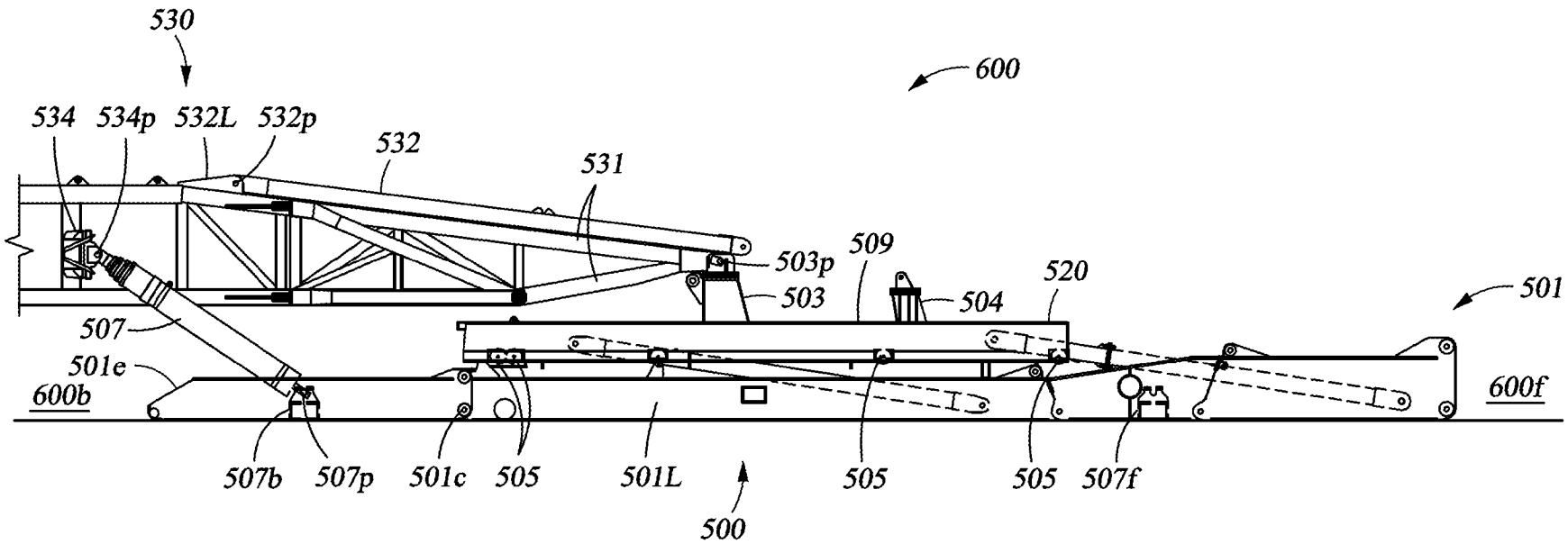
Figure 9D:
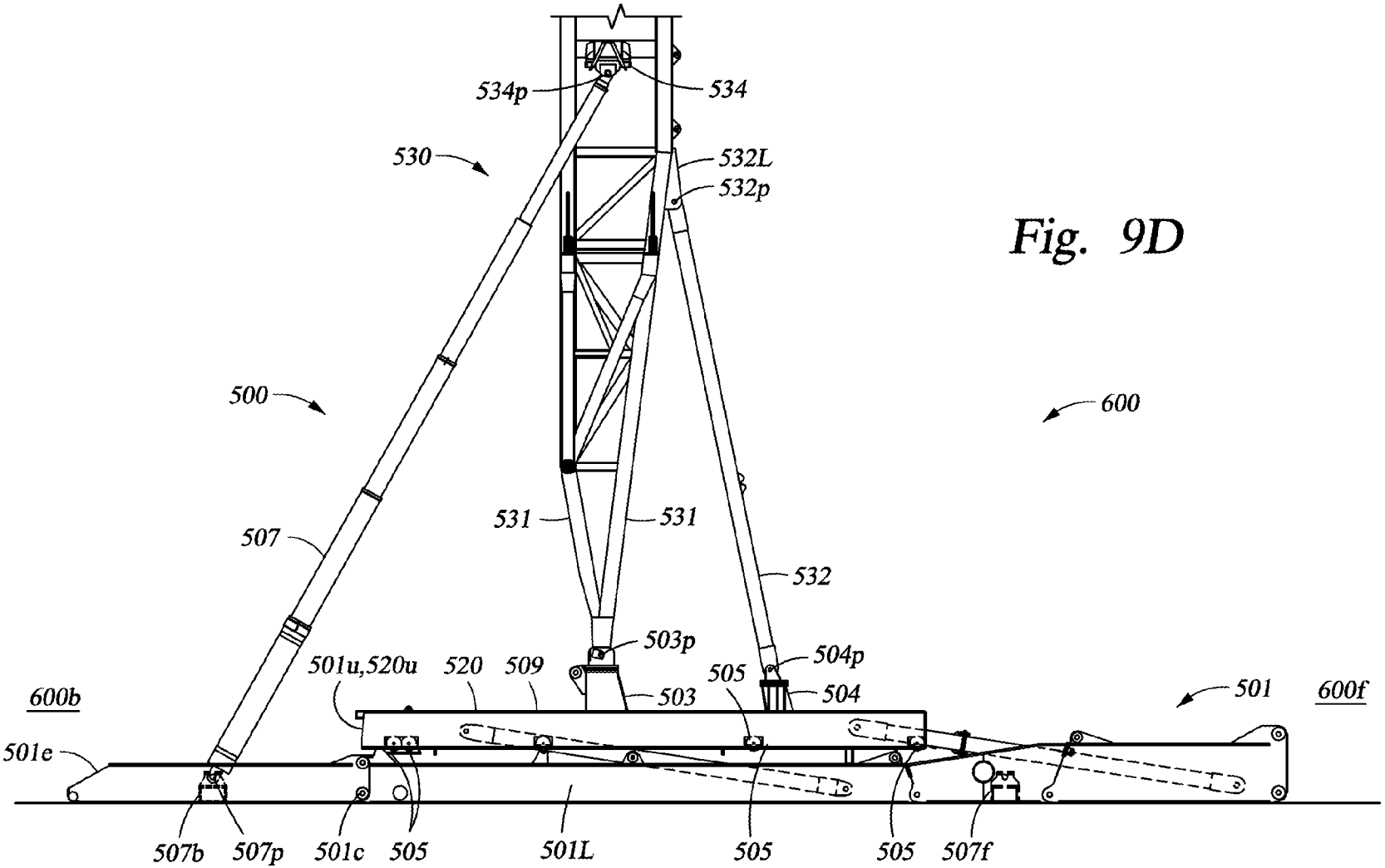

FIGS. 9C and 9D depict another illustrative embodiment of the mobile drilling rig 600 wherein a bi-directionally raisable drilling rig mast 530 may be raised from the back, or drawworks, side 600*b* of the mobile drilling rig 600. As shown in FIG. 9C, the bi-directionally raisable drilling rig mast 530 is pivotably attached to the mast shoes 503 on the raisable substructure 500 substantially as is described with respect to FIG. 9A above, such that the mast 530 is in a nominally horizontal position, i.e., prior to mast erection. However, as shown in the illustrative embodiment of FIG. 9C, the bi-directionally raisable drilling rig mast 530 may be oriented in the opposite direction of the embodiment shown in FIG. 9A, that is, toward the back side 600*b* of the mobile drilling rig 600. Furthermore, a lower box extension skid 501*e* may be securably attached to the lower box 501L at the back side 600*b* of the mobile drilling rig 600 by way of a suitably designed skid connection 501*c*. Additionally, a corresponding extension skid (not shown) may also be attached in a similar fashion to a similarly configured second substructure box (not shown).

As with the embodiment shown in FIG. 9A, i.e., wherein the bi-directionally raisable drilling rig mast 530 is raised from the front side 600*f*, the bi-directional mast raising means e.g., the mast erection apparatuses 507, may be configured so that it can also be used to raise the mast 530 from the back side 600*b* of the mobile drilling rig 600. For example, the mast erection apparatuses 507 may similarly be pivotably attached at an upper end thereof to respective bi-directional mast erection connections 534 on the mast 530 at associated pinned connections 534*p*. However, since the bi-directionally raisable mast 530 is now oriented in a substantially opposite direction for mast erection from the back side 600*b* of the mobile drilling rig 600, rather than attaching the mast erection apparatuses 507 to the pinned connection 507*p* at the front erection connections 507*f* on the lower box 501L (see, FIGS. 9A and 9B), the mast erection apparatuses 507 are pivotably attached at a lower end thereof to the back erection connections 507*b* proximate the back side 600*b* on the lower box extension skid 501*e* at a corresponding pinned connection 507*p*.

FIG. 9D shows the mobile drilling rig 600 of FIG. 9A after the bi-directionally raisable drilling rig mast 530 has been raised from the back side 600*b* of the rig 600 to an operating position. As shown in FIG. 9D, the bi-directionally raisable drilling rig mast 530 may be raised to a substantially vertical orientation by actuating bi-directional mast raising means, e.g., the mast erection apparatuses 507, so as to pivotably rotate the mast 530 about the pinned connections 503*p*. As with the illustrative embodiment of FIGS. 9A and 9B, the front leg braces 532 may then be removably attached to the front leg support shoes 504 as previously described, and the upper end of the each respective mast erection apparatus 507 may be detached from the pinned connection 534*p* on a corresponding bi-directional mast erection connection 534. Thereafter, the lower box extension skid 501*e* (as well as a corresponding extension skid on the second substructure box) may be detached from the connections 501*c* in preparation for further rig assembly stages, such as removably attaching a drawworks skid (not shown) to the movable center floor section 520, and the like.

In various embodiments of the mobile drilling rig 600 disclosed herein, after completion of drilling operations, the bi-directionally raisable drilling rig mast 530 may be lowered to a nominally horizontal position during rig disassembly by, among other things, pivotably attaching the mast erection apparatuses 507 to the bi-directional mast erection connections 534, detaching the front leg braces 532 from the front leg support shoes 504, and thereafter actuating the mast erection apparatuses to lower the mast 530. Additionally, as may be appreciated by a person of ordinary skill having full benefit of the presently disclosed subject matter, the bi-directionally raisable drilling rig mast 530 may be lowered in either direction, i.e., toward either the front side 600*f* or the back side 600*b* of the mobile drilling rig 600. Furthermore, and depending on the overall rig assembly and disassembly strategy, the bi-directionally raisable drilling rig mast 530 may be both raised and lowered from the same side of the mobile drilling rig 600, or the mast 530 may be raised from one side of the rig 600 and lowered to the opposite side of the rig 600. For example, in certain illustrative embodiments, the bi-directionally raisable drilling rig mast 530 may be raised from the front side 600*f* of the mobile drilling rig 600 and lowered to the back side 600*b*, whereas in other embodiments, the mast 530 may be raised from back side 600*b* and lowered to the front side 600*f*. In still other embodiments, the bi-directionally raisable drilling rig mast 530 may be both raised and lowered from the front side 600*f*, or the mast 530 may be both raised and lowered from the back side 600*b*.

FIGS. 10A-10J depict illustrative embodiments wherein the various mast sections of a bi-directionally raisable drilling rig mast 760 of the present disclosure may be assembled prior to mast erection. More specifically, FIGS. 10A-10E show some exemplary steps that may be used to assemble an illustrative bi-directionally raisable drilling rig mast 760 of a mobile drilling rig 800 from the setback side, or back side 800*f*, of the rig 800, whereas FIGS. 10F-10J depict similarly illustrative steps that may be used to assemble a bi-directionally raisable drilling rig mast 760 from the drawworks side, or back side 800*b*, of the rig 800.

Figure 10A:
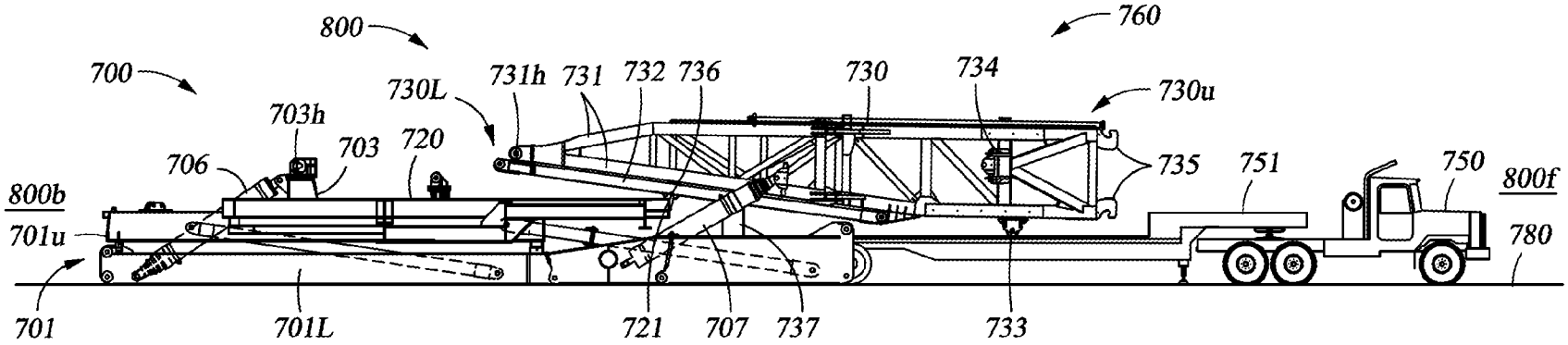
FIGS. 10A-10E are side elevation views showing various steps of assembling a plurality of mast sections of an illustrative bi-directionally raisable drilling rig mast from the setback side of a mobile drilling rig of the present disclosure.

FIG. 10A shows a preliminary assembly stage of the mobile drilling rig 800, wherein a truck 750 may be used to move a trailer 751 supporting a bottom mast section 730 of the bi-directionally raisable drilling rig mast 760 across the ground 780 and adjacent to a raisable substructure 700 in a similar fashion as was previously described with respect to FIGS. 2A and 2B above. The raisable substructure 700 may be any one of the raisable substructures previously described herein, e.g., raisable substructures 100 and 300 as described with respect to FIGS. 1A-7B and FIGS. 8A-8K above, respectively, and as such may therefore include a first substructure box 701 that is made up of upper and lower boxes 701*u* and 701L, as well as a similarly configured second substructure box (not shown in FIGS. 10A-10J), such as the previously described second substructure boxes 102 and 302 illustrated in FIGS. 1A and 8A, respectively. Accordingly, since only the first substructure box 701 is illustrated in FIGS. 10A-10J, it should be understood that any reference made below to the substructure box 701 and the various components thereof may be equally applicable to the second similarly configured substructure box of the raisable substructure 700.

In certain illustrative embodiments, the bottom mast section 730 of the bi-directionally raisable drilling rig mast 760 may be pivotably attached to the raisable substructure 700 in any manner previously described with respect to any of the illustrative embodiments disclosed herein. For example, the trailer 751 may be moved into an open space between the substructure boxes of the raisable substructure 700, such as the open space 100*s* shown in FIG. 1A and described above. Next, a movable center floor section 720 positioned on the upper box 701*u* of the raisable substructure 700 (and a corresponding upper box on a second substructure box, not shown), such as any movable center floor section described herein, may be slidably moved toward the front side 800*b* of the mobile drilling rig 800 so that mast positioning lugs 721 on the movable center floor section 720 are positioned substantially below center floor engagement lugs 736 on the front legs 732 of the bottom mast section 730. Thereafter, substructure raising means, e.g., powered raising apparatuses 706 such as any of the powered raising apparatuses of the present disclosure, may be used to raise the upper boxes of the raisable substructure 700 relative to respective lower boxes with the movable center floor section 720 positioned thereon until the mast positioning lugs 721 engage respective center floor engagement lugs 736. See, e.g., FIG. 2C, described above. In some embodiments, actuation of the powered raising apparatuses 706 may then be continued so that the lower end 730L of the bottom mast section 730 is raised off of the temporary mast supports 737 on the trailer 751.

Figure 10B:
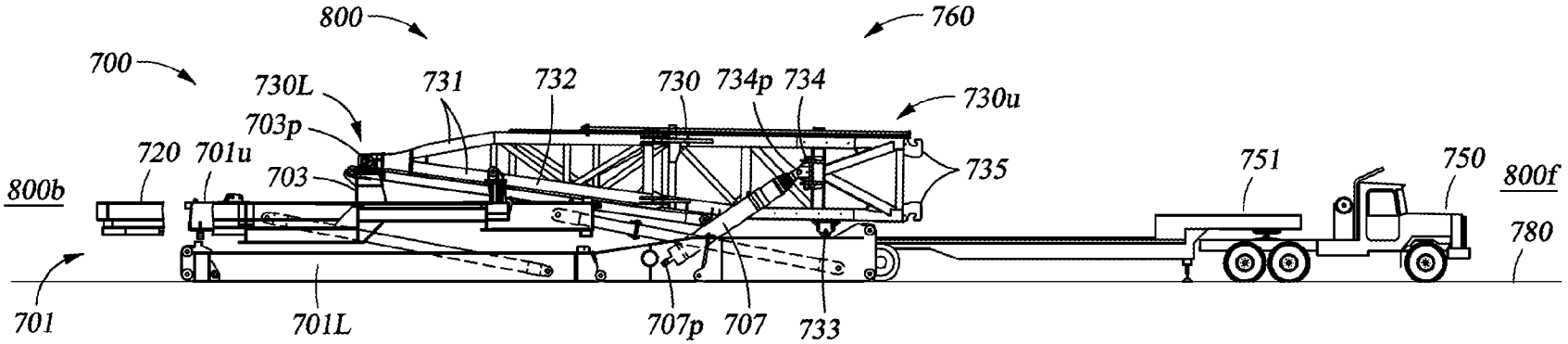

FIG. 10B illustrates a subsequent rig assembly step, wherein the movable center floor section 720 may be slidably moved so as to position the lower end 730L of the bottom mast section 730 above the raisable substructure 700 in preparation for pivotably attaching the bottom mast section 730 to the mast support shoes 703. One or more suitably sized dollies or rollers 733 may be positioned near an upper end 730*u* of the bottom mast section 730 to facilitate a rolling movement of the bottom mast section 730 across the trailer 751. In certain illustrative embodiments, the rear support legs 731 of the bottom mast section 730 may include pin holes 731*h* near the lower end 730L, and the mast support shoes 703 may include corresponding pin holes 703*h*. See, FIG. 10A. As shown in FIG. 10, the lower end 730L of the bottom mast section 730 may be positioned so that the pin hole 731*h* on the rear support legs 731 are substantially aligned with the pin holes 703*h* on the mast support shoes 703, after which a suitably sized pin (not shown) may be used to pivotably attach the bottom mast section 730 to the raisable substructure 700, thereby forming the pinned connection 703*p*.

In at least some embodiments, the mobile drilling rig 800 may include bi-directional mast raising means, such as, for example, mast erection apparatuses 707, which may be any mast erection apparatus described herein. The mast erection apparatuses 707 may each be pivotably attached to the raisable substructure 700 using suitably designed pinned connections, such as the pinned connection 707*p* on the lower box 701L shown in FIG. 10B. Once the bottom mast section 730 has been pivotably attached to the mast support shoes 703 as described above, the mast erection apparatuses 707 may then be pivotably attached to suitably sized mast erection lugs 734 on the bottom mast section 730 by way of appropriately designed pinned connections 734*p*. Thereafter, the bi-directional mast raising means, e.g., the mast erection apparatuses 707, may be used to raise the upper end 730*u* of the bottom mast section 730 so that the rollers 733 are raised off of the trailer 751 and therefore no longer support the bottom mast section 730. The truck 750 and trailer 751 may then be moved away from the front side 800*f* of the mobile drilling rig 800 in preparation for further assembly steps of the bi-directionally raisable drilling rig mast 760.

Figure 10C:
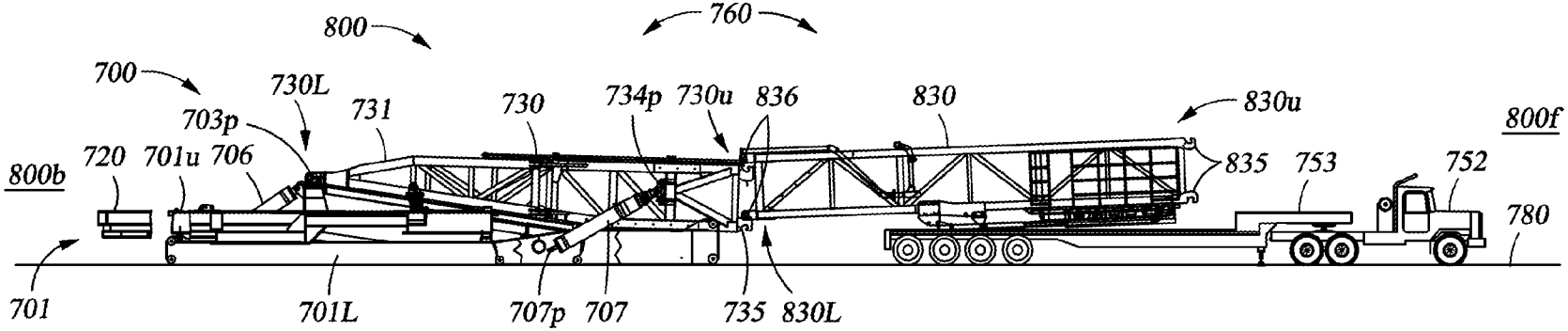

FIG. 10C shows a further mast assembly step, wherein a second mast section, i.e., an intermediate mast section 830, of the bi-directionally raisable drilling rig mast 760 has been positioned adjacent to the bottom mast section 730, which, as previously described with respect to FIGS. 10A and 10B, has already been pivotably attached to the raisable substructure 700. As shown in FIG. 10C, the intermediate mast section 830 may be supported on a trailer 753, which may be positioned using a truck 752 so that the lower end 830L of the intermediate mast section 830 is adjacent to the upper end 730*u* of the bottom mast section 730. Furthermore, the intermediate mast section 830 may be positioned such that the bi-directional hook engagement connections 836 at the lower end 830L of the intermediate mast section are aligned with and positioned substantially above corresponding bi-directional hook connections 735 located at the upper end 730*u* of the bottom mast section 730. Additional disclosure regarding the configurations and relative positioning of the above-noted bi-directional hook and hook engagement connections will be described in further detail with respect to FIGS. 11A-11N, FIG. 11P, and FIGS. 12A-12H below.

In certain illustrative embodiments, the bi-directional mast raising means, e.g., the mast erection apparatuses 707, may be used to lower the upper end 730*u* of the bottom mast section 730 so that the bi-directional hook connections 735 are properly positioned substantially below the bi-directional hook engagement connections 836. Implementation of this step, however, may depend on the position and orientation of the intermediate mast section 830 on the trailer 753 relative to the upper end 730*u* of the bottom mast section 730. Once the bi-directional hook and hook engagement connections 736 and 836 have been appropriately aligned and positioned (see, e.g., FIGS. 11A-11N and FIG. 11P below), the mast erection apparatuses 707 may be actuated so as to pivotably rotate the lower mast section 730 about the pinned connection 703*p*, thereby raising the upper end 730*u* of the bottom mast section 730 relative to the lower end 830L of the intermediate mast section 830. Furthermore, the upper end 730*u* of the bottom mast section 730 may be raised until the bi-directional hook connections 735 hookingly engage the bi-directional hook engagement connections 836, after which the intermediate mast section 830 may be removably secured to the bottom mast section 730 in a suitable manner.

Figure 11B:
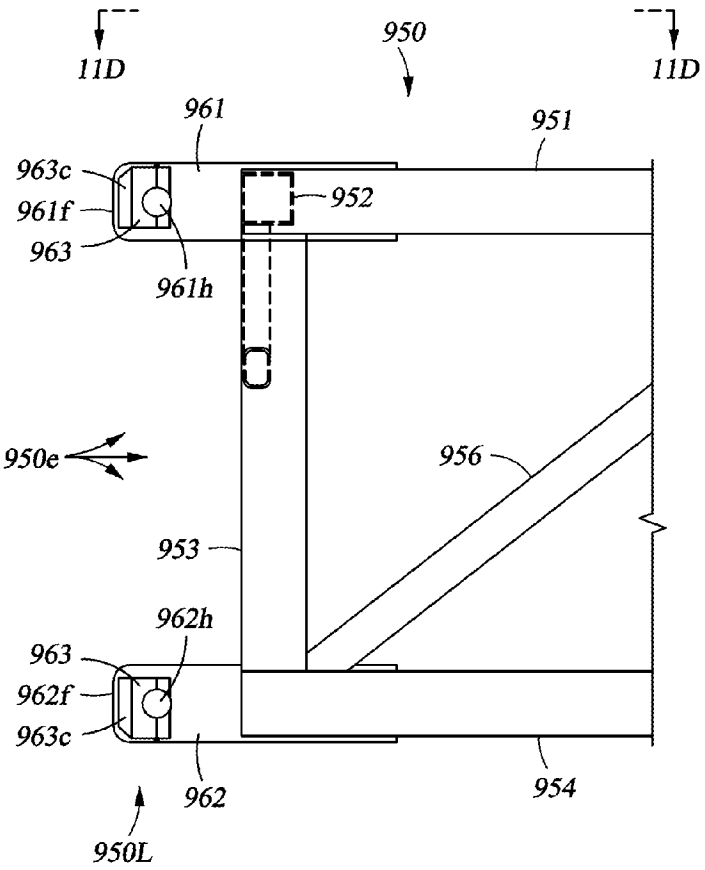
FIGS. 11A and 11B are side elevation views of an upper end of a first mast section and a lower end of an adjacent second mast section, respectively, of one embodiment of bi-directionally raisable drilling rig mast disclosed herein, showing an illustrative bi-directional mast connection system.
Figure 11A:
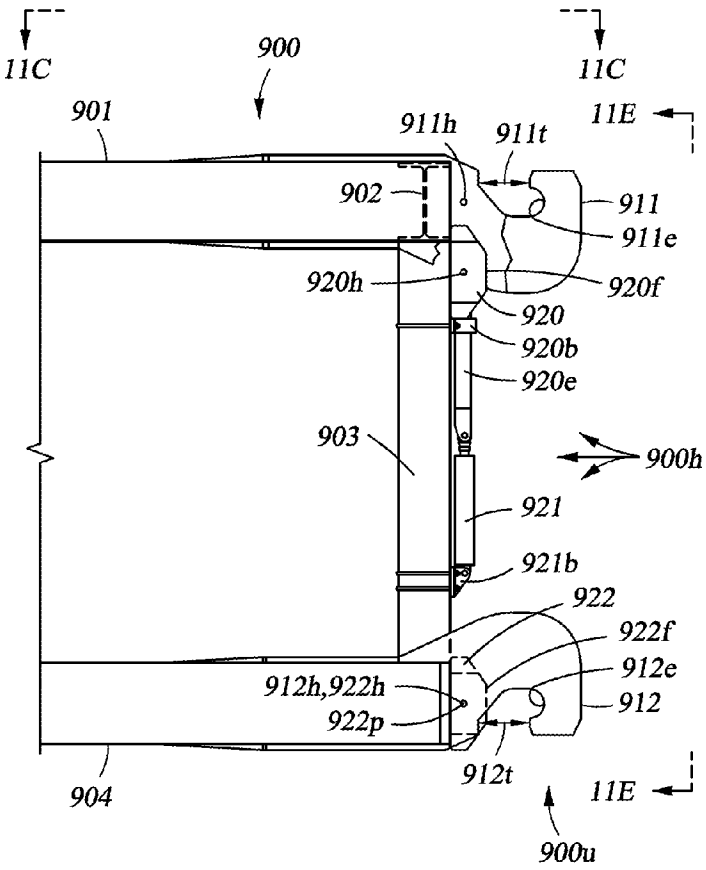
Figure 11D:
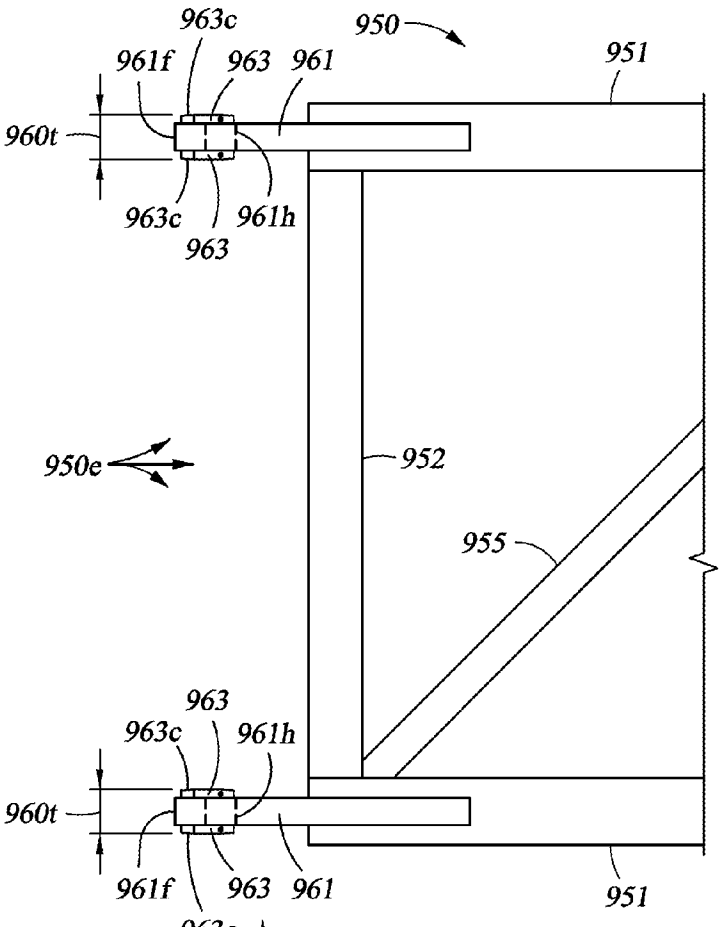
FIGS. 11C and 11D are plan views of the upper end of the first mast section and the lower end of the adjacent second mast section, respectively, showing the bi-directional mast connection system of FIGS. 11A and 11B, respectively.
Figure 11C:
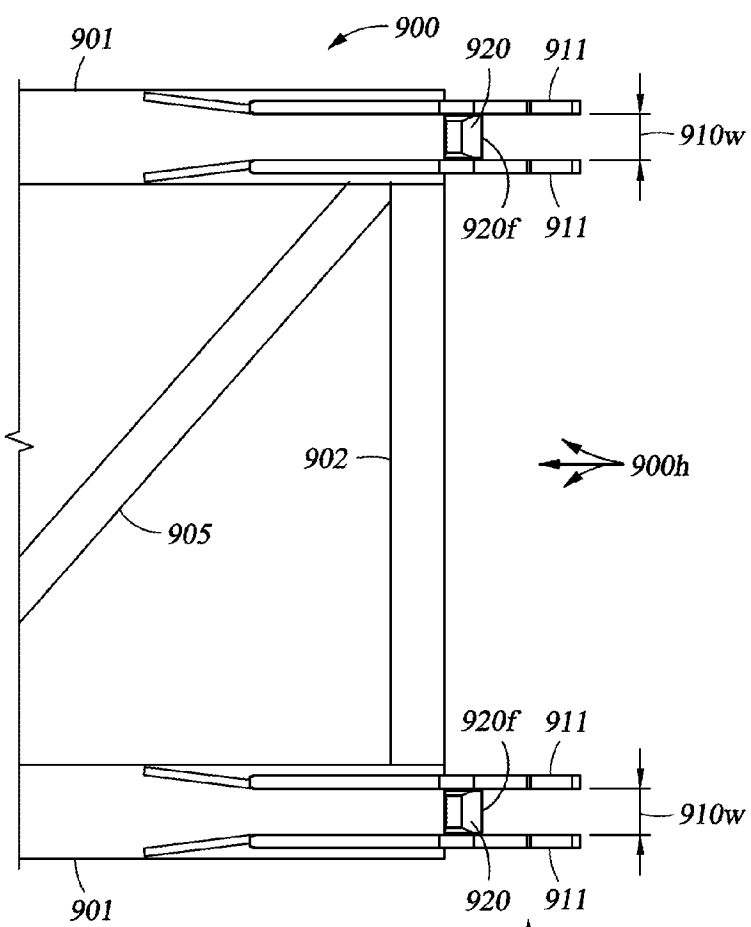
Figure 11F:
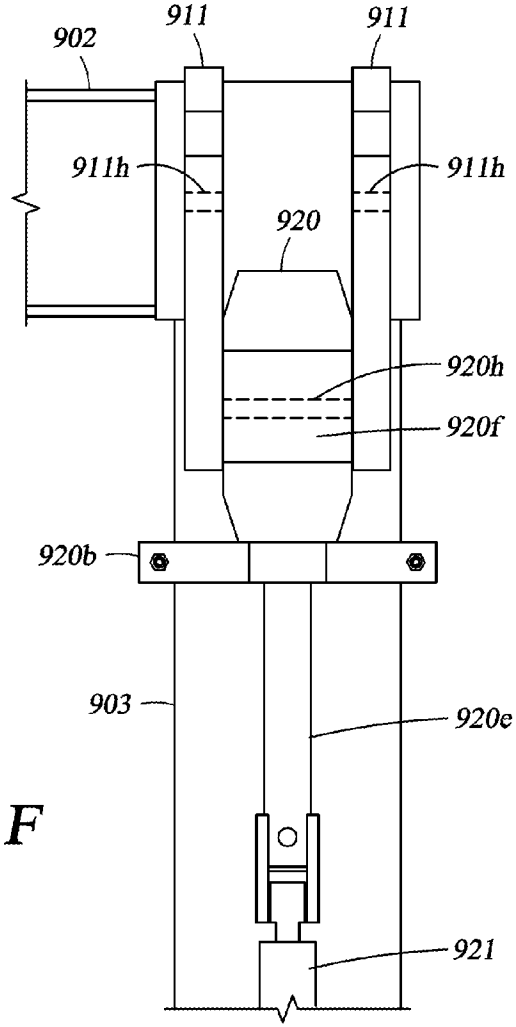
FIGS. 11E and 11F are various end views of the first mast section illustrated in FIGS. 11A and 11C when oriented for mast assembly and erection from the setback side of an illustrative mobile drilling rig of the present disclosure.
Figure 11E:
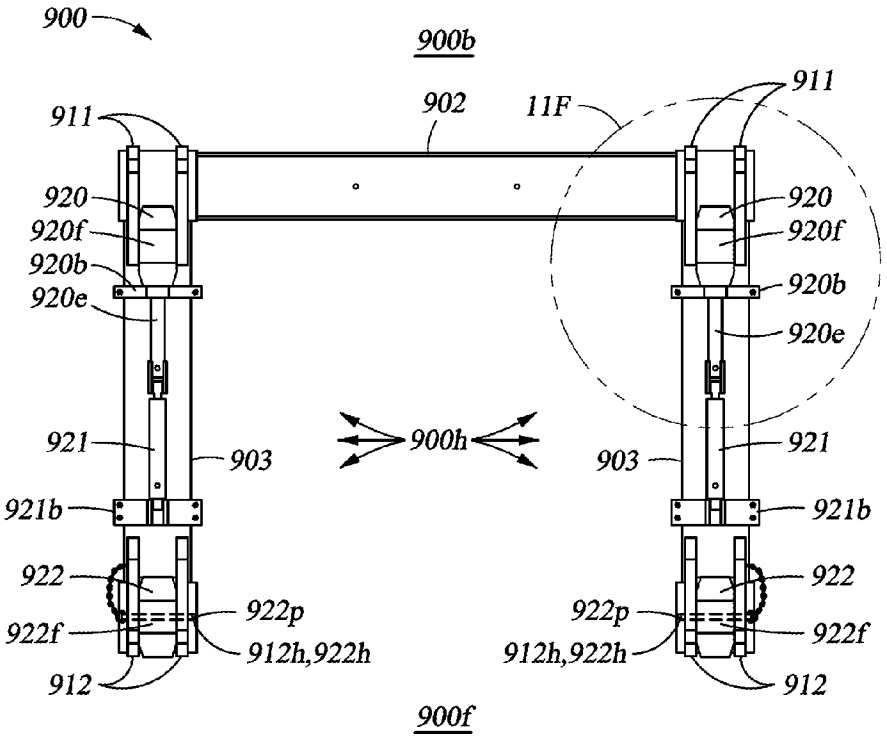
Figure 11G:
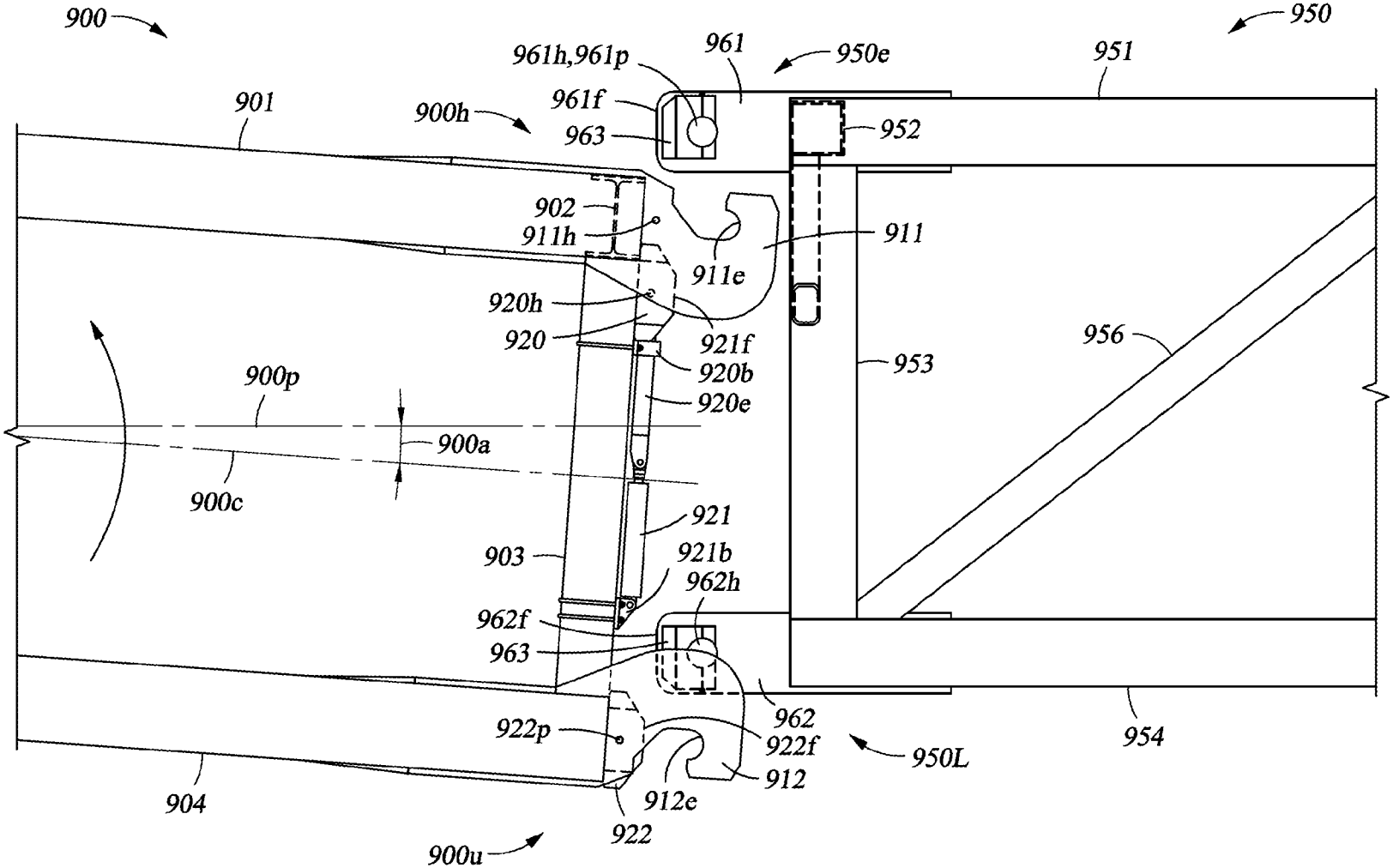
FIGS. 11G and 11H illustrate the assembly of the upper end of the first mast section to the lower end of the adjacent second mast section of the illustrative bi-directionally raisable drilling rig mast using the bi-directional mast connection system of FIGS. 11A-11F when assembled from the setback side of an illustrative mobile drilling rig disclosed herein.
Figure 11H:
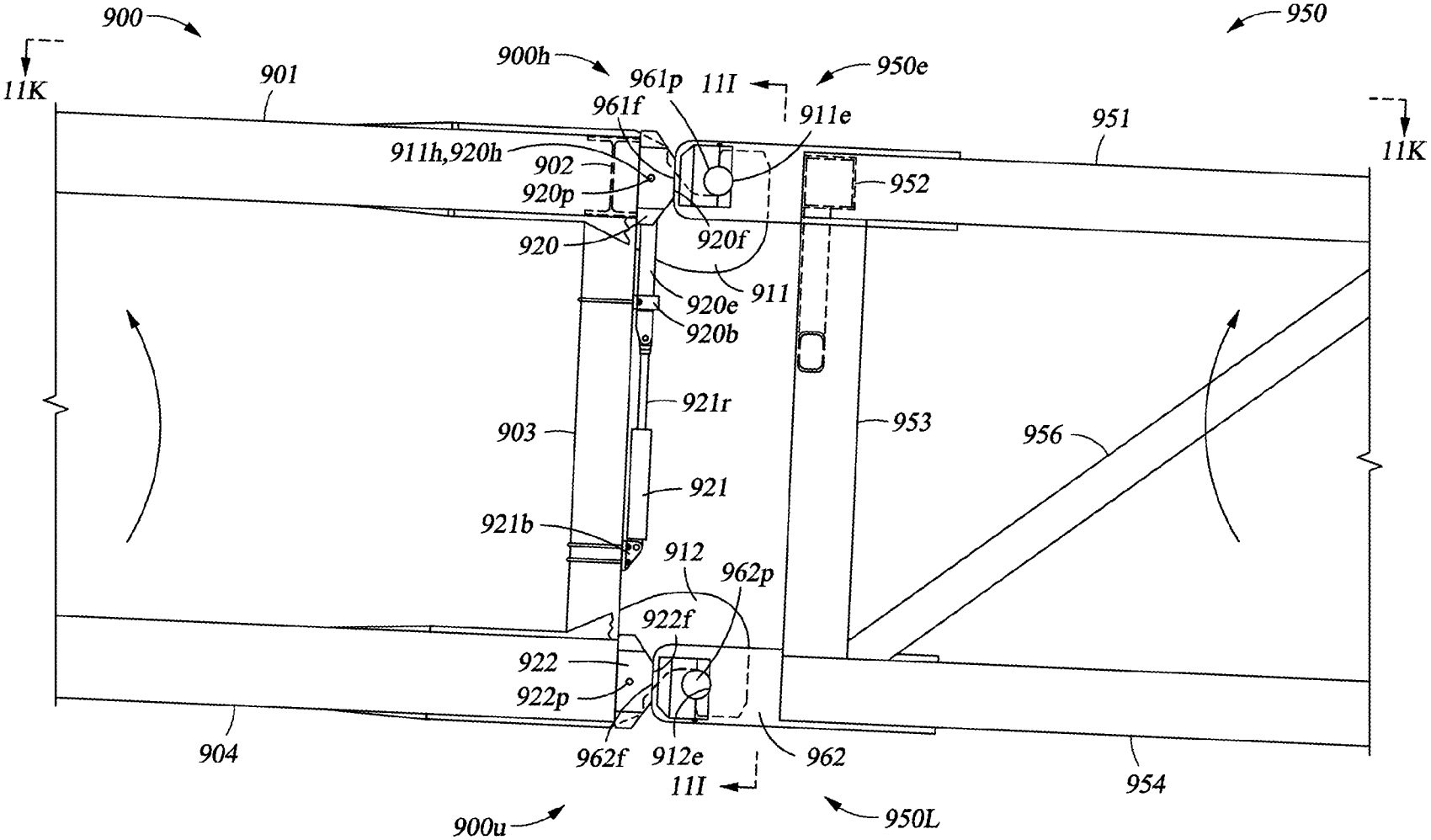
Figure 11J:
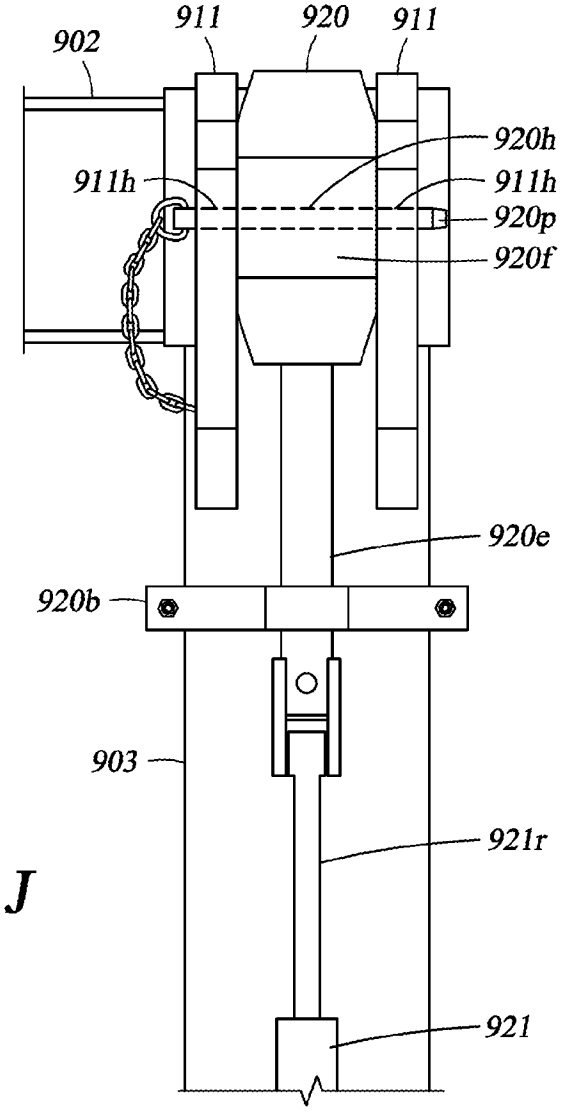
FIGS. 11I and 11J illustrate the first mast section end views of FIGS. 11E and 11F, respectively, after assembly of the bi-directionally raisable drilling rig mast using the bi-directional mast connection system as shown in FIGS. 11G and 11H, and after the installation of upper connection spacers.
Figure 11I:
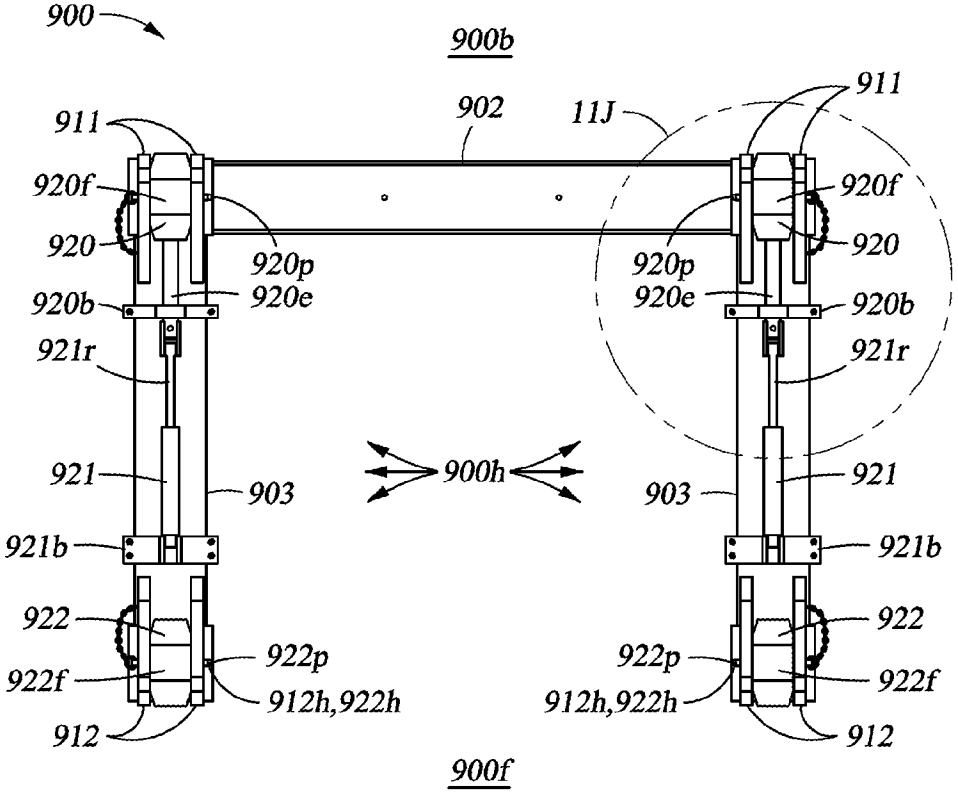
Figure 11K:
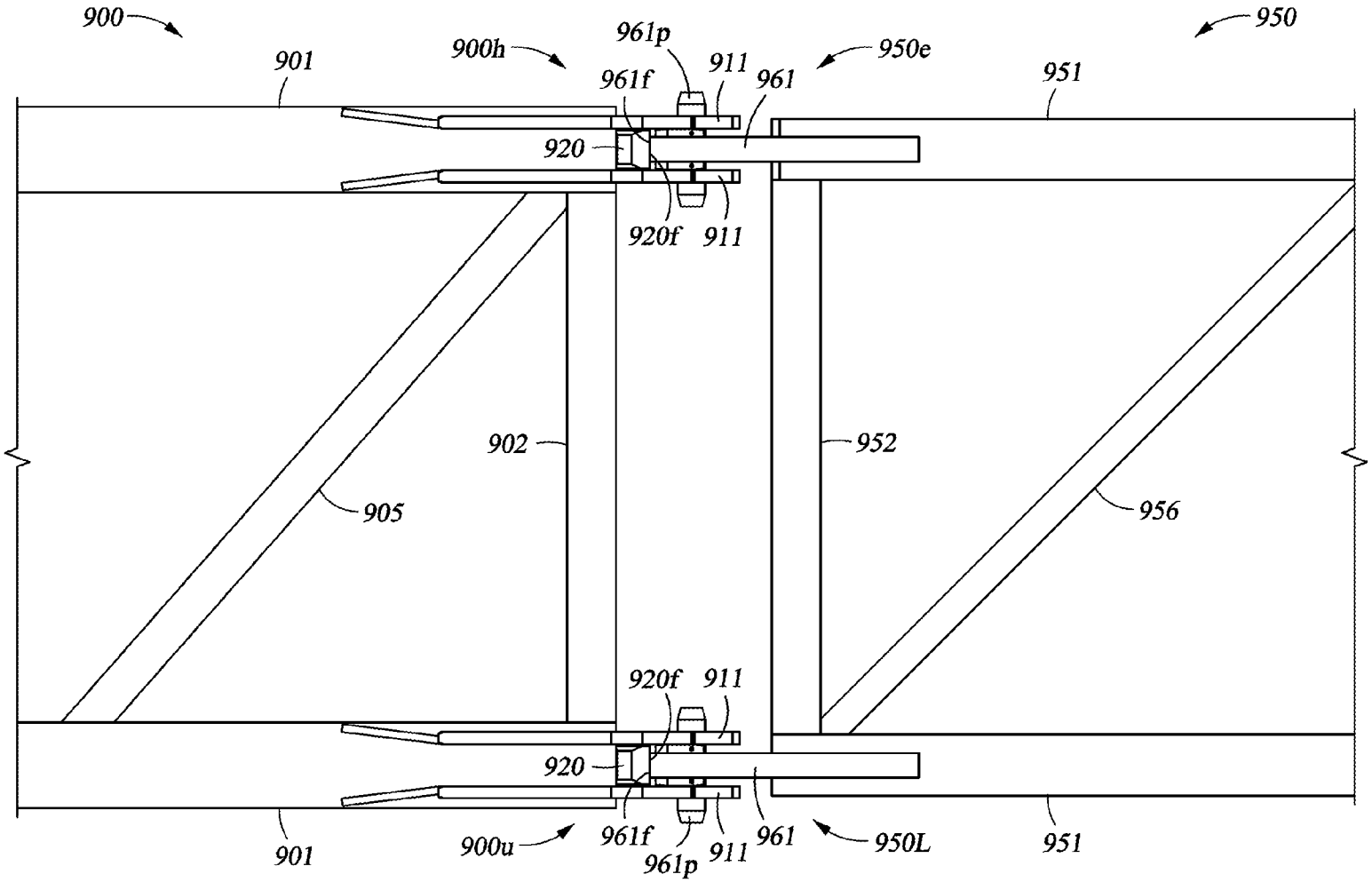
FIG. 11K is a plan view of the upper end of the first mast section and the lower end of the adjacent second mast section shown in FIG. 11G after assembly of the mast sections using an illustrative bi-directional mast connection system of the present disclosure.
Figure 11M:
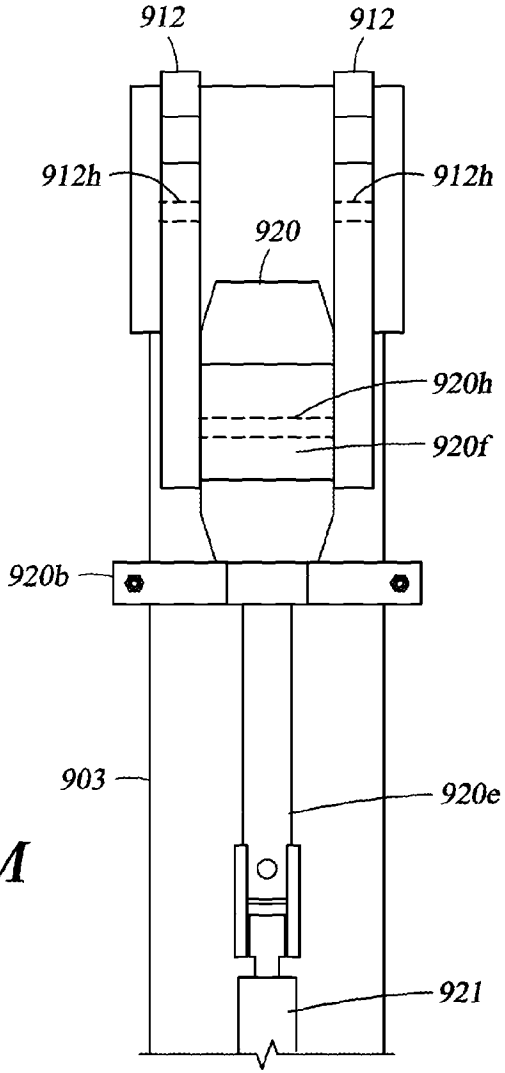
FIGS. 11L and 11M are various end views of the first mast section illustrated in FIGS. 11A and 11C when oriented for mast assembly and erection from the drawworks side of an illustrative mobile drilling rig of the present disclosure.
Figure 11L:
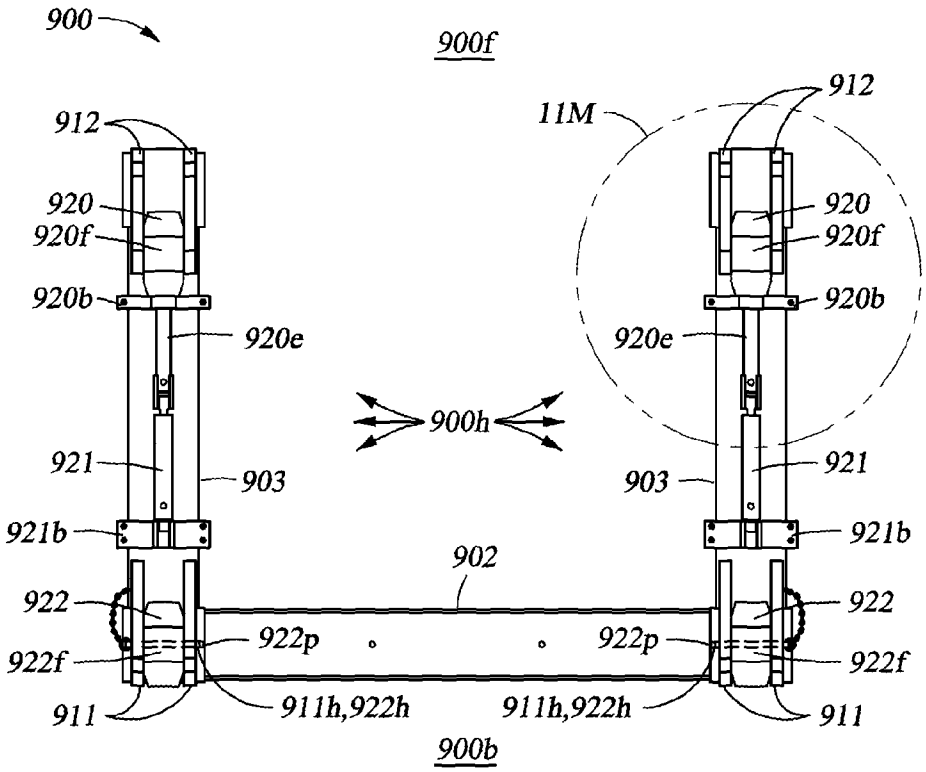
Figure 11N:
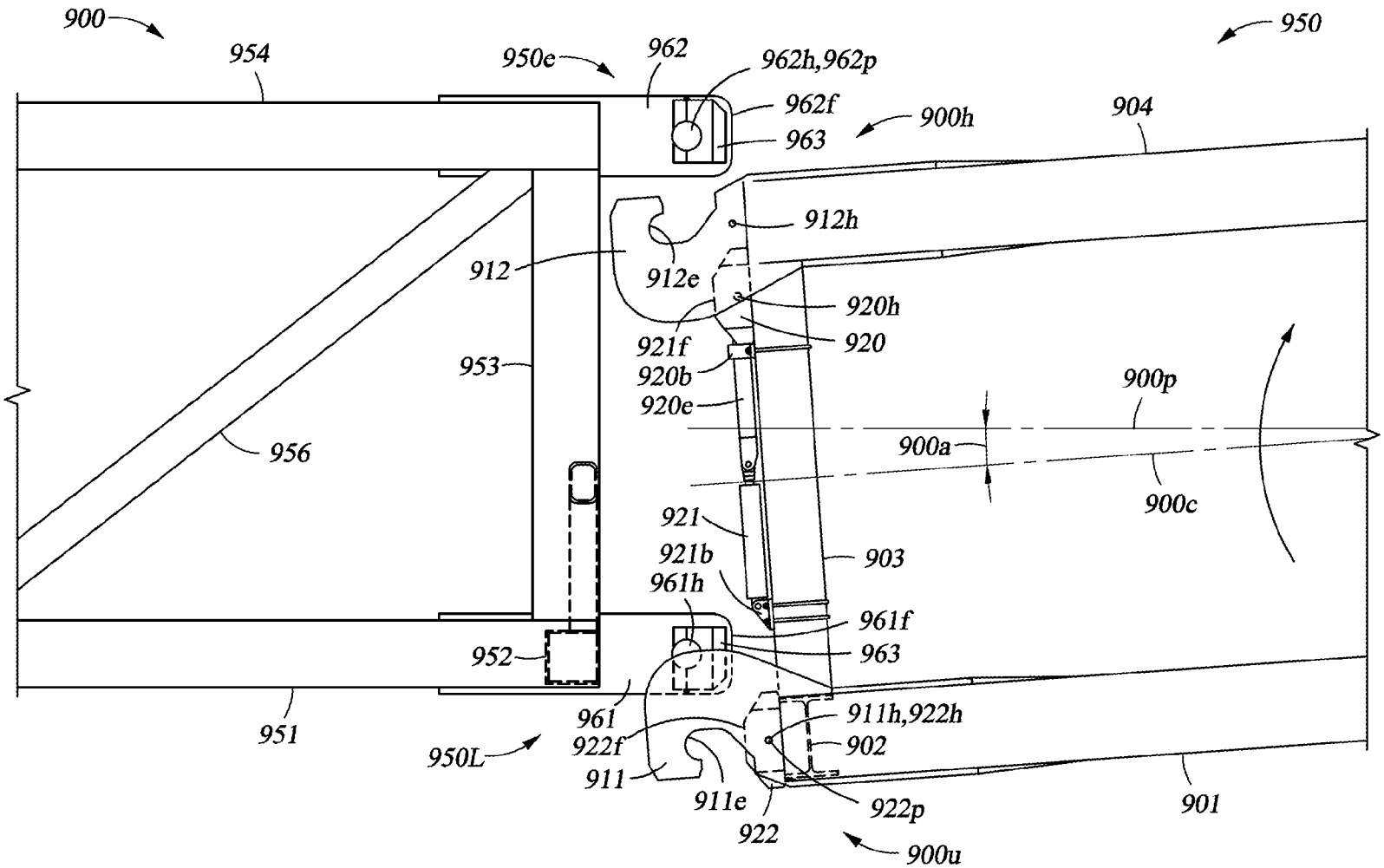
FIGS. 11N and 11P illustrate the assembly of the upper end of the first mast section to the lower end of the adjacent second mast section of the illustrative bi-directionally raisable drilling rig mast using the bi-directional mast connection system of FIGS. 11A-11D, 11L and 11M when assembled from the drawworks side of an illustrative mobile drilling rig disclosed herein.
Figure 11P:
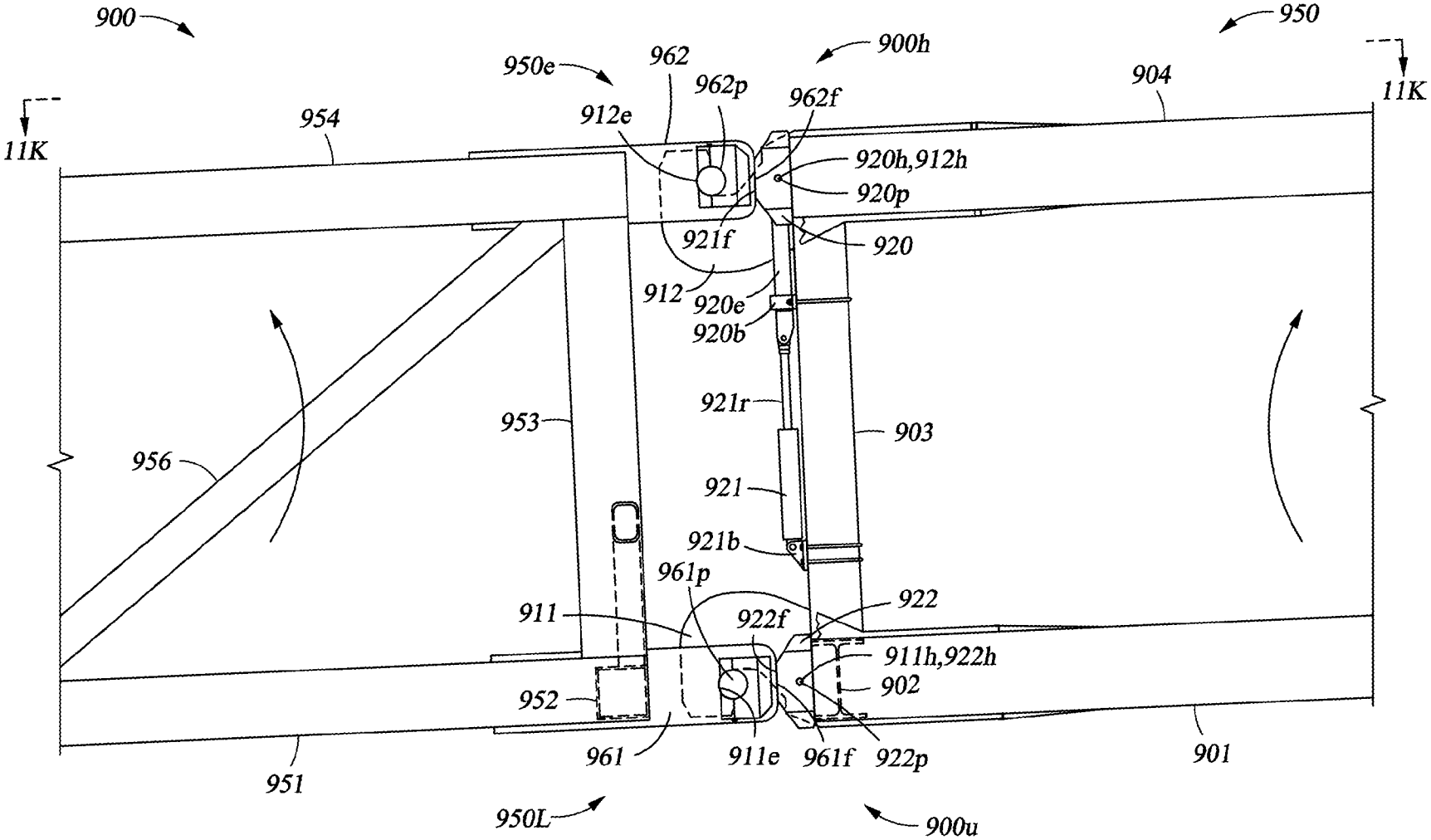

For example, in at least some embodiments, the bottom mast section 730 may be secured to the intermediate mast section 830 by using suitably sized pin members to connect each bi-directional hook connection 735 to a corresponding bi-directional hook engagement connection 836, as is illustrated in FIGS. 11A-1N and FIG. 11P, and which will be described in further detail below. Thereafter, the partially assembled bi-directionally raisable drilling rig mast 760, which is now made up of mast sections 730 and 830, may be raised using the bi-directional mast raising means, e.g., mast erection apparatuses 707, so that the intermediate mast section 830 is no longer supported by the trailer 753, after which the truck 752 and trailer 753 may be moved away from the front side 800*f* of the mobile drilling rig 800.

Figure 10D:
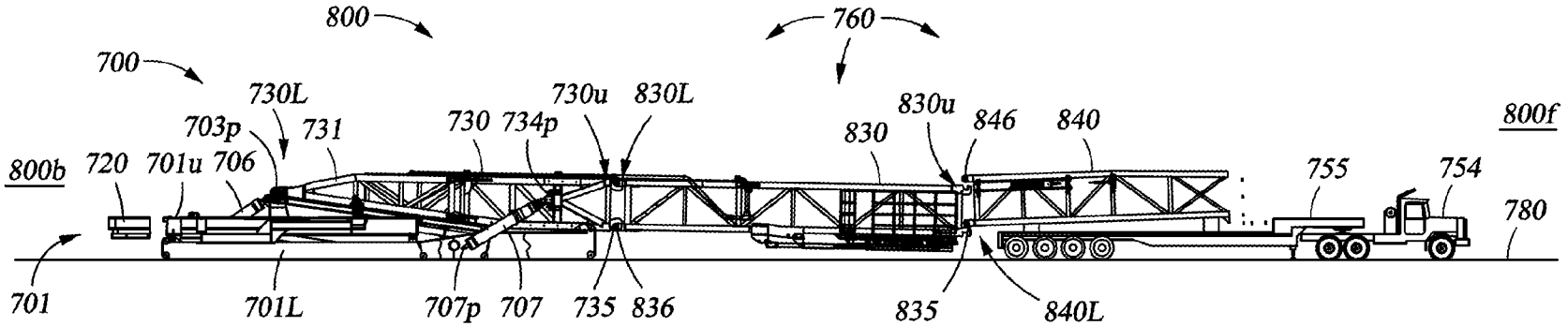
Figure 10E:
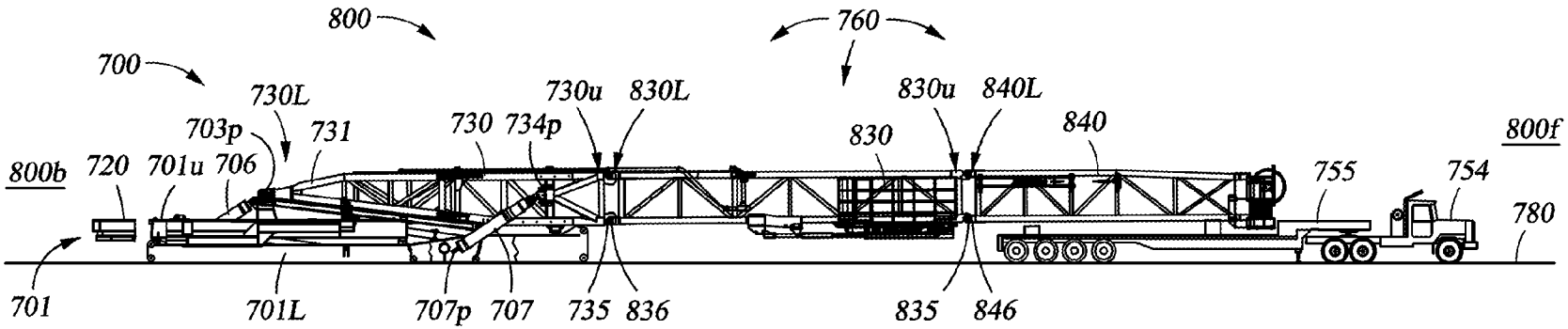

FIGS. 10D and 10E illustrate further mast assembly steps, wherein a third mast section, i.e., an upper mast section 840, of the bi-directionally raisable drilling rig mast 760 may be positioned adjacent to the intermediate mast section 830 using a truck 754 and trailer 755. Furthermore, bi-directional hook connections 835 located at the upper end 830*u* of the intermediate mast section 830 may be attached to corresponding bi-directional hook engagement connections 846 located at the lower end 840L of the upper mast section 840 in the manner previously described with respect to the bi-directional connections 735 and 836. Thereafter, the fully assembled bi-directionally raisable drilling rig mast 760 may be raised from the front side 800*f* of the mobile drilling rig 800 substantially as illustrated in FIGS. 9A and 9B and described above.

FIGS. 10F-10J illustrate the bi-directionally raisable drilling rig mast 760 shown in FIGS. 10A-10E when assembled from the back side 800*b* of the mobile drilling rig 800. Accordingly, as previously described with respect to FIGS. 9C and 9D above, lower extension skids may be attached to the lower substructure boxes of the raisable substructure 700, such as the lower box extension skid 701*e* that is attached to the lower box 701L at connection 701*c*. Furthermore, in order to facilitate the various assembly and erection steps of the bi-directionally raisable drilling rig mast 760 from the back side 800*b*, the bi-directional mast raising means may be re-configured for back side raising, e.g., the mast erection apparatuses 707 may be pivotably attached to back lugs 707*b* by way of suitably designed pinned connections 707*p*, such as was previously described with respect to FIGS. 9C and 9D above.

Figure 10F:
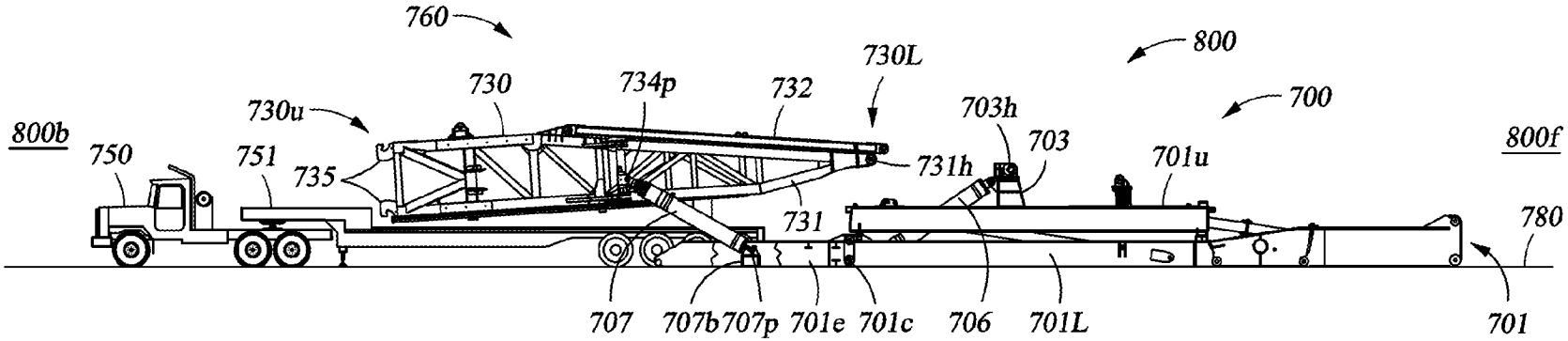
FIGS. 10F-10J are side elevation views showing various steps of assembling the illustrative bi-directionally raisable drilling rig mast of FIGS. 10A-10E from the drawworks side of a mobile drilling rig.
Figure 10G:
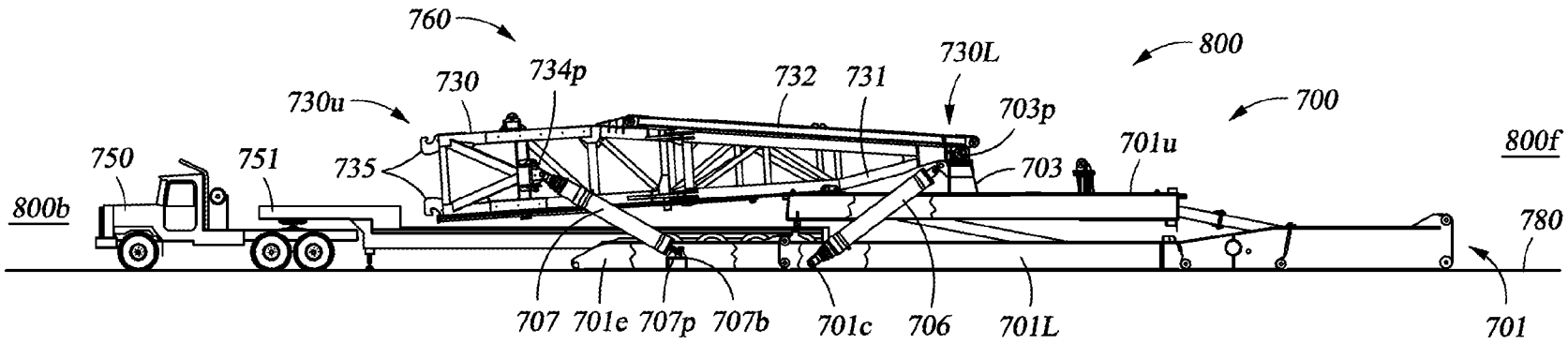

As shown in FIG. 10F, the bottom mast section 730 may be moved into position adjacent to the raisable substructure 700 from the back side 800*b* of the mobile drilling rig 800 using the truck 750 and trailer 751, as previously described. In certain embodiments, a movable center floor section (not shown) may be used to position the lower end 730L of the bottom mast section 730 above the raisable substructure 700 in the manner previously described with respect to various exemplary embodiments disclosed herein, such that the pin holes 731*h* in the rear mast legs 731 are substantially aligned with the pin holes 703*h* in respective mast support shoes 703. In other illustrative embodiments, the truck 750 may be used to move the trailer 751 into an open space between the substructure boxes of the raisable substructure 700, such as the open space 100*s* shown in FIG. 1A, until the pin holes 731*h* and 703*h* are substantially aligned as described above.

Once the pin holes 731*h* and 703*h* are substantially aligned, the pinned connection 703*p* may be used to pivotably attach the bottom mast section 730 to the mast support shoes 703. Thereafter, the mast erection apparatuses 707 may be pivotably attached to the mast raising lugs 734 at respective pinned connections 734*p*, and the bottom mast section 730 may be raised off of the trailer 751 as previously described. The truck 750 and trailer 751 can then be moved away from the back side 800*b* of the mobile drilling rig 800.

Figure 10H:
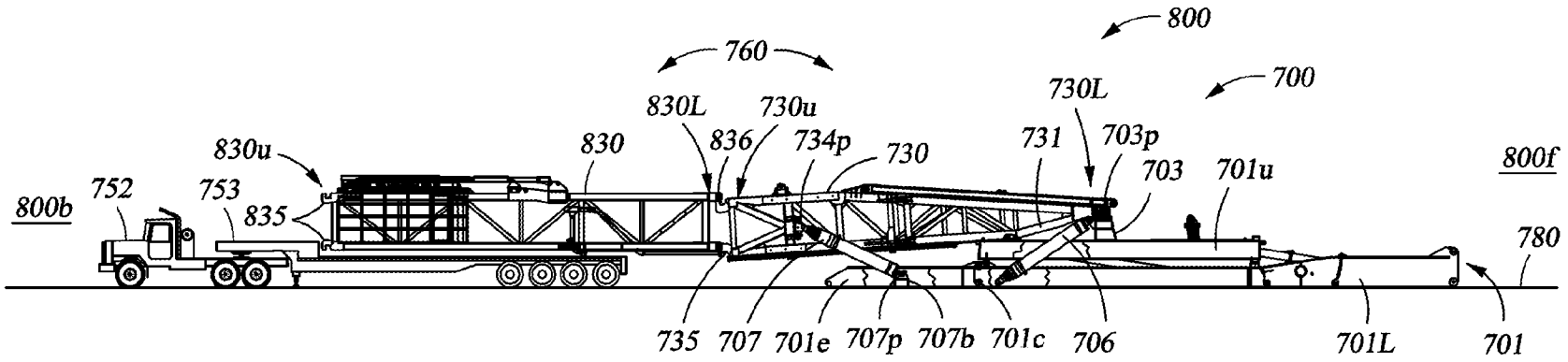
Figure 10I:
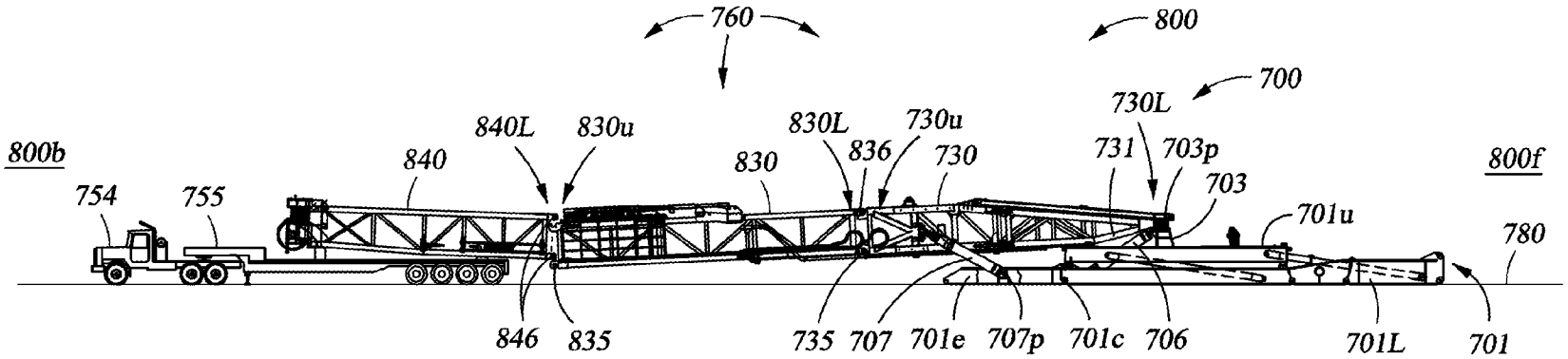
Figure 10J:
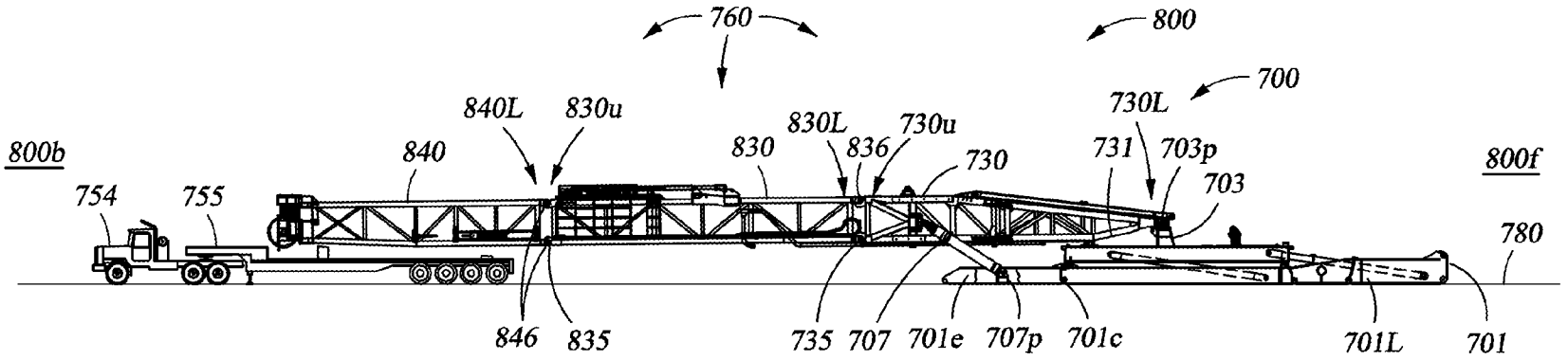

As shown in FIGS. 10H-10J, the intermediate and upper mast sections 830 and 840 may be aligned and positioned as previously described, the bi-directional hook connections 735, 835 may be removable secured to respective bi-directional hook engagement connections 836, 846, also as previously described, so as to fully assembly the bi-directionally raisable drilling rig mast 760. Thereafter, the bi-directionally raisable drilling rig mast 760 may be erected from the back side 800*b* of the mobile drilling rig 800 using the bi-directional mast raising means, e.g., the mast erection apparatuses 707, as illustrated in FIGS. 9C and 9D and described above.

It should understood that while the illustrative bi-directionally raisable drilling rig mast 760 depicted in FIGS. 10A-10J is made up of three mast sections—i.e., a bottom mast section 730, an intermediate mast section 830, and an upper mast section 840—the exemplary embodiments shown in FIGS. 10A-10J are illustrative only. For example, in some illustrative embodiments, a fewer number of mast sections, e.g., two mast sections, may be used, whereas in other embodiments, four or more mast sections may be used. As may be appreciated by a person of ordinary skill in the art having benefit of the present disclosure, the total number of drilling rig mast sections may depend on several competing considerations, such as the overall drilling rig design, the type of drilling mast employed, and equipment logistical requirements, such as road transportation restrictions and the like.

FIGS. 11A-11N and FIG. 11P show some illustrative aspects of an exemplary bi-directional mast connection system that may be used to removably secure the various mast sections of a bi-directionally raisable drilling rig mast to one another. FIG. 11A is a side elevation view of an upper end 900*u* of a first mast section 900, and FIG. 11B is a side elevation view of a lower end 950L of second mast section 950 that will be positioned immediately adjacent to the first mast section 900 in an assembled bi-directionally raisable drilling rig mast. FIGS. 11C and 11D are plan views of the first and second mast sections 900 and 950 shown in FIGS. 11A and 11B, respectively.

The following description of the mast sections depicted in FIGS. 11A-11D is intended to apply to any representative bi-directional mast connection system between any two adjacent mast sections of a bi-directionally raisable drilling rig mast. Accordingly, in certain embodiments, the first mast section 900 may be representative of any mast section in any fully or partially assembled bi-directionally raisable drilling rig mast disclosed herein that is positioned lower than at least one other mast section, whereas the second mast section 950 may be representative of the mast section that is immediately adjacent to and higher than the first mast section 900 in an assembled mast. For example, the upper end 900*u* of the first mast section 900 shown in FIGS. 11A and 11C may be representative of the upper end 730*u* of the bottom mast section 730 depicted in the illustrative embodiments of FIGS. 10A-10J, in which case the lower end 950L of the second mast section 950 shown in FIGS. 11B and 11D may be representative of the lower end 830L of the intermediate mast section 830—i.e., the mast section that is adjacent to and immediately above the bottom mast section 730 in the bi-directionally raisable drilling rig mast 760 shown in FIGS. 10A-10J. Similarly, the upper end 900*u* of the first mast section 900 may be representative of the upper end 830*u* of the intermediate mast section 830, whereas the lower end 950L of the second mast section 950 would be representative of the lower end 840L of the upper mast section 840.

As shown in the illustrative embodiment depicted in FIGS. 11A and 11C, the upper end 900*u* of the first mast section 900 may include a pair of spaced-apart first structural members 901 positioned on a first side (e.g., the top side as depicted in FIG. 11A) of the first mast section 900 and a pair of spaced-apart second structural members 904 positioned on a second side of the first mast section 900 (e.g., the bottom side as depicted in FIG. 11A). Additionally, the first (top) side of the first mast section 900 is spaced apart from the second (bottom) side of the first mast section by a pair of connecting structural members 903, each of which connects an end of a first structural member 901 to an end of a respective second structural member 904. As shown in FIG. 11C, the first mast section 900 also includes a cross member 902 that runs between and connects the ends of the pair of spaced-apart first structural members 901, and a cross brace 905 running diagonally from one first structural member 901 to the other first structural member 901, such that both the cross member 902 and cross brace 905 are positioned on the first (top) side of the first mast section 900. Accordingly, it should be appreciated that, after mast erection, the second structural members 904 (i.e., the second side of the first mast section 900) would be positioned along the setback side, or front side 900*f*, of the mast section 900, as the first mast section 900 is open from that side, i.e., no cross-members are present, thereby permitting relatively easy access to the space inside of the first mast section 900 by tubular products and/or handling equipment. Likewise, it should also be appreciated that, after mast erection, the first structural members 901, the cross member 902, and the cross brace 905 would be positioned along the drawworks side, or back side 900*b*, of the first mast section 900, and the cross member 902 and cross brace 905 would generally prevent easy access to the inside of the first mast section 900 from the drawworks side 900*b*. See, i.e., the end view of the first mast section 900 shown in FIGS. 11E, 11 and 11L.

In certain embodiments, the upper end 900*u* of the first mast section 900 may also have a bi-directional hook connection apparatus 900*h*, which may include, among other things, a pair of first bi-directional hooks 911 fixedly attached to the ends of each of the pair of first structural members 901. Similarly, a pair of second bi-directional hooks 912 may also be fixedly attached to the ends of each of the pair of lower structural members 904. As shown in FIG. 11A, each of the bi-directional hooks 911 have an open throat area 911*t* and each of the bi-directional hooks 912 have an open throat area 912*t*. Additionally, as shown in FIG. 11A, the bi-directional hooks 911 and 912 are oriented in substantially opposite directions, that is, wherein the open throats 911*t* of the first bi-directional hooks 911 are oriented substantially away from the first (top) side of the first mast section 900—e.g., substantially upward, as shown in FIG.

11A—and in an opposite direction compared to the open throats 912*t* of the second bi-directional hooks 912, which are oriented substantially away from the second (bottom) side of the first mast section—e.g., substantially downward, as shown in FIG. 11A.

In at least some embodiments, each of the first and second bi-directional hooks 911, 912 may have substantially the same overall configuration, such that each hook 911, 912 may be able to properly engage a corresponding hook engagement connection, such as the first and second bi-directional hook engagement connections 961 and 962 of the second mast section 950 (see, FIGS. 11B and 11D), irrespective of the specific orientations of the bi-directional hooks 911, 912. For example, each of the first and second bi-directional hooks 911 and 912 may have respective hook engagement surfaces 911*e* and 912*e*, which may be adapted to hookingly engage suitably sized pin members when the first mast section 900 is attached and secured to the second mast section 950 during the assembly of an illustrative bi-directionally raisable drilling rig mast, as will be further described with respect to FIGS. 11G-11K and FIGS. 11N and 11P below.

The bi-directional hook connection apparatus 900*h* may also include a pair of first mast connection spacers 920 having contact faces 920*f*, and pair of second mast connection spacers 922 having contact faces 922*f*. In certain embodiments, the first and second mast connection spacers 920, 922 are adapted to facilitate the proper alignment and positioning of the first and second bi-directional hook engagement connections 961 and 962 on the second mast section 950 relative to the hook engagement surfaces 911*e* and 912*e* of the respective first and second bi-directional hooks 911 and 912 during the hooking engagement therebetween that occurs as the second mast section 950 is attached to the first mast section 900.

In at least some embodiments, the first mast connection spacers 920 may include spacer extension bars 920*e*, each of which in turn may be operatively coupled to a respective spacer movement apparatus 921. The spacer movement apparatus 921 may be, for example, suitably sized hydraulically or pneumatically actuated cylinders, which may be adapted to move the first mast connection spacers 920 between respective pairs of first or second bi-directional hooks 911 or 912, as may be required depending on the direction from which the illustrative bi-directionally raisable drilling rig mast may be assembled and erected, i.e., the front side 900*f* or the back side 900*b*, as will be further described below. In certain embodiments, brackets 921*b* may be used to removably attach the spacer movement apparatuses 921 to respective connecting structural members 903. Furthermore, brackets 920*b* may also be removably attached to respective connecting structural members 903, which may be adapted to allow a sliding movement therethrough of respective spacer extension bars 920*e*, thereby permitting the spacer movement apparatuses 921 to move respective first mast connection spacers 920.

In at least some embodiments disclosed herein, the second mast connection spacers 922 may be pinned into position using a removable spacer pin 922*p* between the pairs of bi-directional hooks that will be on the bottom side of the first mast section 900 when the first mast section 900 is placed in a substantially horizontal orientation for assembling the second mast section 950 thereto. Accordingly, the specific pairs of bi-directional hooks that may be on the bottom side of the first mast section 900 when it is oriented horizontally will vary, depending on whether the illustrative bi-directionally raisable drilling rig mast is assembled from the front side 900*f* of a respective drilling rig or from the back side 900*b*. For example, when the bi-directionally raisable drilling rig mast is assembled from the front side 900*f*, the setback side of the mast section 900 will be oriented downward, i.e., such that the second structural members 904 and the pairs of second bi-directional hooks 912 are on the bottom side of the mast section 900. On the other hand, when the bi-directionally raisable drilling rig mast is assembled from the back side 900*b*, the drawworks side of the mast section 900 will be oriented downward, i.e., such that the first structural members 904, the cross member 902, the cross brace 905, and the pairs of first bi-directional hooks 911 are on the bottom side of the mast section 900.

In the illustrative embodiment shown in FIGS. 11A-11D, the upper and lower ends 900*u* and 950L of first and second mast sections 900 and 950, respectively, are depicted in a substantially horizontal orientation, e.g., prior to assembling the second mast section 950 to the first mast section 900. In the orientation shown in FIG. 11A, the first structural members 901, the cross member 902, the cross brace 905, and the first bi-directional hooks 911 are positioned on the upper side of the first mast section 900, whereas the second structural members 904 and the second bi-directional hooks 912 are positioned on the bottom side of the first mast section 900. Accordingly, the second mast connection spacers 922 will each be positioned between respective pairs of second bi-directional hooks 912 as shown in FIG. 11A, i.e., at the bottom side of the first mast section 900, and thereafter pinned in place by installing removable spacer pins 922*p* through respective aligned pin holes 912*h* and 922*h* in the second bi-directional hooks 912 and the second mast connection spacers 922, respectively.

On the other hand, in those illustrative embodiments of the present disclosure wherein the first mast section 900 is oriented for assembly and erection from the front side 900*f*, the first mast connection spacers 920, the spacer extension bars 920*e*, and the spacer movement apparatuses 921 may be removably attached to respective connecting structural members 903 in the position illustrated in FIG. 11A. Thereafter, the first mast connection spacers 920 may be properly positioned between respective pairs of first bi-directional hooks 911 during the connection of the second mast section 950 to the first mast section 900 as described below, such that holes 920*h* in the first mast connection spacers 920 are substantially aligned with holes 911*h* in the respective pairs of first bi-directional hooks 911. The removable spacer pins 920*p* may then be installed through the aligned pin holes 911*h* and 920*h* so as to fix the first mast connection spacers 920 in place, as will be further discussed below.

FIGS. 11B and 11D, are elevation and plan views, respectively of the lower end 950L of the second mast section 950. In some embodiments, the second mast section 950 may include a pair of spaced-apart first structural members 951 positioned on a first side (e.g., the top side as depicted in FIG. 11B) of the second mast section 950 and a pair of spaced-apart second structural members 954 positioned on a second side of the second mast section 950 (e.g., the bottom side as depicted in FIG. 11B). Additionally, the first (top) side of the second mast section 950 is spaced apart from the second (bottom) side of the first mast section by a pair of connecting structural members 953, each of which connects an end of a first structural member 951 to an end of a respective second structural member 954. The second mast section 950 may also include first cross braces 956 positioned on the first side of the second mast section 950 that runs diagonally from an end of each second structural member 954 to a respective first structural member 951.

Furthermore, a cross member 952 may also be positioned on the first side of the second mast section 950 and run between and connect the ends of the pair of spaced-apart first structural members 951, and a second cross brace 955 may run diagonally from one first structural member 951 to the other first structural member 951. Furthermore, similar to the first mast section 900 illustrated in FIGS. 11A and 11C and described above, it should be appreciated that the second structural members 954 are positioned along the setback side, or front side 900*f*, of the second mast section 950, whereas the first structural members 951, the cross member 952, and the second cross brace 955 are positioned along the drawworks side, or back side 900*b*, of the second mast section 950.

In certain embodiments, the lower end 950L of the second mast section 950 may also have a bi-directional hook engagement apparatus 950*e*, which may include, among other things, a first bi-directional hook engagement connection 961 fixedly attached to the ends of each of the first structural members 951. Similarly, bi-directional hook engagement connections 962 may also be fixedly attached to the ends of each of the lower structural members 954. As shown in FIGS. 11B and 11D, each bi-directional hook engagement connection 961 and 962 may also include a spacer plate 963 on either side thereof, i.e., a pair of spacer plates 963 on each respective bi-directional hook engagement connection 961, 962, and have a respective contact face 961*f*, 962*f* at an exposed end thereof. Furthermore, the bi-directional hook engagement connections 961, 962 may have respective pin holes 961*h*, 962*h* passing therethrough, which may be adapted to receive respective suitably sized pin members, such as the pin members 961*p*, 962*p* shown in FIGS. 11G, 11H and 11K (described in further detail below), which may be installed during the attachment of the second mast section 950 to the first mast section 900.

In at least some embodiments, each of the first and second bi-directional hook engagement connections 961 and 962 may have substantially the same overall configuration, with the exception of the orientation of the spacer plates 963 attached to either side of the hook engagement connections 961, 962. In this way, each bi-directional hook engagement connection 961, 962 may be able to properly engage a corresponding bi-directional hook 911, 912 irrespective of the orientation of the first and second mast sections 900 and 950 during the assembly of the illustrative bi-directionally raisable drilling rig mast.

In certain embodiments of the present disclosure, the width 910*w* (see, FIG. 11C) of the spaces between each pair of first and second bi-directional hooks 911, 912 on the first mast section 900 may be adapted so as to receive a corresponding bi-directional hook engagement connection 961, 962 during the attachment of the second mast section 950 to the first mast section 910. Accordingly, the total thickness 960*t* of each hook engagement connection 961, 962, including the thickness of the spacer plates 963 attached thereto, may be sized so as to be substantially the same as the width 910*w*, less a suitable amount of clearance and associated tolerance so as to form a proper pinned connection between each pair of first and second bi-directional hooks 911, 912 and the corresponding first and second hook engagement connections 961, 962, after the respective pin members 961*p*, 962*p* (see, FIGS. 11G, 11H and 11K) have been installed therein. Furthermore, in at least some embodiments, each spacer plate 963 may have a front taper/chamfer 963*c*, so as to facilitate easier insertion of each first and second bi-directional hook engagement connection 961, 962 between corresponding pairs of first and second bi-directional hooks 911, 912, as will be further described below.

FIG. 11E is an end view of the illustrative first mast section 900 when viewed along the view line "11E-11E" shown in FIG. 11A. As shown in FIG. 11E, the first mast section 900 is depicted as being oriented for assembly and erection from the front side of an illustrative mobile drilling rig. Accordingly, the cross member 902 and the first bi-directional hooks 911, i.e., the drawworks side or back side 900*b* of the first mast section 900, are positioned along the upper side of the first mast section 900, whereas the second bi-directional hooks 912, i.e., the setback side or front side 900*f* of the first mast section, are positioned along the bottom side of the first mast section 900. Furthermore, a second mast connection spacer 922 is pinned in place between each pair of bi-directional hooks 912 with the removable spacer pins 922*p*, as previously described. Moreover, the first mast connection spacers 920, the spacer extension bars 920*e*, and the spacer movement apparatuses 921 are removably attached to respective connecting structural members 903 with brackets 920*b* and 921*b*, wherein however the first mast connection spacers 920 have not yet been fully moved into a final position between respective pairs of first bi-directional hooks 911 by the spacer movement apparatuses 921.

FIG. 11F is a close-up view of an illustrative first mast connection spacer 920, first bi-directional hooks 911, and spacer movement apparatus 921 as shown in view "11F" of FIG. 11E. As shown in FIG. 11F, the pin hole 920*h* through the first mast connection spacer 920 is not aligned with the pin holes 911*h* through the pair of bi-directional hooks 911. Furthermore, alignment of the pin holes 911*h* and 920*h* will not occur until the second mast section 950 has been attached to the first mast section 900, as will be further described in detail below. Additionally, FIG. 11F shows that the cross member 902 is connected to the connecting structural member 903 immediately adjacent to the first bi-directional hooks 911, indicating that the first mast section 900 is oriented for assembly and erection from the front side 900*f* of an illustrative mobile drilling rig.

FIGS. 11G and 11H illustrate the assembly of the upper end 900*u* of the first mast section 900 to the lower end 950L of the second mast section 950 when using the bi-directional hook connection apparatus 900*h* and the bi-directional hook engagement apparatus 950*e* shown in FIGS. 11A-1F and described above. More specifically, the cross members 902 and 952 are shown in FIGS. 11G and 11H as being positioned along the upper side of each respective mast section 900 and 950, and therefore depict mast assembly steps wherein the first and second mast sections 900, 950 are being assembled from the setback side, or front side 900*f*, of an illustrative mobile drilling rig disclosed herein.

As shown in FIG. 11G, the upper end 900*u* of the first mast section 900 may positioned and oriented so that the hook engagement surfaces 911*e*, 912*e* of the respective first and second bi-directional hooks 911, 912 are positioned substantially below the respective pin holes 961*h*, 962*h* in the respective first and second hook engagement connections 961, 962. In some embodiments, the above-noted positioning of the first mast section 900 may be accomplished by pivotably rotating the mast section 900 about pinned connections on respective mast support shoes (such as the pinned connections 703*p* on the mast support shoes 703 shown in FIGS. 10A-10E) using illustrative mast raising means (such as the mast erection apparatuses 707, also shown in FIGS. 10A-10E). In certain embodiments, the centerline 900*c* of the first mast section 900 may be rotated downward by an angle 900*a* below a substantially horizontal plane 900*p* until the hook engagement surfaces 911*e*, 912*e* are positioned below the pinholes 961*h*, 962*h* as described above. Suitably sized pin members 961*p* may then be installed into the pin holes 961*h* in the first bi-directional hook engagement connections 961.

After the pin members 961*p* have been installed into the pin holes 961*h* of the first hook engagement connections 961, the first bi-directional hooks 911 may be raised by pivotably rotating the first mast section 900 upward using the previously noted mast raising means (such as the mast erection apparatuses 707) so that the pin members 961*p* enter the open throat areas 911*t* (see, FIG. 11A) of each pair of bi-directional hooks 911. Thereafter, the pin members 961*p* may contact the pairs of respective first bi-directional hooks 911 and slide forward until the pin members 961*p* substantially hookingly engage the hook engagement surfaces 911*e* of the respective first hooks 911, as shown in FIG. 11H.

In some illustrative embodiments, the first mast section 900 may be further raised after the pin members 961*p* have substantially hookingly engaged the hook engagement surfaces 911*e* as described above, thereby causing the second mast section 950 to pivotably rotate about the pin members 961*p* until the contact faces 962*f* on the front ends of the second bi-directional hook engagement connections 962 engage, or slide between, corresponding pairs of second hooks 912 so as to move into bearing contact with the contact faces 922*f* on the previously installed corresponding second mast connection spacers 922. In this configuration, the overturning moment caused by the cantilevered dead weight of the second mast section 950 may be resisted by a force couple within the bi-directional hook connection apparatus 900*h* and the bi-directional hook engagement apparatus 950*e*, wherein a substantially axial upper force (i.e., along the axis of the drilling rig mast) is induced by the reaction of the pin members 961*p* on the hook engagement surfaces 911*e*, and a corresponding substantially axial lower force is induced by the reaction of the contact faces 962*f* on the contact faces 922*f*. Thereafter, pin members 962*p* may be installed into the pin holes 962*h* in the second bi-directional hook engagement connections 962, thereby locking into place the connection between the second bi-directional hooks 912 and the second hook engagement connections 962.

Furthermore, the connection between the first bi-directional hooks 911 and the second hook engagement connections 961 may also be locked into place by actuating the spacer movement apparatuses 621 to extend push rods 921*r* and move the first mast connection spacers 920 between respective pairs of first bi-directional hooks 911. In certain embodiments, the push rods 921*r* are operatively coupled to respective spacer extension bars 920*e*, and therefore act to slidably move the spacer extension bars 920*e* through the bracket 920*b*. Accordingly, the first mast connection spacers 920 may be pushed upward into their final positions between pairs of first bi-directional hooks 911, such that the contact faces 920*f* on the spacers 920 are substantially in contact with the contact faces 961*f* on the ends of each respective first hook engagement connection 961. Thereafter, removable spacer pins 920*p* may be installed into the aligned pin holes 911*h* and 920*h* on the first hooks 911 and the first mast connection spacers 920, respectively.

FIG. 11I is an end view of the illustrative first mast section 900 when viewed along the view line "11I-11I" shown in FIG. 11H, after the connection between the first mast section 900 and the second mast section 950 has been completed, i.e., after the respective first mast connection spacers 920 have been pinned in place with the removable spacer pins 920*p*. FIG. 11J is a close-up view of the illustrative first mast connection spacer 920 as shown in the detail view "11J" of FIG. 11I. As shown in FIG. 11J, the pin hole 920*h* through the first mast connection spacer 920 has been aligned with the pin holes 911*h* through the pair of bi-directional hooks 911 (see, FIGS. 11E and 11F), and the removable spacer pin 920*p* has been inserted therethrough.

FIG. 11K is an plan view of the illustrative first and second mast sections 900 and 950 when viewed along the view line "11K-11K" shown in FIG. 11H, after the connection between the first mast section 900 and the second mast section 950 has been completed. As shown in FIG. 11K, each pin member 961*p* passes through a first bi-directional hook engagement connection 961, as well as through a respective pair of first bi-directional hooks 911. Furthermore, the first mast connection spacers 920 have been positioned between respective pairs of first bi-directional hooks 911 such that contact faces 920*f* on the spacers 920 are substantially in contact with the contact faces 961*f* on the respective bi-directional hook engagement connections 961.

FIG. 11L is an end view of the illustrative first mast section 900 of a bi-directionally raisable drilling rig mast as shown in FIGS. 11A and 11C, wherein however the first mast section 900 has been oriented for assembly and erection from the drawworks side, or back side 900*b*, of an illustrative mobile drilling rig of the present disclosure. More specifically, as shown in FIG. 11L, the first mast section 900 is oriented so that the cross member 902 and the first bi-directional hooks 911 (i.e., the back side of the first mast section 900) are positioned along the bottom side of the first mast section 900, whereas the second bi-directional hooks 912 (i.e., the front side of the first mast section 900) are positioned along the upper side of the first mast section 900. Furthermore, the positions of the first and second mast connection spacers 920 and 922 have been reversed relative to the various elements of the first mast section 900. For example, while the second mast connection spacers 922 are still positioned at the bottom side of the first mast section 900 as they were in the previous illustrative embodiment (see, i.e., FIGS. 11E and 11I), they are now pinned in place between pairs of first bi-directional hooks 911, rather than second pairs of bi-directional hooks 912, since the orientation of the first mast section 900 has been reversed. More specifically, the second mast connection spacers 922 are pinned in place between the first hooks 911 by substantially aligning the pin holes 911*h* in the first hooks 911 with the pin holes 922*h* in the second spacers 922 and installing the removable spacer pin 922*p*. Similarly, the removable brackets 920*b* and 921*b* and been repositioned as shown in FIG. 11L, so that spacer movement apparatuses 921 may be actuated so as position the first mast connection spacers 920 between respective pairs of second bi-directional hooks 912 and substantially align the pin holes 920*h* in the first spacers 920 with the pin holes 912*h* in the second hooks 912 during the connection operation of the second mast section 950 to the first mast section 900.

FIG. 11M is a close-up view of an illustrative first mast connection spacer 920, first bi-directional hooks 911, and spacer movement apparatus 921 as shown in view "11M" of FIG. 11L. As shown in FIG. 11M, the arrangement is substantially the same as shown in FIG. 1F and described above, wherein however the cross member 902 is not shown, as its position relative to the first mast connection spacer 920 has been reversed, i.e., it is located at the opposite end of the connecting structural member 903 relative to the spacer 920.

FIGS. 11N and 11P illustrate the assembly of the upper end 900*u* of the first mast section 900 to the lower end 950L of the second mast section 950 when using the bi-directional hook connection apparatus 900*h* and the bi-directional hook engagement apparatus 950*e* described above, and wherein the first and second mast sections 900, 950 are being assembled from the drawworks side, or back side 900*b*, of an illustrative mobile drilling rig. As shown in FIGS. 11N and 11P, the various mast assembly steps are substantially similar to those outlined with respect to FIGS. 11G and 11H above, wherein however the positions and orientations of the first and second mast sections 900 and 950 have been reversed. For example, as noted previously, in FIGS. 11N and 11P, the upper end 900*u* of the first mast section 900 is oriented toward the back side 900*b* of an illustrative mobile drilling rig, as compared to being oriented toward the front side 900*f* of a rig as shown in FIGS. 11G and 11H. Furthermore, the positions of the first and second mast connection spacers 920 and 922 have also been reversed relative to the positions of the various other elements of the first and section mast sections 900 and 950. For example, as shown in FIG. 11H, after the second mast section 950 has been attached to the first mast section 900, the second mast connection spacers 922 are pinned between pairs of first bi-directional hooks 911, whereas the first mast connection spacers 920 are pinned between pairs of second bi-directional hooks 912. Otherwise, as noted above, the mast assembly sequence is substantially as outlined with respect to FIGS. 11G and 11H, and will not be repeated here.

It should be appreciated by those having ordinary skill in the art that the description set forth above related to the various structural members that may be included in the first and second mast sections 900 and 950, respectively, are illustrative only, and should therefore not be considered as limiting in any way. Accordingly, it should be understood that it is within the overall spirit and scope of the present disclosure to use specific configurations of structural members, connection member, cross members, and cross braces other than those described above in conjunction with the disclosed bi-directional hook connection apparatuses 900*h* and bi-directional hook engagement apparatuses 950*e*.

Furthermore, while the specific embodiments described with respect to FIGS. 11A-11N and 11P above are directed to attaching pairs of illustrative bi-directional hooks 911 and 912 to the first and second structural members 901 and 904 on both sides of the first mast section 900, the bi-directional mast connection concepts disclosed herein are equally functional when pairs of bi-directional hooks 911 and 912 are attached to first and section structural members 901 and 904 on only one side or the other of the first mast section 900. Accordingly, it is also therefore within the scope of the present disclosure to attach illustrative bi-directional hook engagement connections 961 and 962 to the first and second structural members 951 and 954 on only one corresponding side of the second mast section 950.

FIGS. 12A-12H are illustrative perspective views showing various steps for assembling first and second mast sections 900 and 950 of a bi-directionally raisable drilling rig mast from the setback side of an illustrative mobile drilling rig, wherein some aspects of the mast sections 900 and 950 shown in FIGS. 12A-12H are substantially similar to the first and second mast sections 900 and 950 shown in FIGS. 11A-11K and described above. More specifically, FIGS. 12A-12D depict four illustrative steps of attaching the lower end 950L of the second mast section 950 to the upper end 900*u* of the first mast section 900 when viewed from the side of the first mast 900, whereas FIGS. 12E-12H depict the same four illustrative steps shown in FIGS. 12A-12D when viewed from the side of the second mast section 950.

Figure 12A:
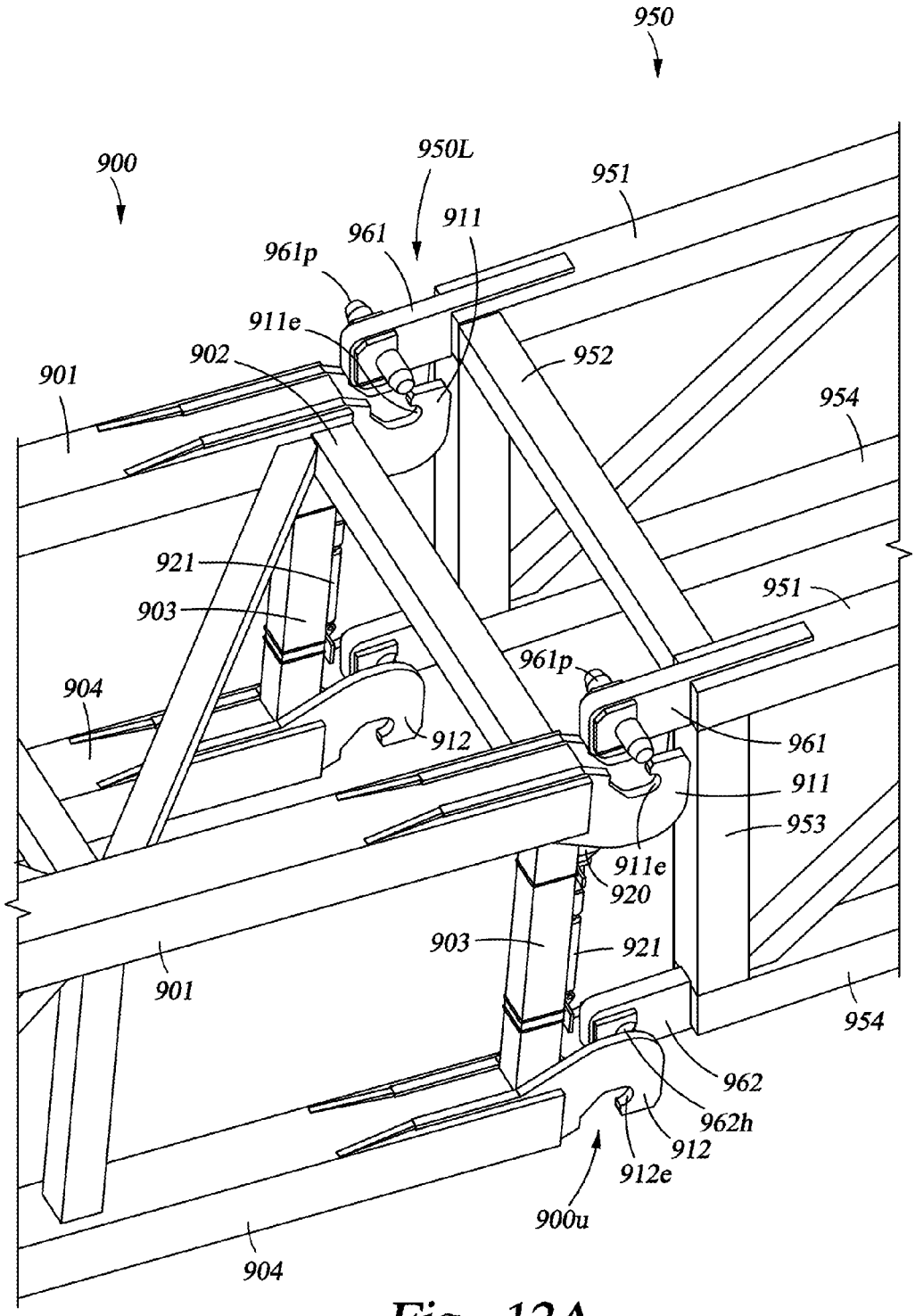
FIGS. 12A-12D are perspective views showing various illustrative steps for assembling two adjacent mast sections of a bi-directionally raisable drilling rig mast from the setback side of an illustrative mobile drilling rig disclosed herein when viewed from a first mast section side of the bi-directional mast connection system illustrated in FIGS. 11A-11J.
Figure 12B:
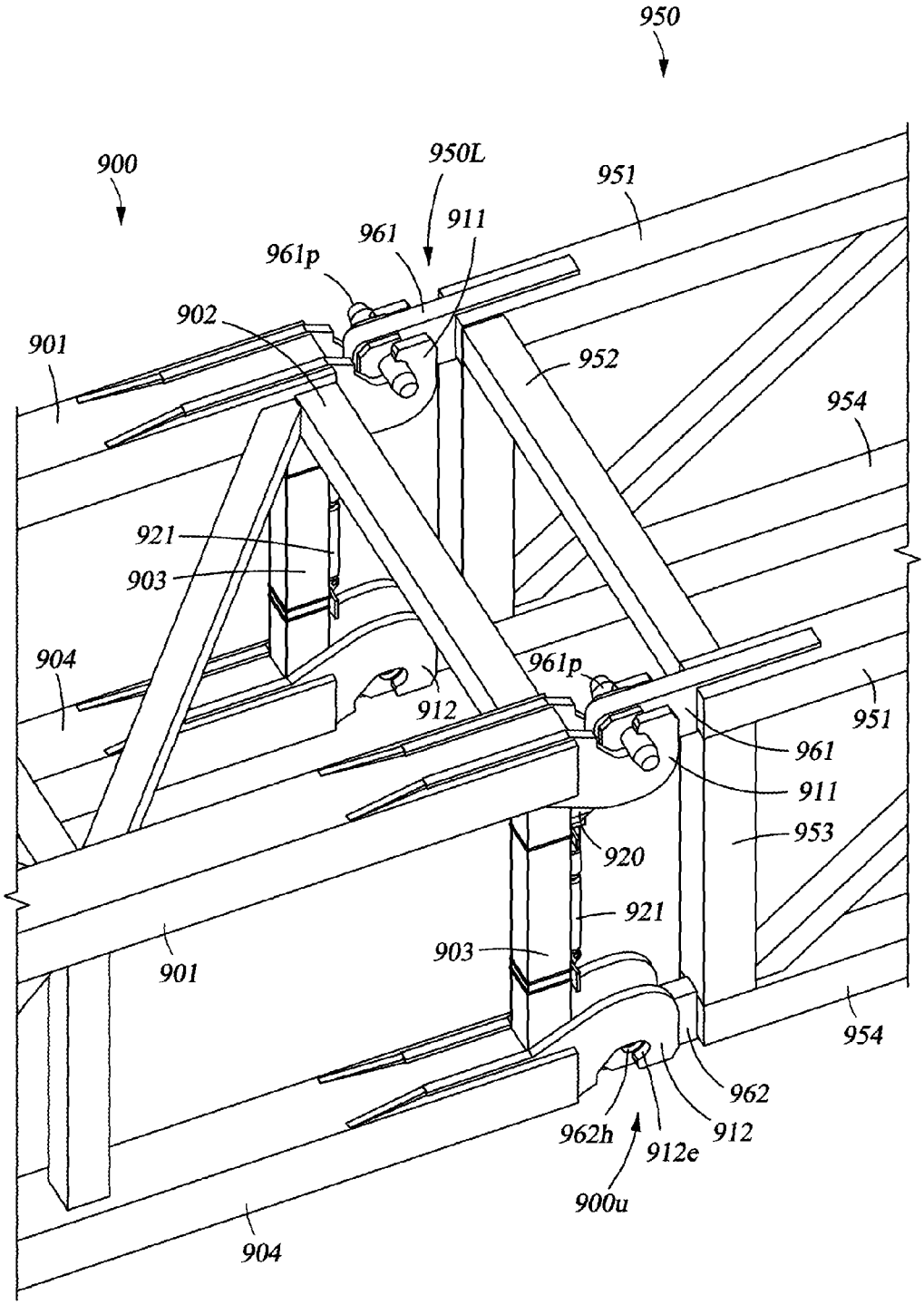
Figure 12C:
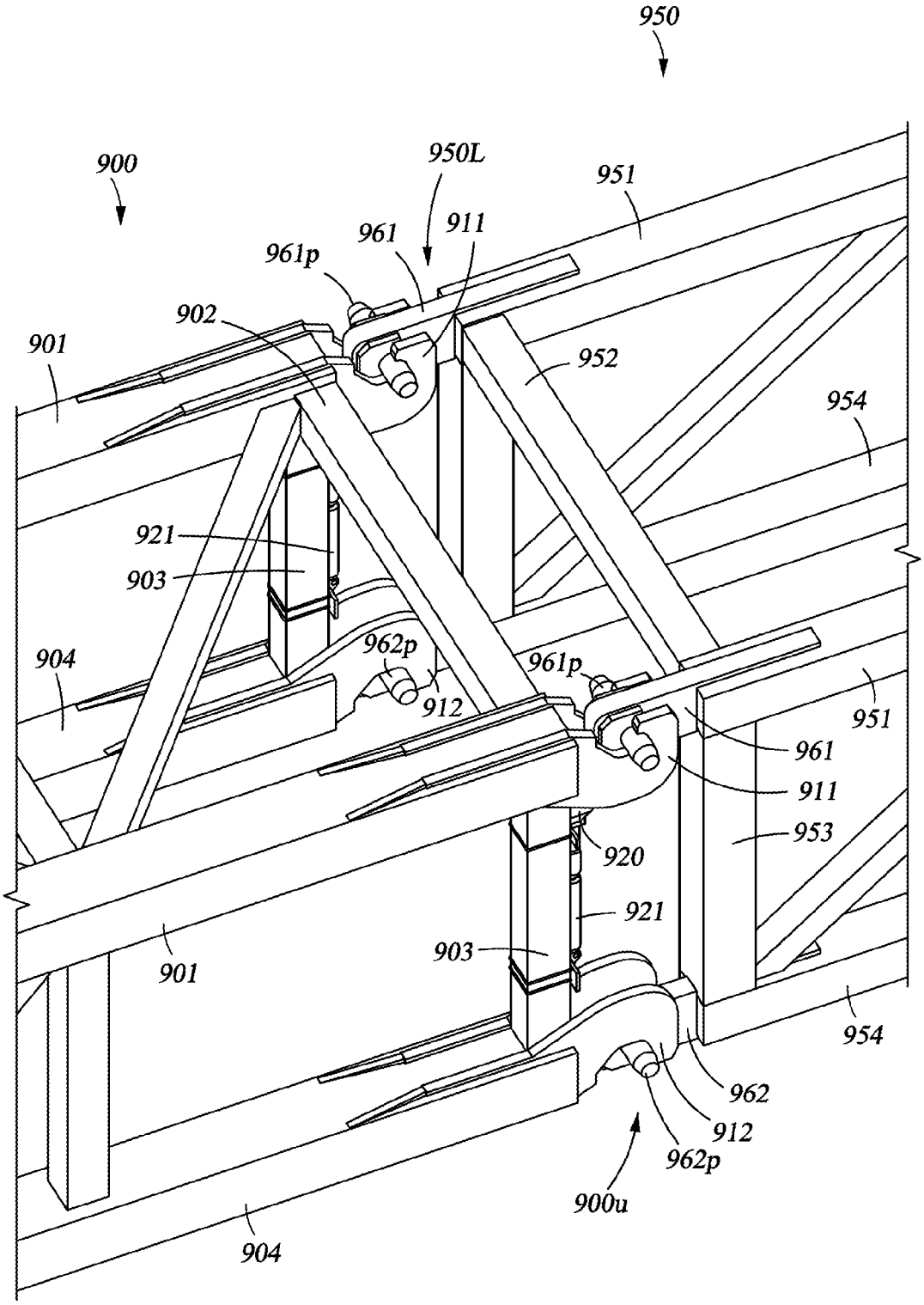
Figure 12D:
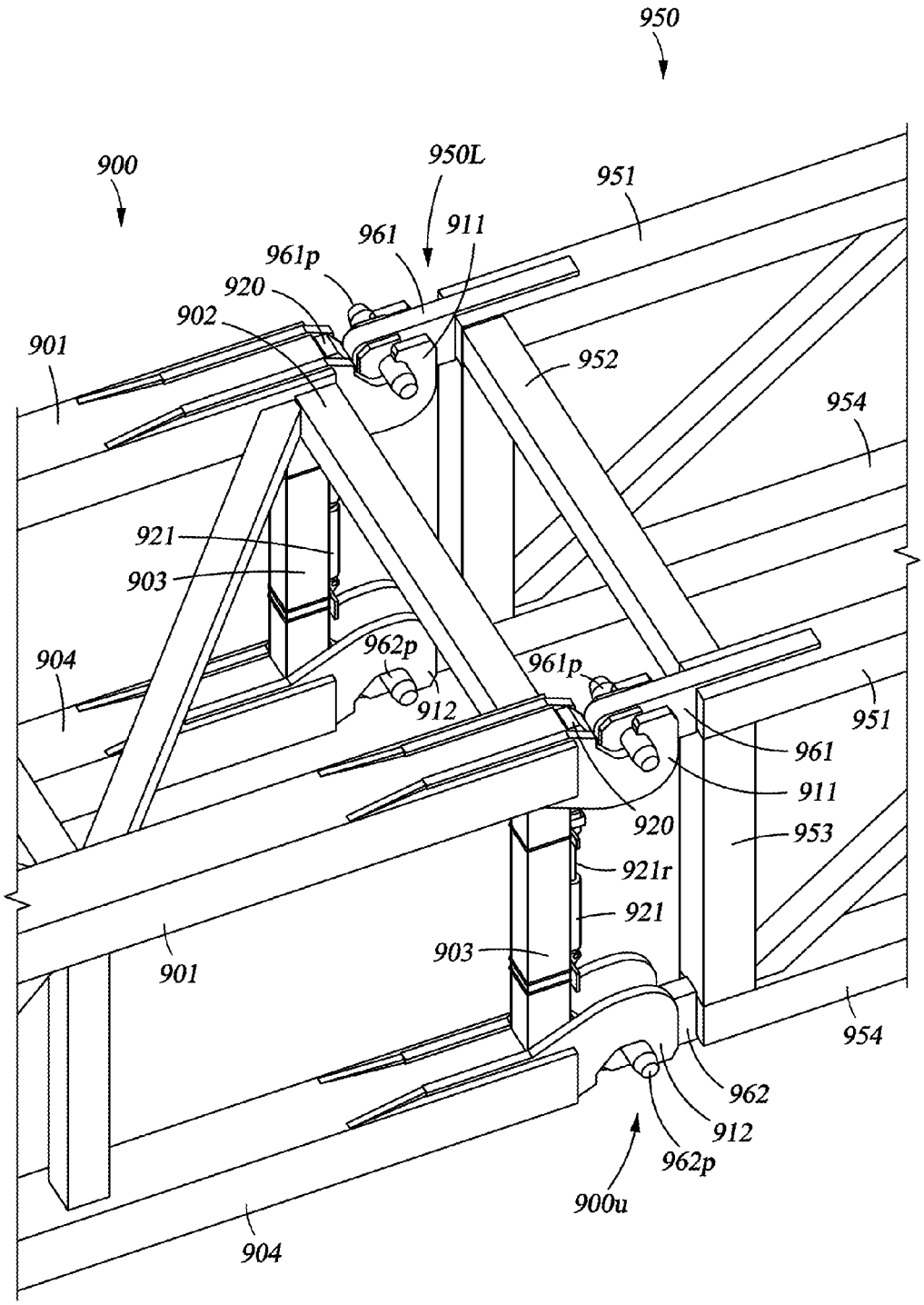
Figure 12E:
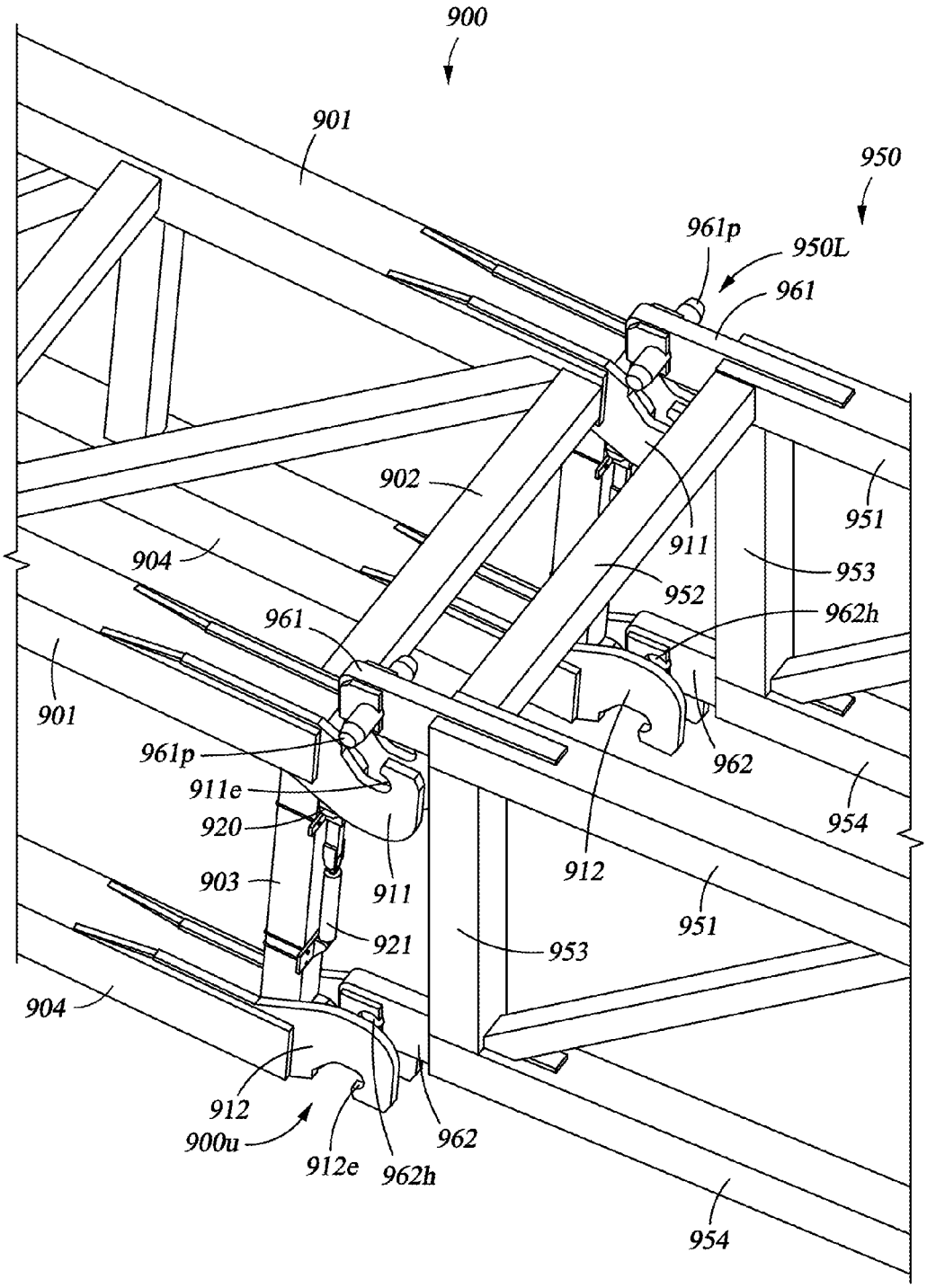
FIGS. 12E-12H are perspective views showing the illustrative bi-directionally raisable drilling rig mast assembly steps of FIGS. 12A-12D when viewed from a second mast section side of the bi-directional mast connection system illustrated in FIGS. 11A-11J.

As shown in FIGS. 12A and 12E, the upper end 900*u* of the first mast section 900 is angled downward so that the pin members 961*p* installed in each of the first bi-directional hook engagement connections 961 are positioned substantially above the hook engagement surfaces 911*e* of the bi-directional hooks 911, and so that the pin holes 962*h* in each of the second bi-directional hook engagement connections 962 are positioned substantially above the hook engagement surfaces 912*e* of the bi-directional hooks 912, as shown in FIG. 11G and described above. Moreover, the first and second hook engagement connections 961 and 962 are aligned so that each may be installed between pairs of respective bi-directional hooks 911 and 912.

Figure 12F:
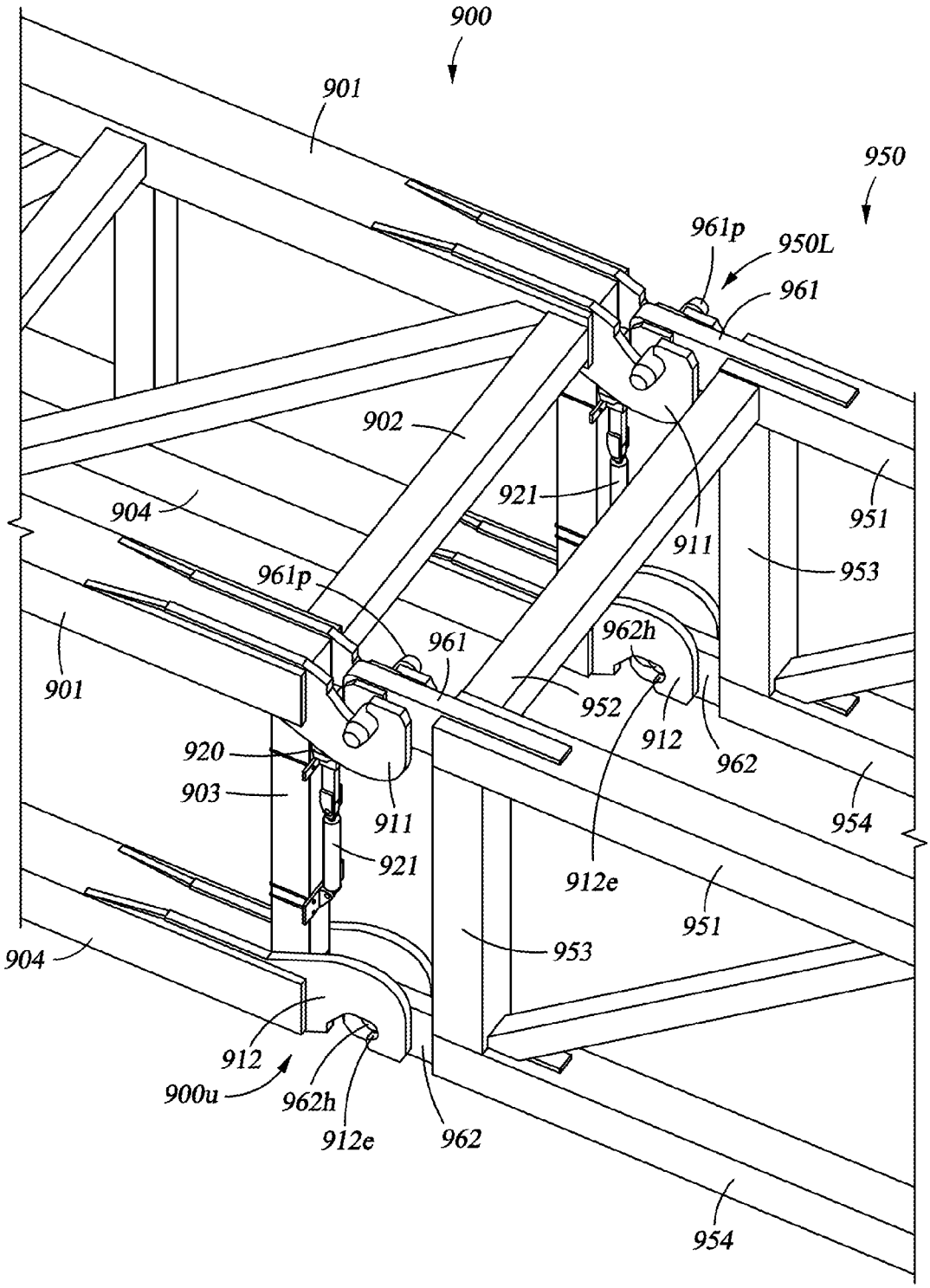

FIGS. 12B and 12F show a further illustrative step of connecting the lower end 950L of the second mast section 950 to the upper end 900*u* of the first mast section 900, after the first mast section 900 has been rotatably pivoted about an illustrative pinned mast connection (not shown in FIGS. 12A-12H, see, e.g., the pinned mast connection 703*p* shown in FIGS. 10A-10E) so that the first bi-directional hooks 911 are raised relative to the first bi-directional hook engagement connections 961. Furthermore, as shown in FIG. 12B, the pin members 961*p* have each slid into engaging contact with the hook engagement surfaces 911*e* on the first hooks 911, and the pin holes 962*h* in each of the second hook engagement connections 912 are substantially aligned with the pin engagement surfaces 912*e* on each of the second hooks 912.

Figure 12G:
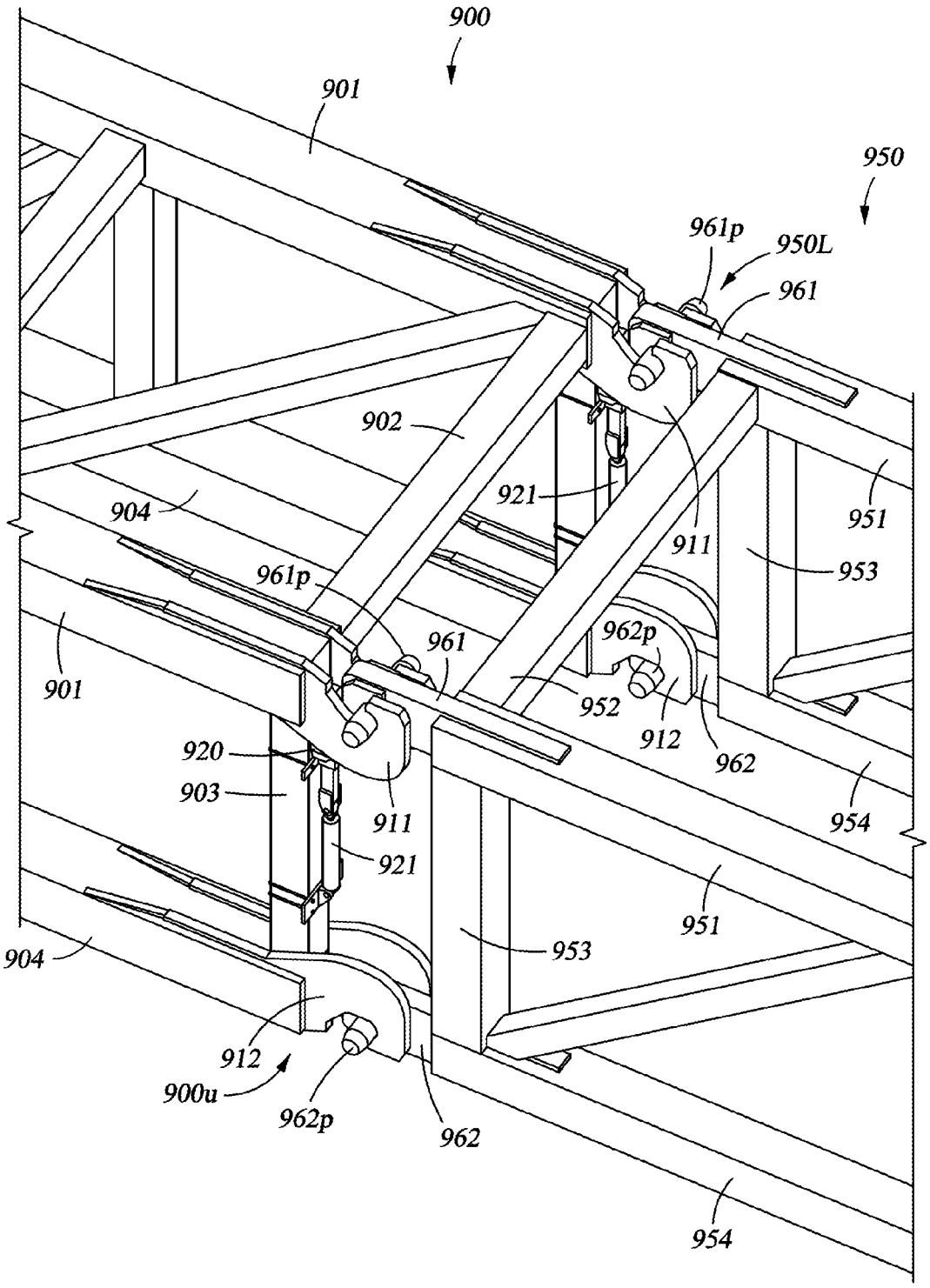
Figure 12H:
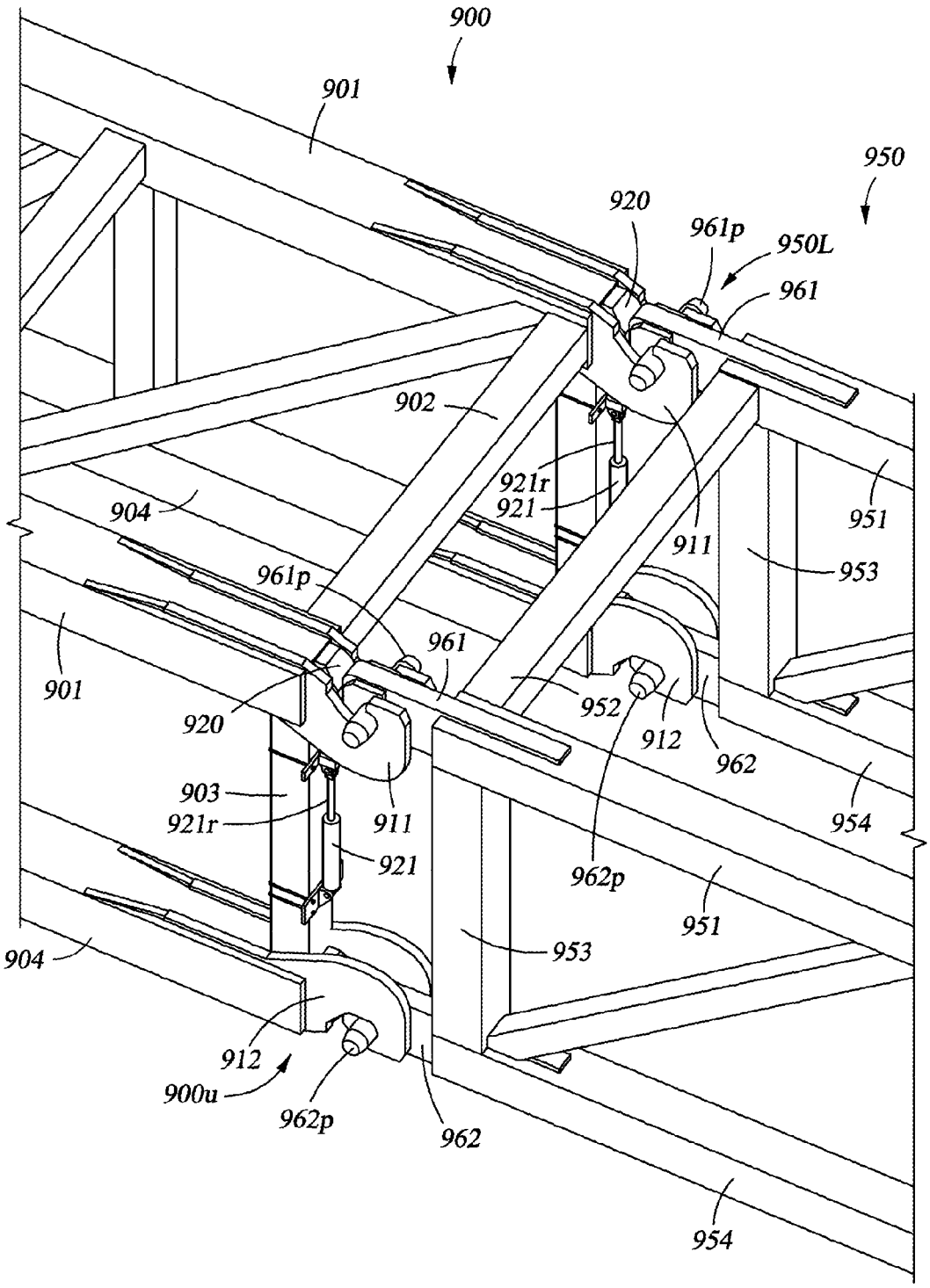

FIGS. 12C and 12G show the second mast section 950 and the first mast section 900 during a further mast assembly stage, wherein pin members 962*p* have also been installed into the pin holes 962*h* in each of the second bi-directional hook engagement connections 962, thereby locking in place the connection between the second hooks 912 and the second hook engagement connections 962. FIGS. 12D and 12H show the assembly of the bi-directionally raisable drilling rig mast during a subsequent stage, after the spacer positioning apparatuses 921 have been actuated so as to extend the push rods 921*r*, thereby pushing the first mast connection spacers 920 into final position between respective pairs of first bi-directional hooks 911.

As a result, the subject matter of the present disclosure provides details of various aspects of a mobile drilling rig having a movable center floor section and raisable substructure that can be used to facilitate the assembly and installation of large and/or heavy drilling rig components, such as the drilling rig mast sections and the rig drawworks and the like, without relying on the use of a conventional crane to lift and/or position the rig components. Furthermore, the disclosed subject matter is provides details of various aspects of bi-directionally raisable drilling rig masts, which may be assembled and erected from either side of an illustrative mobile drilling rig.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown. It is therefore evident that the particular embodiments disclosed above may be altered or modified and all such variations are considered within the scope and spirit of the invention. Accordingly, the protection sought herein is as set forth in the claims below.

What is claimed is:

1. A bi-directionally raisable drilling rig mast system, comprising:

a drilling rig mast comprising a bi-directional mast erection connection that is positioned on and fixedly attached to said drilling rig mast;

a first erection connection positioned proximate a setback side of a rig substructure;

a second erection connection positioned proximate a drawworks side of said rig substructure, said drawworks side being at an opposite end of said rig substructure from said setback side; and at least one mast erection apparatus having an upper end that is adapted to be pivotably attached to said drilling rig mast at said bi-directional mast erection connection and a lower end that is adapted to be pivotably attached to said first erection connection for pivotably erecting said drilling rig mast from said setback side of said rig substructure, said lower end being further adapted to be pivotably attached to said erection connection for pivotably erecting said drilling rig mast from said drawworks side of said rig substructure.

2. The bi-directionally raisable drilling rig mast system of claim 1, further comprising a mast support shoe attached to said rig substructure, wherein a bottom mast section of said drilling rig mast is adapted to be pivotably attached to said mast support shoe.

3. The bi-directionally raisable drilling rig mast system of claim 2, wherein said drilling rig mast comprises said bottom mast section and at least one further mast section removably attached to said bottom mast section.

4. The bi-directionally raisable drilling rig mast system of claim 3, wherein a connection between said bottom mast section and said at least one further mast section comprises a bi-directional mast connection system that is adapted to facilitate said removable attachment of said at least one further mast section to said bottom mast section after said bottom mast section has been pivotably attached to said mast support shoe.

5. The bi-directionally raisable drilling rig mast system of claim 4, wherein said bi-directional mast connection system is adapted to facilitate said removable attachment of said at least one further mast section to said bottom mast section when said drilling rig mast is oriented for erection from said setback side of said rig substructure, said bi-directional mast connection system being further adapted to facilitate said removable attachment of said at least one further mast section to said bottom mast section when said drilling rig mast is oriented for erection from said drawworks side of said rig substructure.

6. The bi-directionally raisable drilling rig mast system of claim 1, wherein said first erection connection is attached to a lower substructure box of said rig substructure proximate a first end of said lower substructure box, said first end corresponding to said setback side of said rig substructure.

7. The bi-directionally raisable drilling rig mast system of claim 6, wherein said second erection connection is on an extension skid attached to a second end of said lower substructure box that is opposite of said first end, said second end corresponding to said drawworks side of said rig substructure.

8. The bi-directionally raisable drilling rig mast system of claim 6, further comprising a mast support shoe attached to an upper substructure box of said rig substructure, wherein a bottom mast section of said drilling rig mast is adapted to be pivotably attached to said mast support shoe and said upper substructure box is adapted to be raised above said lower substructure box after said drilling rig mast has been pivotably erected above said upper substructure box.

9. The bi-directionally raisable drilling rig mast system of claim 1, wherein said drilling rig mast comprises a bi-directional drilling rig mast connection system, said bi-directional drilling rig mast connection system comprising a first bi-directional connection apparatus positioned at a lower end of a first mast section of said drilling rig mast and a second bi-directional connection apparatus positioned at an upper end of a second mast section of said drilling rig mast.

10. The bi-directionally raisable drilling rig mast system of claim 9, wherein said first bi-directional connection apparatus is adapted to engage said second bi-directional connection apparatus so as to removably attach said first mast section to said second mast section when said first and second mast sections are in a substantially horizontal orientation and an upper end of said first mast section is oriented toward said setback side of said rig substructure, said first bi-directional connection apparatus being further adapted to engage said second bi-directional connection apparatus so as to removably attach said first mast section to said second mast section when said first and second mast sections are in a substantially horizontal orientation and said upper end of said first mast section is oriented toward said drawworks side of said rig substructure.

11. A bi-directionally raisable drilling rig mast system, comprising:

a drilling rig mast comprising:

a bi-directional mast erection connection that is positioned on and fixedly attached to said drilling rig mast; and a bi-directional drilling rig mast connection system that is adapted to removably connect a bottom mast section of said drilling rig mast to at least one further mast section of said drilling rig mast when an upper end of said drilling rig mast is oriented toward a setback side of a rig structure and when said upper end of said drilling rig mast is oriented toward a drawworks side of said rig structure that is opposite of said setback side;

a first erection connection positioned proximate said setback side of said rig sub structure;

a second erection connection positioned proximate said drawworks side of said rig substructure; and a mast erection apparatus having an upper end that is adapted to be pivotably attached to said drilling rig mast at said bi-directional mast erection connection and a lower end that is adapted to be pivotably attached to said first erection connection for pivotably erecting said drilling rig mast from said setback side of said rig substructure, said lower end being further adapted to be pivotably attached to said second erection connection for pivotably erecting said drilling rig mast from said drawworks side of said rig substructure.

12. The bi-directionally raisable drilling rig mast system of claim 11, further comprising a mast support shoe attached to said rig substructure, wherein said bottom mast section of said drilling rig mast is adapted to be pivotably attached to said mast support shoe.

13. The bi-directionally raisable drilling rig mast system of claim 12, wherein said first erection connection is attached to a lower substructure box of said rig substructure proximate a first end of said lower substructure box, said second erection connection is attached to a second end of said lower substructure box, and said mast support shoe is attached to an upper substructure box of said rig substructure, said upper substructure box being adapted to be raised above said lower substructure box after said drilling rig mast has been pivotably erected above said rig substructure with said mast erection apparatus.

14. The bi-directionally raisable drilling rig mast system of claim 12, wherein said bi-directional drilling rig mast connection system comprises a first bi-directional connection apparatus positioned at an upper end of said bottom mast section and a second bi-directional connection apparatus positioned at a lower end of said at least one further mast section, said first bi-directional connection apparatus being adapted to engage said second bi-directional connection apparatus so as to removably connect said bottom mast section to said at least one further mast section while said bottom mast section is pivotably attached to said mast support shoe.

15. The bi-directionally raisable drilling rig mast system of claim 14, wherein said mast erection apparatus is adapted to pivotably raise said upper end of said bottom mast section so that said first bi-directional connection apparatus can engage said second bi-directional connection apparatus.

16. The bi-directionally raisable drilling rig mast system of claim 11, wherein said bi-directional mast erection connection is attached to said bottom mast section.

17. A bi-directionally raisable drilling rig mast system, comprising:

a drilling rig mast of a drilling rig, said drilling rig mast comprising a bi-directional mast erection connection;

a first erection connection that is adapted to be positioned proximate a first end of a lower substructure box of a drilling rig substructure, wherein said first end of said lower substructure box is oriented toward a setback side of said drilling rig;

a second erection connection that is adapted to be positioned proximate a second end of said lower substructure box, wherein said second end of said lower substructure box is oriented toward a drawworks side of said drilling rig;

a mast support shoe attached to an upper substructure box of said drilling rig substructure, wherein a lower end of said drilling rig mast is adapted to be pivotably attached to said mast support shoe; and a mast erection apparatus that is adapted to pivotably erect said drilling rig mast above said upper substructure box while said lower end of said drilling rig mast is pivotably attached to said mast support shoe, said mast erection apparatus having an upper end and a lower end, wherein said upper end of said mast erection apparatus is adapted to be pivotably attached to said bi-directional mast erection connection for pivotably erecting said drilling rig mast, said lower end of said mast erection apparatus is adapted to be pivotably attached to said first erection connection for erecting said drilling rig mast from said setback side of said drilling rig, said lower end of said mast erection apparatus being further adapted to be pivotably attached to said second erection connection for erecting said drilling rig mast from said drawworks side of said drilling rig.

18. The bi-directionally raisable drilling rig mast system of claim 17, wherein said drilling rig mast comprises a bottom mast section and at least one further mast section that is adapted to be removably attached to said bottom mast section, wherein said bottom mast section of said drilling rig mast is adapted to be pivotably attached to said mast support shoe.

19. The bi-directionally raisable drilling rig mast system of claim 18, wherein a connection between said bottom mast section and said at least one further mast section comprises a bi-directional mast connection system that is adapted to facilitate said removable attachment of said at least one further mast section to said bottom mast section after said bottom mast section has been pivotably attached to said mast support shoe.

* * * * *